US009864334B2

(12) United States Patent
Ikeda et al.

(10) Patent No.: US 9,864,334 B2
(45) Date of Patent: Jan. 9, 2018

(54) COOLING DEVICE AND IMAGE FORMING APPARATUS INCLUDING SAME

(71) Applicants: Keisuke Ikeda, Kanagawa (JP); Tomoyasu Hirasawa, Kanagawa (JP); Kenichi Takehara, Kanagawa (JP); Hiromitsu Fujiya, Kanagawa (JP); Keisuke Yuasa, Kanagawa (JP); Yasuaki Toda, Kanagawa (JP); Susumu Tateyama, Ibaraki (JP); Hiroaki Miyagawa, Ibaraki (JP); Kenji Ishii, Ibaraki (JP); Takeshi Watanabe, Ibaraki (JP)

(72) Inventors: Keisuke Ikeda, Kanagawa (JP); Tomoyasu Hirasawa, Kanagawa (JP); Kenichi Takehara, Kanagawa (JP); Hiromitsu Fujiya, Kanagawa (JP); Keisuke Yuasa, Kanagawa (JP); Yasuaki Toda, Kanagawa (JP); Susumu Tateyama, Ibaraki (JP); Hiroaki Miyagawa, Ibaraki (JP); Kenji Ishii, Ibaraki (JP); Takeshi Watanabe, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/229,924

(22) Filed: Aug. 5, 2016

(65) Prior Publication Data

US 2016/0342136 A1 Nov. 24, 2016

Related U.S. Application Data

(60) Division of application No. 14/694,514, filed on Apr. 23, 2015, now Pat. No. 9,465,358, which is a (Continued)

(30) Foreign Application Priority Data

Dec. 27, 2012 (JP) ..... 2012-285720
Mar. 7, 2013 (JP) ..... 2013-045277
Mar. 15, 2013 (JP) ..... 2013-054309

(51) Int. Cl.
*G03G 21/20* (2006.01)
*G03G 15/00* (2006.01)
*G03G 15/20* (2006.01)

(52) U.S. Cl.
CPC ..... *G03G 21/20* (2013.01); *G03G 15/6529* (2013.01); *G03G 15/6573* (2013.01); *G03G 15/2021* (2013.01); *G03G 2215/0129* (2013.01)

(58) Field of Classification Search
None
See application file for complete search history.

(56) References Cited

U.S. PATENT DOCUMENTS 5,970,301 A 10/1999 De Cock
2009/0103959 A1 4/2009 Koyama et al.
(Continued)

FOREIGN PATENT DOCUMENTS

JP H08-083009 3/1996
JP 2002-99169 A 4/2002
(Continued)

OTHER PUBLICATIONS

JP_2010002644_A_T Machine Translation, Japan, 2010, Yamamiya.*
(Continued)

*Primary Examiner* — Victor Verbitsky
(74) *Attorney, Agent, or Firm* — Oblon, McClelland, Maier & Neustadt, L.L.P.

(57) ABSTRACT

A recording-material cooling device includes a first cooling member, a second cooling member, an approach-and-separation member, and a positioning member. The first cooling member is disposed at a first face side of a recording material to absorb heat of the recording material. The second cooling member is disposed at a second face side of the recording material to absorb heat of the recording material. The approach-and-separation member brings the first cooling member and the second cooling member close to and away from each other. The positioning member positions the first cooling member and the second cooling member relatively brought close to each other by the approach-and-separation member.

12 Claims, 42 Drawing Sheets

Related U.S. Application Data continuation of application No. 14/140,854, filed on Dec. 26, 2013, now Pat. No. 9,046,858.

(56) References Cited

U.S. PATENT DOCUMENTS

| | | | | |
|---|---|---|---|---|
| 2011/0052249 | A1* | 3/2011 | Iijima | G03G 15/6573 399/94 |
| 2012/0263491 | A1 | 10/2012 | Fujiya et al. | |
| 2012/0315069 | A1 | 12/2012 | Ikeda et al. | |
| 2013/0259512 | A1 | 10/2013 | Ikeda et al. | |

FOREIGN PATENT DOCUMENTS

| | | | | |
|---|---|---|---|---|
| JP | 2006-201657 | | | 8/2006 |
| JP | 2007-304459 | A | | 11/2007 |
| JP | 2009-103822 | | | 5/2009 |
| JP | 2009-103822 | A | | 5/2009 |
| JP | 2010-002644 | | | 1/2010 |
| JP | 2011-057389 | | | 3/2011 |
| JP | 2011-123259 | A | | 6/2011 |
| JP | 2011123259 | A | * | 6/2011 |
| JP | 2012-098677 | | | 5/2012 |
| JP | 2012-98677 | A | | 5/2012 |
| JP | 2012-173640 | | | 9/2012 |
| JP | 2012-226046 | A | | 11/2012 |
| JP | 2012-255964 | A | | 12/2012 |

OTHER PUBLICATIONS

JP_2011123259_A_T Machine Translation, Japan, Sasaki, 2011.*

Office Action dated Oct. 26, 2016 in Japanese Patent Application No. 2013-45277.

Office Action dated Nov. 11, 2016 in Japanese Patent application No. 2013-54309.

Office Action dated Apr. 7, 2017 in Japanese Patent Application No. 2013-054309.

* cited by examiner

COOLING DEVICE AND IMAGE FORMING APPARATUS INCLUDING SAME

CROSS-REFERENCE TO RELATED APPLICATIONS

This patent application is a division of U.S. application Ser. No. 14/694,514, filed Apr. 23, 2015, which is continuation of U.S. application Ser. No. 14/140,854 (now U.S. Pat. No. 9,046,858), filed Dec. 26, 2013, which is based on and claims priority pursuant to 35 U.S.C. §119 to Japanese Patent Application Nos. 2012-285720, filed on Dec. 27, 2012, 2013-045277, filed on Mar. 7, 2013, and 2013-054309, filed on Mar. 15, 2013, in the Japan Patent Office. The contents of each of the above are hereby incorporated by reference herein.

BACKGROUND

Technical Field

Exemplary embodiments of this disclosure relate to a cooling device and an image forming apparatus including the cooling device.

Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. Such an electrophotographic image forming apparatus may have a fixing device to fuse toner under heat and fix a toner image on a recording material (e.g., a sheet of paper). Such recording materials having toner images fixed thereon may be stacked on an output tray of the image forming apparatus.

In such a case, the recording materials having toner images are stacked one on another on, e.g., the output tray in heated state. As a result, toner is softened by heat retained in the stacked recording materials, and pressure due to the weight of the stacked recording materials may cause the recording materials to adhere to each other with softened toner. If the recording materials adhering to each other are forcefully separated, the fixed toner images might be damaged. Such an adhering state of the stacked recording materials is referred to as blocking. To suppress blocking, a cooling device may be employed to cool a recording material after a toner image is fixed on the recording material under heat.

For example, a cooling device is proposed to absorb heat from a recording material with cooling members while sandwiching and conveying the recording material by conveyance belts (e.g., JP-2010-002644-A1, JP-2006-201657-A1, and JP-H8-083009-A1). In other words, the cooling members absorb heat from a recording material via the conveyance belts. Alternatively, it is known that cooling the recording material from both faces rather than a single face allows more efficient cooling performance (e.g., JP-2012-098677-A1). The cooling members may be provided with a cooling-liquid circuit including a heat receiving part, a radiation part, and a circulation channel. The cooling-liquid circuit causes the cooling members to function as the heat receiving part to receive heat from a recording material. The radiation part radiates heat of the heat receiving part. Cooling liquid is circulated through the circulation circuit via the heat receiving part and the radiation part.

BRIEF SUMMARY

In at least one exemplary embodiment of this disclosure, there is provided a recording-material cooling device including a first cooling member, a second cooling member, an approach-and-separation member, and a positioning member. The first cooling member is disposed at a first face side of a recording material to absorb heat of the recording material. The second cooling member is disposed at a second face side of the recording material to absorb heat of the recording material. The approach-and-separation member brings the first cooling member and the second cooling member close to and away from each other. The positioning member positions the first cooling member and the second cooling member relatively brought close to each other by the approach-and-separation member.

In at least one exemplary embodiment of this disclosure, there is provided a recording-material cooling device including a first cooling member, a second cooling member, and an approach-and-separation member. The first cooling member transports a recording material and absorbs heat of the recording material. The first cooling member is disposed at a first face side of the recording material transported. The second cooling member transports the recording material and absorbs heat of the recording material. The second cooling member is disposed at a second face side of the recording material. The approach-and-separation member brings the first cooling member and the second cooling member close to and away from each other. The first cooling member and the second cooling member have different weights from each other. A lighter one of the first cooling member and the second cooling member is displaceable relative to the other heavier one thereof via the approach-and-separation member. With the heavier one fixed, the lighter one is displaceable via the approach-and-separation member to bring the first cooling member and the second cooling member away from each other.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
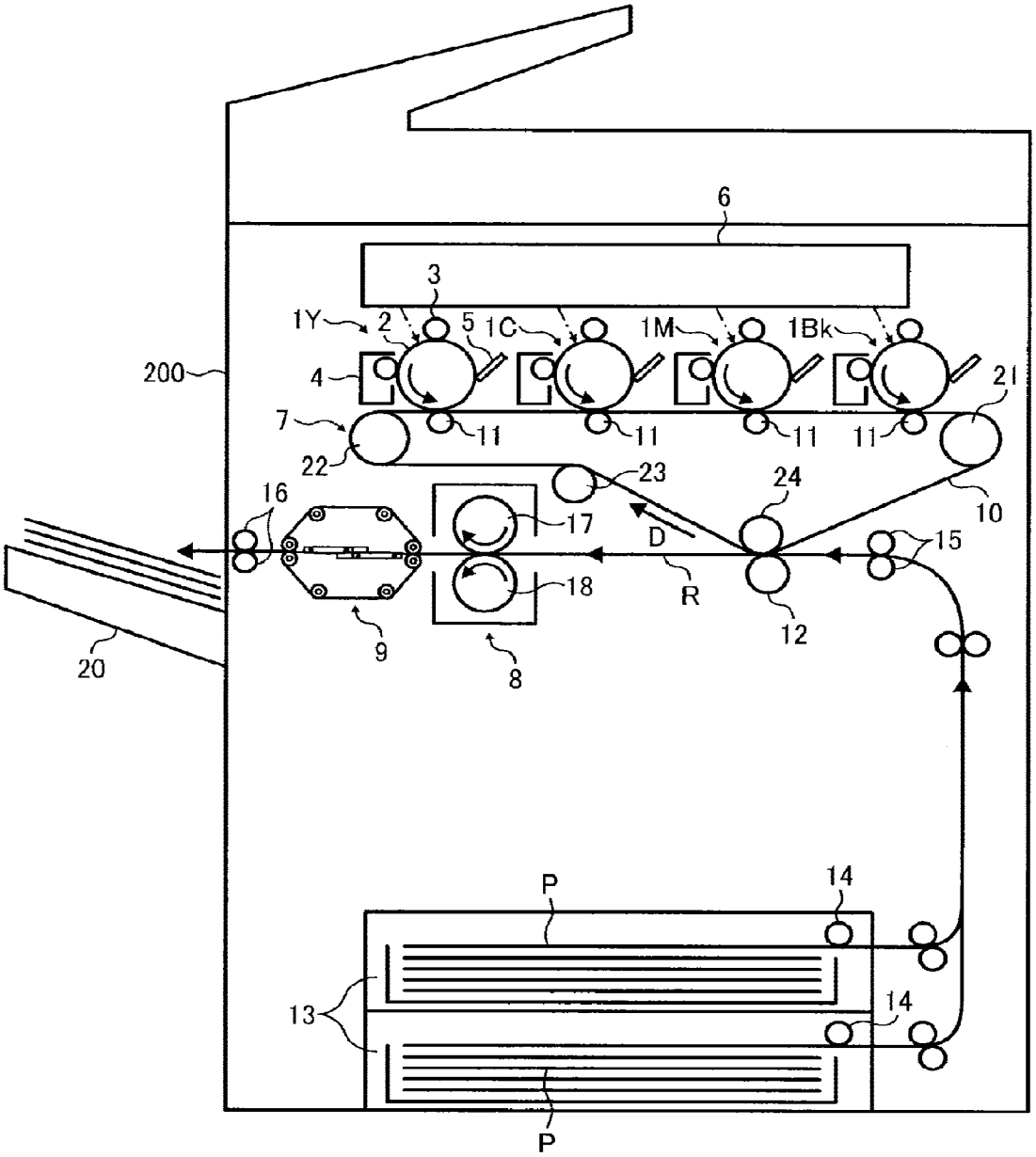
FIG. 1 is a schematic view of an image forming apparatus according to some exemplary embodiments of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

FIG. 1 is a schematic view of an image forming apparatus according to some exemplary embodiments of this disclosure. The image forming apparatus illustrated in FIG. 1 includes a tandem-type image forming section in which four process units 1Y, 1C, 1M, and 1Bk serving as image forming units are arranged in tandem. The process units 1Y, 1C, 1M, and 1Bk are removably mountable relative to an apparatus body 200 of the image forming apparatus and have substantially the same configuration except for containing different color toners of yellow (Y), cyan (C), magenta (M), and black (Bk) corresponding to color separation components of a color image.

Specifically, each of the process units 1Y, 1C, 1M, and 1Bk includes, e.g., a photoreceptor 2, a charging roller 3, a developing device 4, and a cleaning blade 5. The photoreceptor 2 has, e.g., a drum shape and serves as a latent image carrier. The charging roller 3 serves as a charging device to charge a surface of the photoreceptor 2. The developing device 4 forms a toner image on the surface of the photoreceptor 2. The cleaning blade 5 serves as a cleaner to clean the surface of the photoreceptor 2. In FIG. 1, the photoreceptor 2, the charging roller 3, the developing device 4, and the cleaning blade 5 of the process unit 1Y for yellow are represented by the photoreceptor 2Y, the charging roller 3Y, the developing device 4Y, and the cleaning blade 5Y, respectively. Regarding the other process units 1C, 1M, and 1Bk, color index are omitted for simplicity.

In FIG. 1, above the process units 1Y, 1C, 1M, and 1Bk, an exposing device 6 is disposed to expose the surface of the photoreceptor 2. The exposing device 6 includes, e.g., a light source, polygon mirrors, f– lenses, and reflection lenses to irradiate a laser beam onto the surface of the photoreceptor 2.

A transfer device 7 is disposed below the process units 1Y, 1C, 1M, and 1Bk. The transfer device 7 includes an intermediate transfer belt 10 formed of an endless belt serving as a transfer body. The intermediate transfer belt 10 is wound around a plurality of rollers 21 to 24 serving as support members. One of the rollers 21 to 24 is rotated as a driving roller to circulate (rotate) the intermediate transfer belt 10 in a direction indicated by an arrow D in FIG. 1.

Four primary transfer rollers 11 serving as primary transfer devices are disposed at positions at which the primary transfer rollers 11 oppose the respective photoreceptors 2. At the respective positions, the primary transfer rollers 11 are pressed against an inner circumferential surface of the intermediate transfer belt 10. Thus, primary transfer nips are formed at positions at which the photoreceptors 2 contact pressed portions of the intermediate transfer belt 10. Each of the primary transfer rollers 11 is connected to a power source, and a predetermined direct current (DC) voltage and/or an alternating current (AC) voltage are supplied to the primary transfer rollers 11.

A secondary transfer roller 12 serving as a second transfer device is disposed at a position at which the secondary transfer roller 12 opposes the roller 24, which is one of the rollers around which the intermediate transfer belt 10 is wound. The secondary transfer roller 12 is pressed against an outer circumferential surface of the intermediate transfer belt 10. Thus, a secondary transfer nip is formed at a position at which the secondary transfer roller 12 and the intermediate transfer belt 10 contact each other. Like the primary transfer rollers 11, the secondary transfer roller 12 is connected to a power source, and a predetermined direct current (DC) voltage and/or an alternating current (AC) voltage are supplied to the secondary transfer roller 12.

Below the apparatus body 200 is a plurality of feed trays 13 to store sheet-type recording materials P, such as a sheet of paper or overhead projector (OHP) sheet. Each feed tray 13 is provided with a feed roller 14 to feed the recording materials P stored. An output tray 20 is mounted on an outer surface of the apparatus body 200 at the left side in FIG. 1 to stack recording materials P discharged to an outside of the apparatus body 200.

The apparatus body 200 includes a transport path R to transport a recording material P from the feed trays 13 to the output tray 20 through the secondary transfer nip. On the transport path R, registration rollers 15 are disposed upstream from the secondary transfer roller 12 in a transport direction of a recording material (hereinafter, recording-material transport direction). A fixing device 8, a cooling device 9, and paired output rollers 16 are disposed in turn at positions downstream from the secondary transfer roller 12 in the recording-material transport direction. The fixing device 8 includes a fixing roller 17 and a pressing roller 18. The fixing roller serves as a fixing member including an internal heater. The pressing roller 18 serves as a pressing member to press the fixing roller 17. A fixing nip is formed at a position at which the fixing roller 17 and the pressing roller 18 contact each other.

Next, a basic operation of the image forming apparatus is described with reference to FIG. 1. When imaging operation is started, the photoreceptor 2 of each of the process units 1Y, 1C, 1M, and 1Bk is rotated counterclockwise in FIG. 1, and the charging roller 3 uniformly charges the surface of the photoreceptor 2 with a predetermined polarity. Based on image information of a document read by a reading device, the exposing device 6 irradiates laser light onto the charged surface of the photoreceptor 2 to form an electrostatic latent image on the surface of the photoreceptor 2. At this time, image information exposed to each photoreceptor 2 is single-color image information obtained by separating a desired full-color image into single-color information on yellow, cyan, magenta, and black. Each developing device 4 supplies toner onto the electrostatic latent image formed on the photoreceptor 2, thus making the electrostatic latent images a visible image as a toner image.

One of the rollers 21 to 24 around which the intermediate transfer belt 10 is wound is driven for rotation to circulate the intermediate transfer belt 10 in the direction D in FIG. 1. A voltage having a polarity opposite a charged polarity of toner and subjected to constant voltage or current control is supplied to each of the primary transfer rollers 11. As a result, a transfer electric field is formed at the primary transfer nip between each primary transfer roller 11 and the opposing photoreceptor 2. Toner images of respective colors on the photoreceptors 2 are transferred one on another onto the intermediate transfer belt 10 by the transfer electric fields formed at the primary transfer nips. Thus, the intermediate transfer belt 10 bears a full-color toner image on the surface of the intermediate transfer belt 10. Residual toner remaining on each photoreceptor 2 without being transferred onto the intermediate transfer belt 10 is removed with the cleaning blade 5.

With rotation of the feed roller 14, a recording material P is fed from the corresponding feed tray 13. The recording material P is further sent to the secondary transfer nip between the secondary transfer roller 12 and the intermediate transfer belt 10 by the registration rollers 15 so as to synchronize with the full-color toner image on the intermediate transfer belt 10. At this time, a transfer voltage of the polarity opposite the charged polarity of toner of the toner image on the intermediate transfer belt 10 is supplied to the secondary transfer roller 12. As a result, a transfer electric field is formed at the secondary transfer nip. By the transfer electric field formed at the secondary transfer nip, the toner image on the intermediate transfer belt 10 is collectively transferred onto the recording material P. Then, the recording material P is sent into the fixing device 8, and the fixing roller 17 and the pressing roller 18 apply heat and pressure to fix the toner image on the recording material P. After the recording material P is cooled with the cooling device 9, the paired output rollers 16 output the recording material P onto the output tray 20.

The above description relates to image forming operation for forming a full color image on a recording material. In other image forming operation, a single color image can be formed by any one of the process units 1Y, 1M, 1C, and 1Bk, or a composite color image of two or three colors can be formed by two or three of the process units 1Y, 1M, 1C, and 1Bk.

Figure 2:
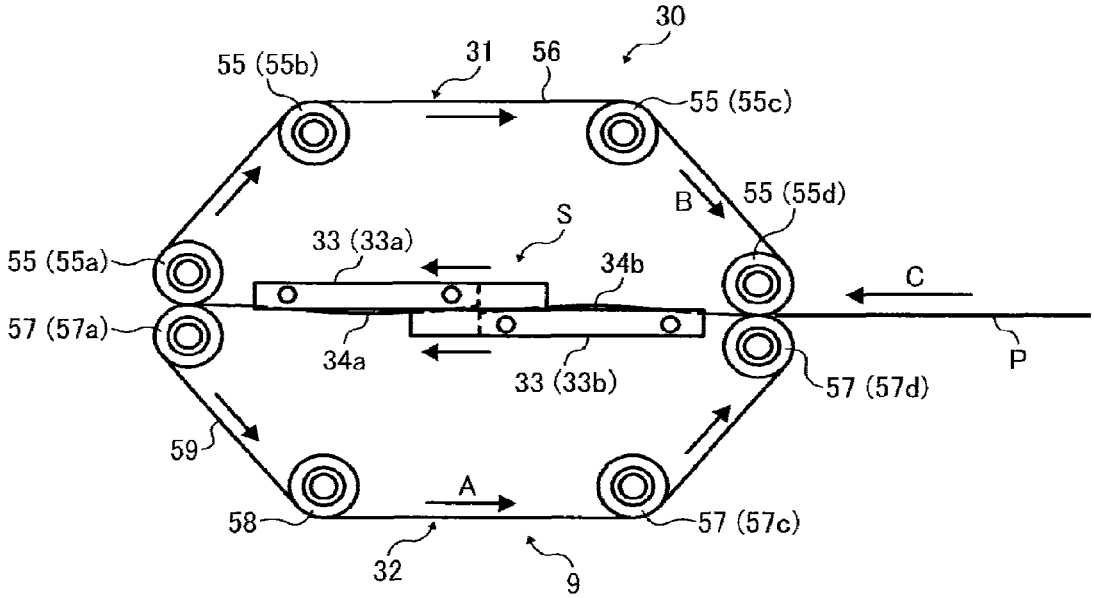
FIG. 2 is a side view of a cooling device disposed in the image forming apparatus illustrated in FIG. 1.
Figure 3:
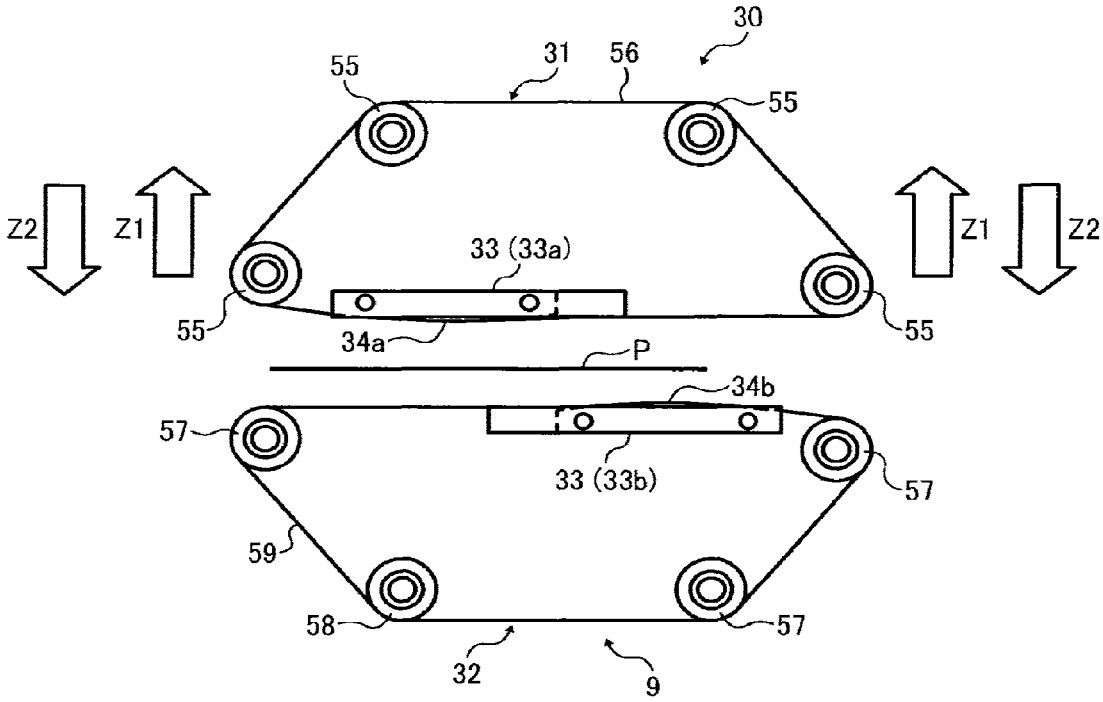
FIG. 3 is a side view of the cooling device in a state in which paired cooling members are placed away from each other.

As illustrated in, e.g., FIGS. 2 and 3, the cooling device 9 has a cooling member 33 to cool a sheet-type recording material P conveyed by travelling of belts of a belt transport unit 30. The belt transport unit 30 includes a first transport assembly 31 and a second transport assembly 32. The first transport assembly 31 is disposed at one face side (front face side or upper face side) of the sheet-type recording material P. The second transport assembly 32 is disposed at the other face side (back face side or lower face side) of the sheet-type recording material P. The belt transport unit 30 also includes a pair of the cooling members 33*a* and 33*b*. The cooling member 33*a* is disposed at one face side (front face side or upper face side) of the sheet-type recording material P. The cooling member 33*b* is disposed at the other face side (back face side or lower face side) of the sheet-type recording material P.

As illustrated in FIGS. 4 to 7, each of the cooling members 33 includes a cooling body 35 of a rectangular flat-plate shape and lateral edges 36*a* and 36*b* disposed at lateral faces of the cooling body 35. The lateral edges 36*a* and 36*b* of the cooling member 33*a* has contact portions 37*a* and 37*b*, respectively. The contact portions 37*a* and 37*b* protrude toward an upstream side beyond an upstream edge of the cooling body 35 in a recording-material transport direction indicated by an arrow C in FIG. 2. The lateral edges 36*a* and 36*b* of the cooling member 33*b* include contact portions 38*a* and 38*b* protruding toward a downstream side beyond a downstream edge of the cooling body 35 in the recording-material transport direction C.

Figure 4:
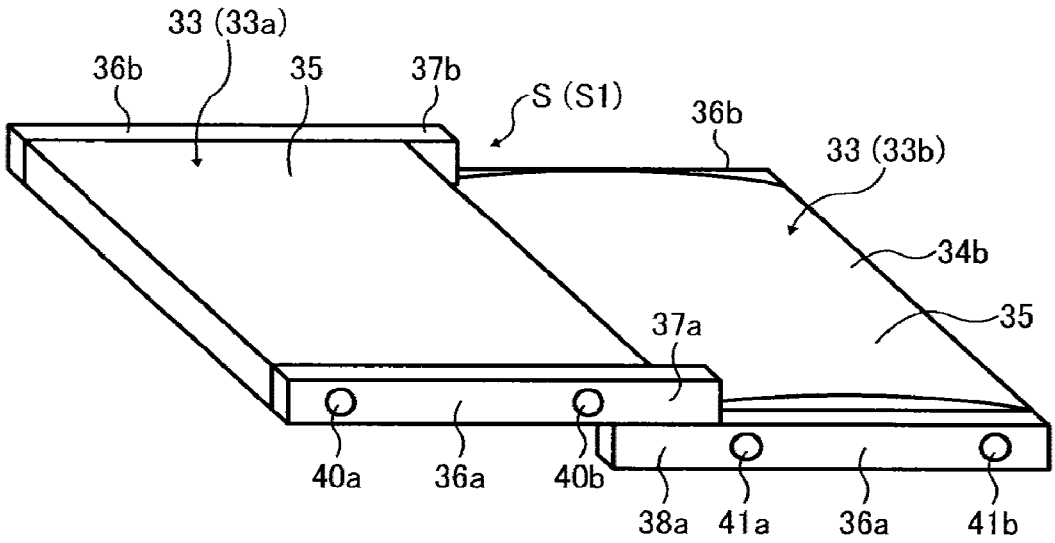
FIG. 4 is a perspective view of the cooling members of the cooling device.
Figure 5:
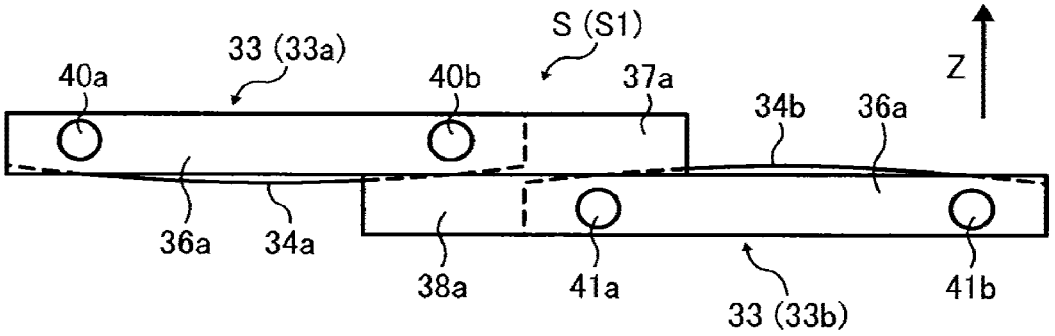
FIG. 5 is a side view of the cooling members of the cooling device.
Figure 6:
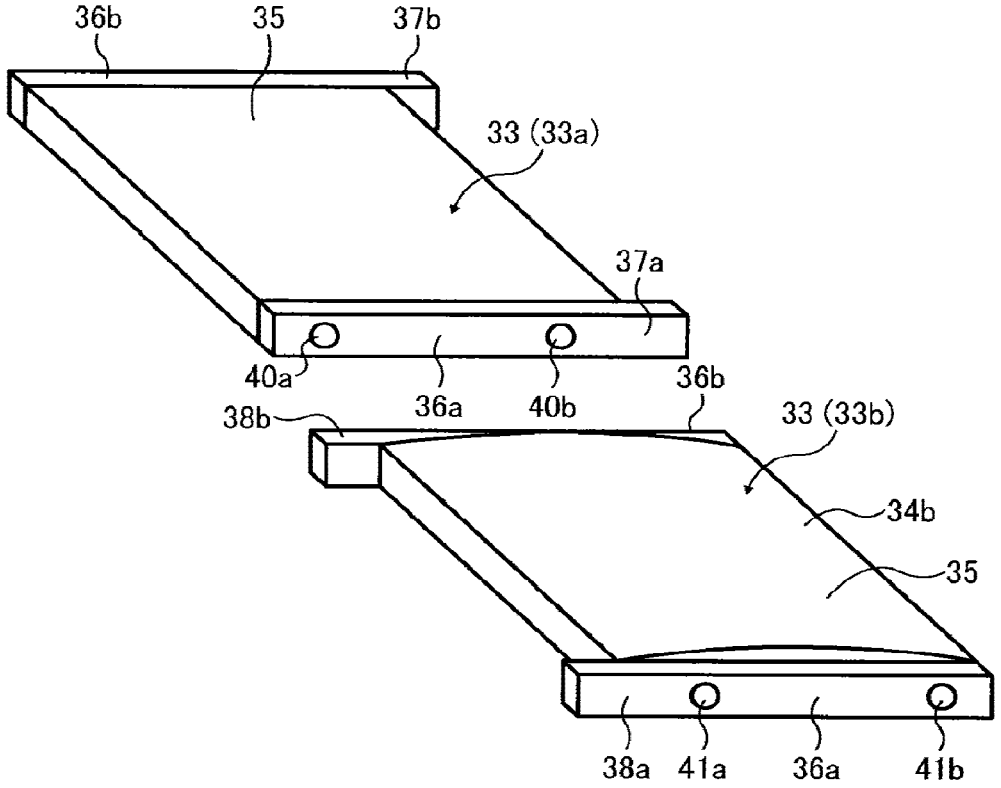
FIG. 6 is a perspective view of the cooling members of the cooling device in a separated state.
Figure 7:
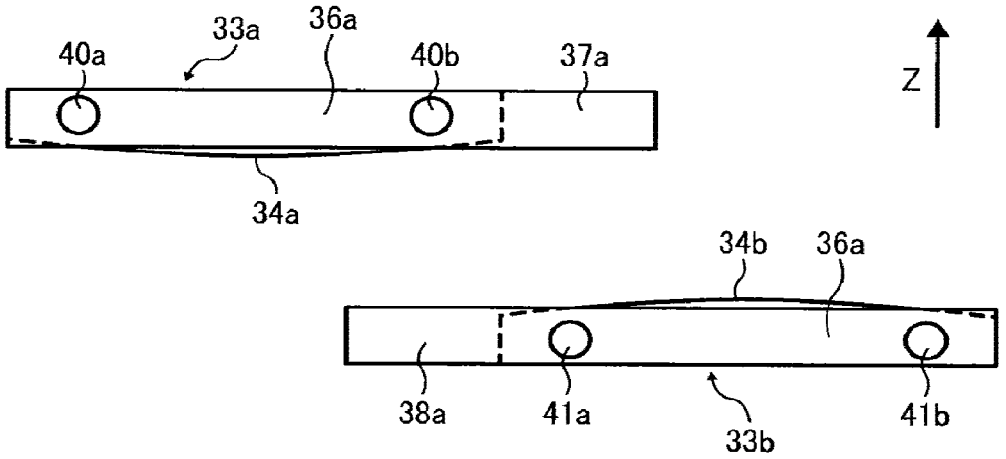
FIG. 7 is a perspective view of the cooling members of the cooling device.
Figure 8:
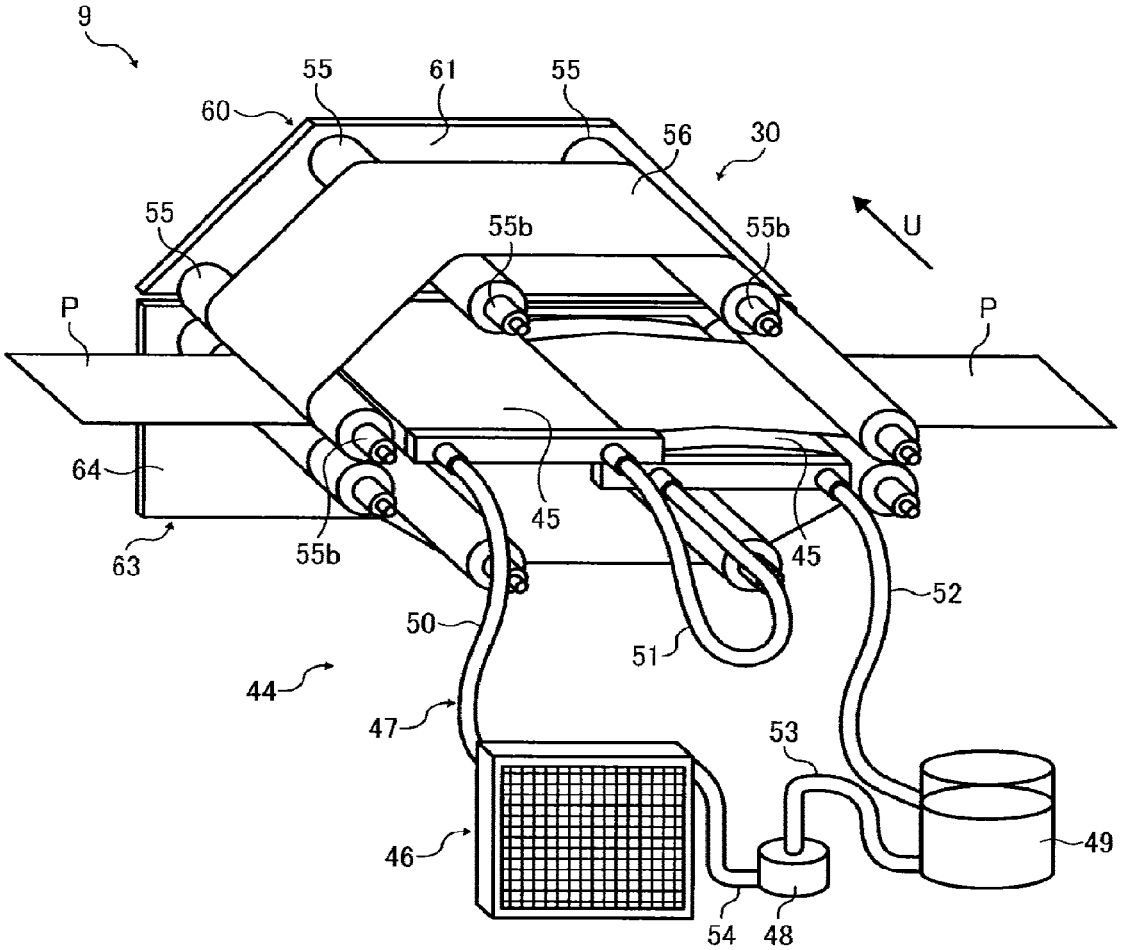
FIG. 8 is a perspective view of the cooling device seen from a rear side thereof.

In such a case, as illustrated in, e.g., FIGS. 4 and 5, in a state in which the contact portions 37*a* and 37*b* of the cooling member 33*a* are in contact with the contact portions 38*a* and 38*b*, respectively, of the cooling member 33*b*, the contact portions 37*a* and 37*b* are overlapped with the contact portions 38*a* and 38*b* so that the cooling member 33*a* and the cooling member 33*b* are offset from each other in the transport direction of the sheet-type recording material. The cooling body 35 of the cooling member 33*a* has, as a lower surface, a heat absorbing surface 34*a* of an arc surface shape slightly protruding downward. The cooling body 35 of the cooling member 33*b* has a heat absorbing surface 34*b* of an arc surface shape slightly protruding upward.

Each of the cooling members 33*a* and 33*b* includes a cooling liquid channel through which cooling liquid flows. The contact portions 37*a* and 38*b* disposed at a rear side of the cooling device have openings 40*a*, 40*b*, 41*a*, and 41*b* of circulation channels.

In other words, as illustrated in FIGS. 8 to 11, the cooling device has a cooling-liquid circuit 44. The cooling-liquid circuit 44 includes a heat receiving part 45 to receive heat from a recording material P serving as a heat generating part, a heat dissipating part 46 to radiate heat of the heat receiving part 45, and a circulation channel 47 to circulate cooling liquid through the heat receiving part 45 and the heat dissipating part 46. The circulation channel 47 includes a pump 48 to circulate cooling liquid and a liquid tank 49 to store cooling liquid, thus causing the cooling members 33*a* and 33*b* to function as the heat receiving part 45. The heat dissipating part 46 includes, e.g., a radiator. The cooling liquid is, for example, magnetic fluid. Examples of the magnetic fluid include, e.g., water, hydrocarbon oil, or fluorine oil as medium and ferromagnetic ultrafine particles, such as high concentration of magnetite, dispersed in stable state in the medium. Additionally, surface-active agent is chemically attached to surfaces of the ferromagnetic ultrafine particles.

The circulation channel 47 includes pipes 50 to 54. The pipe 50 connects the opening 40*a* of the cooling member 33*a* to the heat dissipating part 46 (e.g., radiator). The pipe 51 connects the opening 40*b* of the cooling member 33*a* to the opening 41*a* of the cooling member 33*b*. The pipe 52 connects the opening 41*b* of the cooling member 33*b* to the liquid tank 49. The pipe 53 connects the liquid tank 49 to the pump 48. The pipe 54 connects the pump 48 to the heat dissipating part 46.

The first transport assembly 31 includes a plurality of rollers 55 and a belt (conveyance belt) 56 wound around the plurality of rollers 55. The second transport assembly 32 includes a plurality of rollers 57, a single roller (driving roller) 58, and a belt (conveyance belt) 59 wound around the plurality of rollers 57 and the driving roller 58.

Accordingly, a recording material P is sandwiched and conveyed by the belt 56 of the first transport assembly 31 and the belt 59 of the second transport assembly 32. In other words, as illustrated in FIG. 2, the belt 59 is traveled in a direction indicated by an arrow A by a driving unit. With travel of the belt 59, the belt 56 of the first transport assembly 31 is traveled in a direction indicated by an arrow B via the recording material P sandwiched between the belts 56 and 59. Thus, the recording material P is conveyed from an upstream side to a downstream side in the transport direction indicated by the arrow C in FIG. 2.

As illustrated in FIGS. 8 to 11, the plurality of rollers 55 of the first transport assembly 31 is held by a holding frame 60. The holding frame 60 includes a pair of side plates 61 and 62 to rotatably support shaft ends of the plurality of rollers 55. Such a configuration allows the plurality of rollers 55 to freely rotate.

The plurality of rollers 57 and the driving roller 58 of the second transport assembly 32 are held by a holding frame 63. The holding frame 63 includes a pair of side plates 64 and 65 to rotatably support shaft ends of the plurality of rollers 57 and the driving roller 58. In such a case, the driving roller 58 is connected to a driving unit (e.g., motor) so as to be driven by the driving unit. When a driving force of the driving unit is transmitted to the driving roller 58, the driving roller 58 is rotated.

The cooling member 33*a* is sandwiched and fixed between the pair of side plates 61 and 62 of the first transport assembly 31. The cooling member 33*b* is sandwiched and fixed between the pair of side plates 64 and 65 of the second transport assembly 32. In such a configuration, the pipes 50 and 51 protrude from the side plate 62 of the first transport assembly 31. The pipes 51 and 52 protrude from the side plate 65 of the second transport assembly 32. Each of the side plates 62 and 65 has holes through which the pipes are inserted. As illustrated in, e.g., FIGS. 2 and 3, the first transport assembly 31 has a trapezoid shape in which, when seen from a front side (user side) or a rear side (opposite the user side) of the image forming apparatus in a direction indicated by an arrow U in FIGS. 8 to 11, an upper edge is shorter than a lower edge. By contrast, the second transport assembly 32 has a trapezoid shape in which, when seen from the front side or the rear side of the image forming apparatus in the direction indicated by the arrow U in FIGS. 8 to 11, an upper edge is longer than a lower edge.

Figure 9:
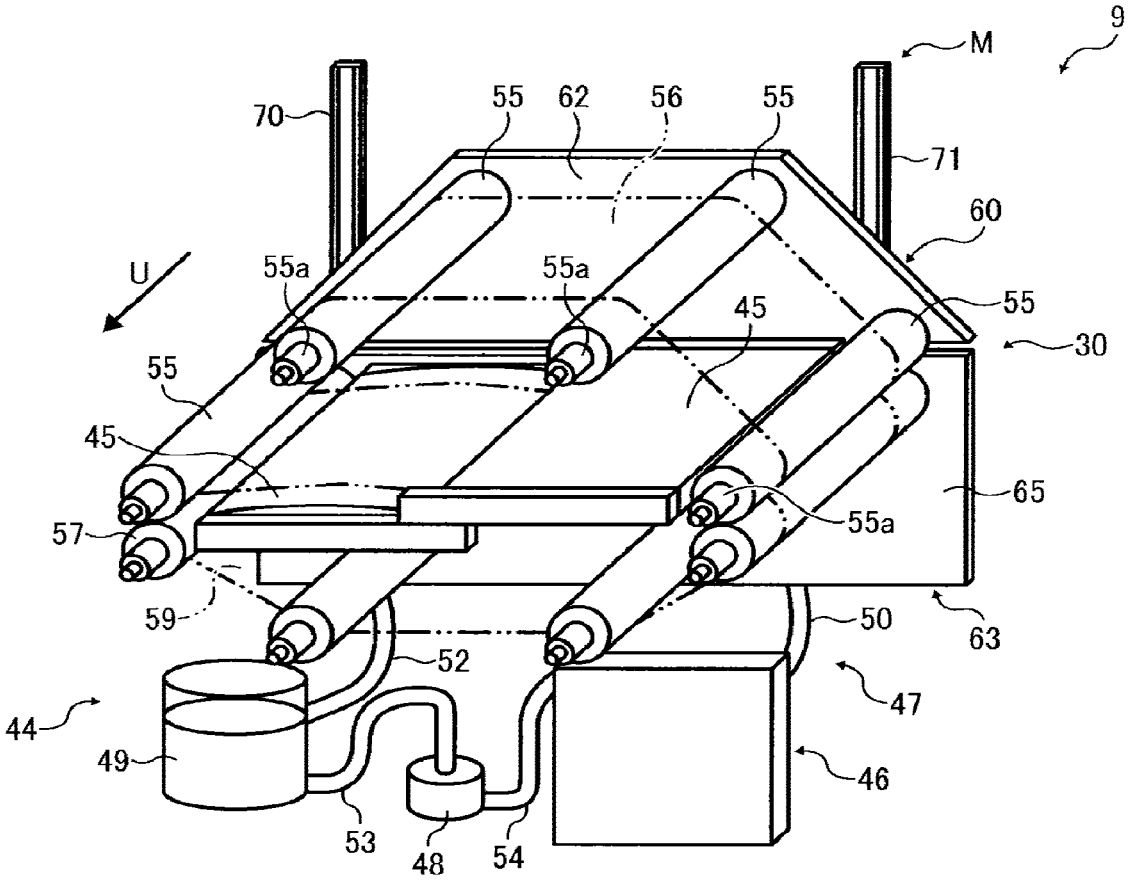
FIG. 9 is a perspective view of the cooling device seen from a front side thereof.
Figure 10:
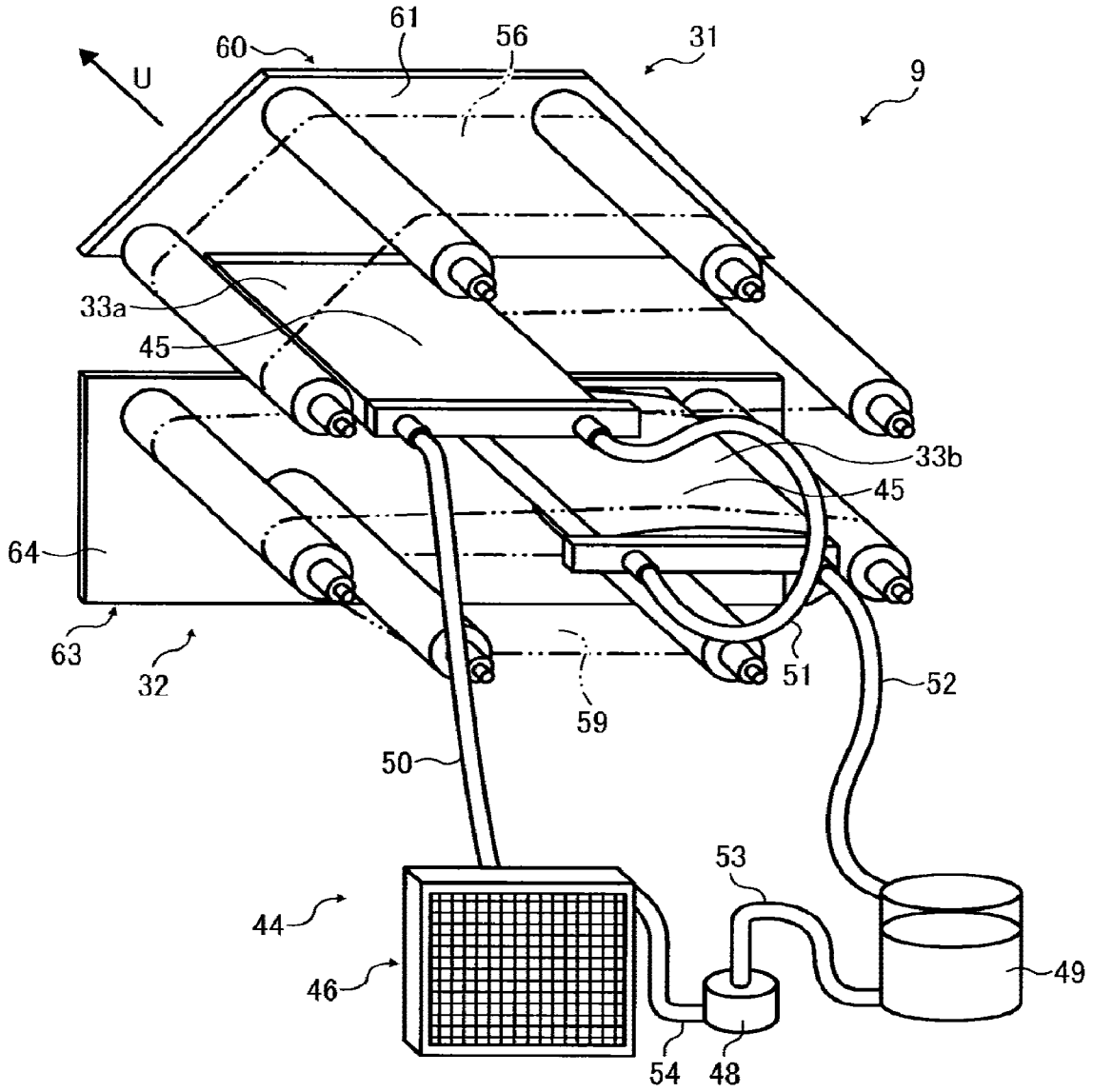
FIG. 10 is a perspective view of the cooling device seen from the rear side in a state in which transport assemblies are placed away from each other.
Figure 11:
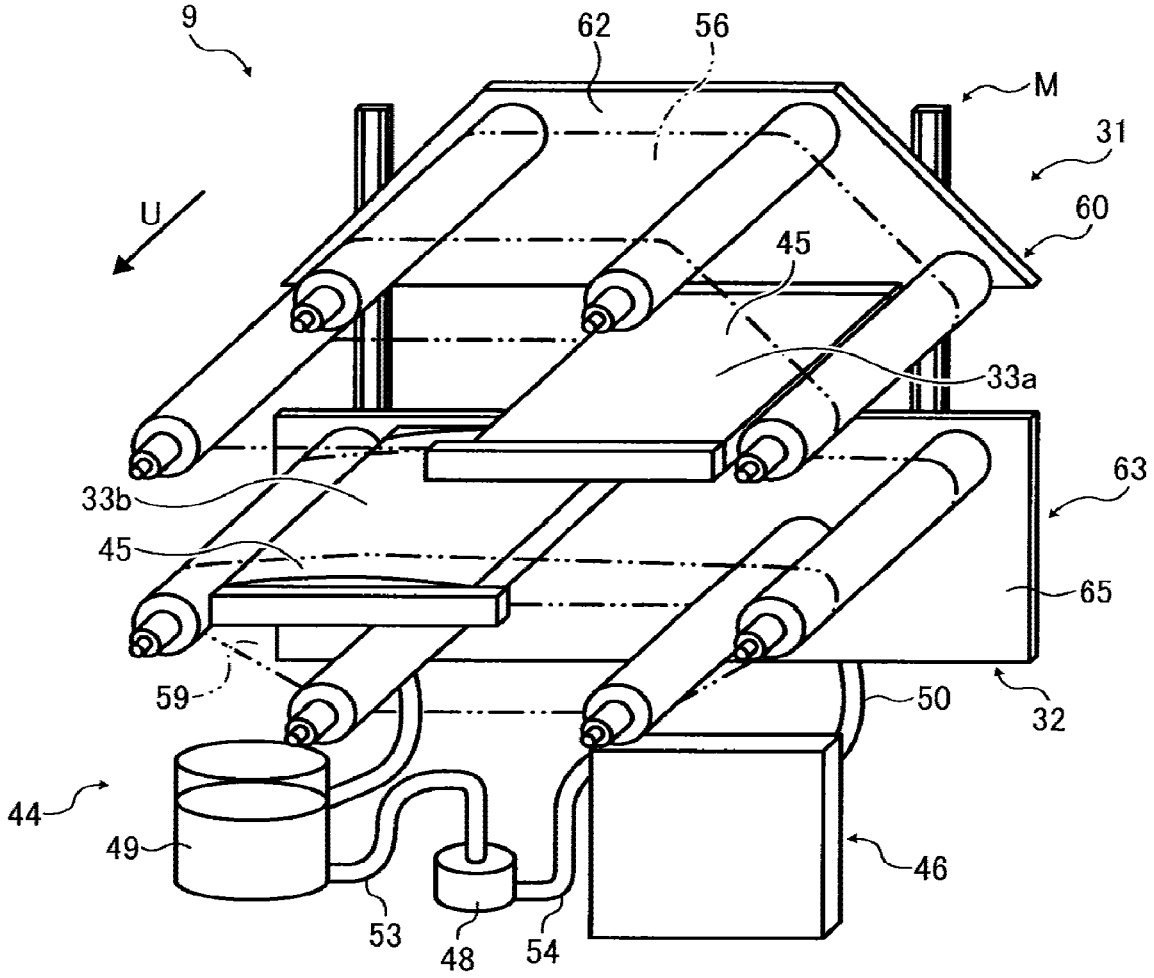
FIG. 11 is a perspective view of the cooling device seen from the front side in a state in which transport assemblies are placed away from each other.

The first transport assembly 31 is guided by a guide assembly M to move upward and downward as indicated by arrows Z1 and Z2 in FIG. 3. As illustrated in FIG. 9, the guide assembly M includes a pair of guide rails 70 and 71 and sliders. The guide rails 70 and 71 are disposed away from each other by a certain distance in the recording-material transport direction. The sliders are reciprocally movable upward and downward while being guided by the rails 70 and 71, respectively. The sliders are attached to the side plate 62 of the holding frame 60 of the first transport assembly 31. In this configuration, since the second transport assembly 32 is fixed, the pair of guide rails 70 and 71 is attached to, for example, the side plate 65 of the holding frame 63 of the second transport assembly 32 or the apparatus body 200.

Accordingly, when the first transport assembly 31 is at a lowest point, as illustrated in FIG. 2, a recording material P can be sandwiched and conveyed by the belts 56 and 59. When the first transport assembly 31 rises, as illustrated in FIG. 3, the belts 56 and 59 separate from each other and turn into a state in which the recording material P cannot be sandwiched and conveyed by the belts 56 and 59.

The upward and downward movements of the first transport assembly 31 may be directly performed by a user or automatically conducted with opening and closing of a cover of the apparatus body 200. In a configuration in which a user directly moves the first transport assembly 31 upward or downward, a lock assembly is preferably provided to fix the first transport assembly 31 and the second transport assembly 32 at respective positions illustrated in FIG. 2 at which the belts 56 and 59 can sandwich and convey the recording material P or respective positions illustrated in FIG. 3 at which the first transport assembly 31 and the second transport assembly 32 separate from each other and the belts 56 and 59 cannot sandwich and convey the recording material P. In a configuration in which the first transport assembly 31 is moved upward and downward with the opening and closing of the cover, when the cover is open, the first transport assembly 31 and the second transport assembly 32 are preferably placed at respective positions illustrated in FIG. 2 at which the belts 56 and 59 can sandwich and convey the recording material P. When the cover is closed, the first transport assembly 31 and the second transport assembly 32 are preferably placed at respective positions illustrated in FIG. 3 at which the first transport assembly 31 and the second transport assembly 32 separate from each other and the belts 56 and 59 cannot sandwich and convey the recording material P.

When the first transport assembly 31 approaches and separates from the second transport assembly 32, both a space between the first transport assembly 31 and the heat dissipating part 46 and a space between the cooling members 33*a* and 33*b* repeatedly change. Consequently, if the pipes 50 and 51 of the cooling-liquid circuit 44 are made of material resistant to deformation or expansion and contraction, the pipes 50 and 51 might deteriorate due to, e.g., buckling. The pipes 50 and 51 are preferably made of, e.g., a flexible elastic material(s). By contrast, since no change occur in spaces between the other pipes 52, 53, and 54, the pipes 52, 53, and 54 may be made of, e.g., a metal(s) having a high degree of hardness instead of a flexible elastic material(s).

In a state in which, as illustrated in, e.g., FIG. 2, the first transport assembly 31 and the second transport assembly 32 are placed adjacent to each other, as illustrated in FIGS. 4 and 5, the contact portions 37*a* and 37*b* of the cooling member 33*a* are in contact with the contact portions 38*a* and 38*b*, respectively, of the cooling member 33*b*. In such a state, the cooling member 33*a* and the cooling member 33*b* are offset from each other in the transport direction of the sheet-type recording material. Thus, the contact portions 37*a* and 37*b* and the contact portions 38*a* and 38*b* position the recording material P with respect to a thickness direction of the recording material P (hereinafter, the recording-material thickness direction).

As described above, the sliders of the guide assembly M attached to the side plate 61 of the holding frame 60 of the first transport assembly 31 are movable upward and downward along the guide rails 70 and 71 that are disposed away from each other at a certain pitch in the recording-material transport direction so as to extend in the upward and downward direction. Thus, the guide assembly M defines the relative positions of the cooling member 33*a* and the cooling member 33*b* with respect to the recording-material transport direction. As the positioning in the recording-material transport direction, after the contact portions 37*a* and 37*b* and the contact portions 38*a* and 38*b* are positioned with respect to the recording-material thickness direction, the cooling member 33*a* and the cooling member 33*b* may be fixed to the holding frames 60 and 63.

As described above, the cooling device 9 has a positioning assembly S including a first positioning unit S1 and a second positioning unit S2. For the first positioning unit S1, the contact portions 37*a* and 37*b* of the cooling member 33*a* and the contact portions 38*a* and 38*b* of the cooling member 33*b* define the positions of the first transport assembly 31 and the second transport assembly 32 with respect to the recording-material thickness direction. In the second positioning unit S2, the guide assembly M defines the relative positions of the cooling member 33*a* and the cooling member 33*b* with respect to the recording-material transport direction. For the first positioning unit S1, the positioning in the recording-material thickness direction are conducted by the contact portions 37*a* and 37*b* of the cooling member 33*a* and the contact portions 38*a* and 38*b* of the cooling member 33*b*. In the above-described configuration, the contact portions 37*a*, 37*b*, 38*a*, and 38*b* are parts of the lateral edges 36*a*, 36*b*, 36*a*, and 36*b*, respectively, which are members separately provided from the cooling body 35. Alternatively, in some embodiments, the contact portions 37*a*, 37*b*, 38*a*, and 38*b* are integrally molded with the cooling body 35.

Next, operation of the cooling device having the above-described configuration is described below.

When the recording material P is sandwiched and conveyed by the belts 56 and 59, as illustrated in, e.g., FIG. 2, the first transport assembly 31 and the second transport assembly 32 are placed adjacent to each other. In a state in which illustrated in FIG. 2, if the driving roller 58 of the second transport assembly 32 is rotated, as described above, the belts 56 and 59 travel in the directions indicated by the arrows A and B, respectively, to transport the recording material P indicated in the transport direction indicated by the arrow C. In such a state, cooling liquid is circulated in the cooling-liquid circuit 44. In other words, the pump 48 is activated to flow the cooling liquid through the cooling liquid channels of the cooling members 33*a* and 33*b*.

At this time, an inner surface of the belt 56 of the first transport assembly 31 slides over the heat absorbing surface 34*a* of the cooling member 33*a*, and an inner surface of the belt 59 of the second transport assembly 32 slides over the heat absorbing surface 34*b* of the cooling member 33*b*. From a front surface (upper surface) side of the recording material P, the cooling member 33*a* absorbs heat of the recording material P via the belt 56. From a back surface (lower surface) side of the recording material P, the cooling member 33*b* absorbs heat of the recording material P via the belt 59. In such a case, an amount of heat absorbed by the cooling members 33*a* and 33*b* is transported to the outside by the cooling liquid, thus maintaining the cooling members 33*a* and 33*b* at relatively low temperature.

In other words, by driving the pump 48, the cooling liquid is circulated through the cooling-liquid circuit 44. The cooling liquid flows through the cooling-liquid channels of the cooling members 33*a* and 33*b*, absorbs heat of the cooling members 33*a* and 33*b*, and turns into a relatively high temperature. The cooling liquid at high temperature passes through the heat receiving part 45 (e.g., radiator), and heat of the cooling liquid is radiated to outside air, thus reducing the temperature of the cooling liquid. The cooling liquid at relatively low temperature flows through the cooling-liquid channels again, and the cooling members 33*a* and 33*b* act as the heat dissipating part 46. By repeating the above-described cycle, the recording material P is cooled from both sides thereof.

With such a configuration, the cooling device 9 cools recording materials P to prevent the recording materials P from being stacked on the output tray 20 at high temperature. As a result, the cooling device 9 effectively prevents blocking, thus allowing the recording materials P to be stacked on the output tray 20 without adhering to each other.

Furthermore, the cooling device 9 separates the first transport assembly 31 and the cooling member 33 from the second transport assembly 32 and the cooling member 33*b* to enhance the operability of a user, thus facilitating removal of a jammed sheet or other maintenance work. In other words, for the cooling device 9, the first transport assembly 31 and the second transport assembly 32 can be relatively spaced away from each other, thus allowing maintenance works, such as removal of foreign substances sandwiched between the belts 56 and 59 or replacement of the belts 56 and 59. For the cooling device 9, the openings 40*a*, 40*b*, 41*a*, and 41*b* of the cooling-liquid channels of the cooling member 33*a* and 33*b* are located at the rear side (the side opposite the user side) of the image forming apparatus. Such a configuration allows the heat dissipating part 46, the pump 48, and the liquid tank 49 of the cooling-liquid circuit 44 to be located at the rear side of the image forming apparatus. As a result, without being disturbed by the heat dissipating part 46, the pump 48, and the liquid tank 49, a service person or user can conduct maintenance work, thus enhancing the operability.

After maintenance work is finished, as illustrated in, e.g., FIG. 3, the cooling member 33*a* placed away from the cooling member 33*b* is returned to an initial position again. At this time, the positioning assembly S defines the positions of the cooling members 33*a* and 33*b* with respect to the recording-material transport direction and the recording-material thickness direction. Thus, the cooling members 33*a* and 33*b* are placed at normal positions. When the sheet-type recording material P is conveyed by the belt transport unit 30, such a configuration prevents the sheet-type recording material P from being jammed between the cooling members 33*a* and 33*b*. In addition, the gap between the sheet-type recording material P and each of the heat absorbing surfaces 34*a* and 34*b* of the cooling members 33*a* and 33*b* is maintained to be relatively small, thus providing effective absorption performance of the cooling members 33*a* and 33*b*.

Figure 40A:
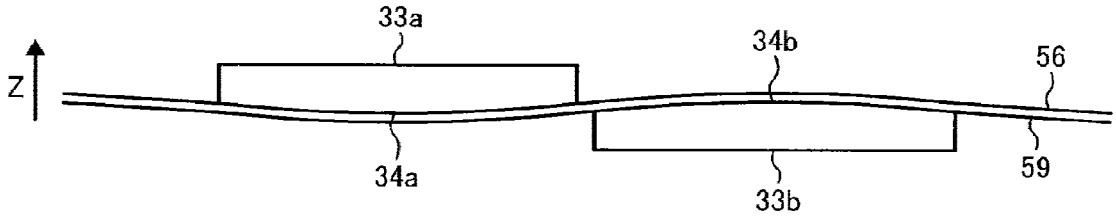
FIG. 40A is a schematic side view of a comparative example of the cooling device in a state in which paired cooling members are disposed at normal positions.
Figure 40B:
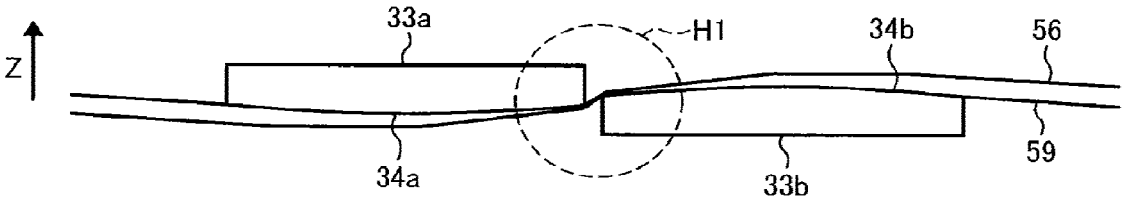
FIG. 40B is a schematic side view of a comparative example of the cooling device in a state in which the paired cooling members are disposed adjacent to each other.
Figure 40C:
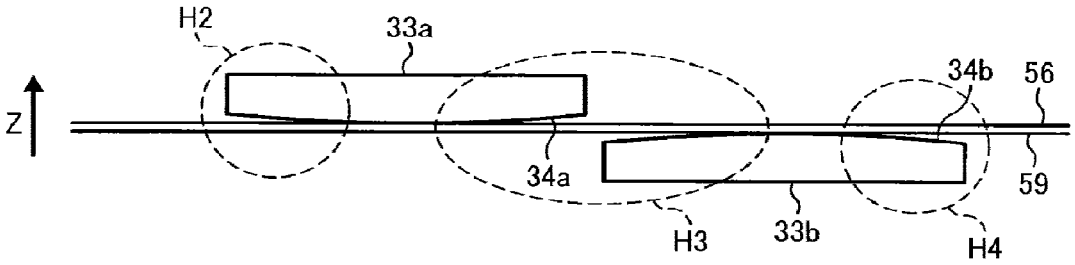
FIG. 40C is a schematic side view of a comparative example of the cooling device in a state in which the paired cooling members are disposed away from each other.

By contrast, without such a positioning assembly, the cooling members 33*a* and 33*b* might not return to the normal positions illustrated in FIG. 40A. In other words, in FIG. 40B, the cooling members 33*a* and 33*b* come too close to each other in both the recording-material transport direction and the recording-material thickness direction (indicated by an arrow Z). In such a case, a large burden is applied to the belts 56 and 59 between the cooling members 33*a* and 33*b* (in a range H1 in FIG. 40B). Consequently, the recording material P might not be properly conveyed. FIG. 40C is a side view of a state in which the cooling members 33*a* and 33*b* are too separated from each other in the recording-material thickness direction. In such a case, since the absorbing surface 34*a* of the cooling member 33*a* is an arc surface and the absorbing surface 34*b* of the cooling member 33*b* is an arc surface, the belt 56 and 59 do not contact the cooling members 33*a* and 33*b* at portions H2, H3, and H4 in FIG. 40C. Consequently, heat of the recording material P is not stably absorbed.

Figure 41:
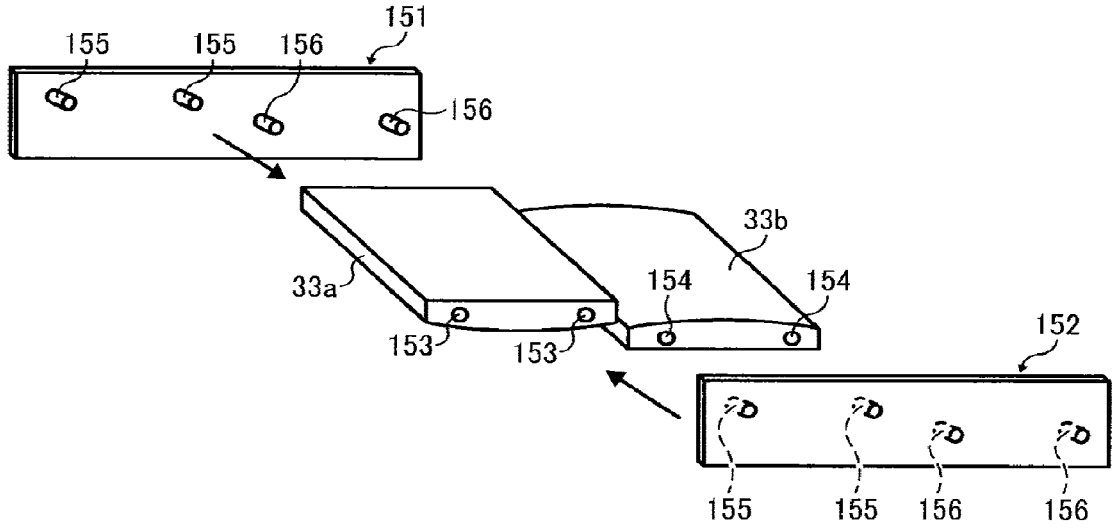
FIG. 41 is a schematic perspective view of another configuration of the cooling device in which cooling members are positioned with positioning pins.

Hence, a pin engagement structure as illustrated in FIG. 41 may be employed. In such a case, side plates 151 and 152 common to the cooling members 33*a* and 33*b* are employed. Each of the side faces of the cooling members 33*a* and 33*b* has engagement holes 153 and 154, and each of the side plates 151 and 152 has pins 155 and 156 corresponding to the engagement holes 153 and 154.

With such a configuration, engagement of the engagement holes 153 and 154 with the pins 155 and 156 allows the cooling members 33*a* and 33*b* to be joined with the cooling members 33*a* and 33*b* positioned.

Figure 12:
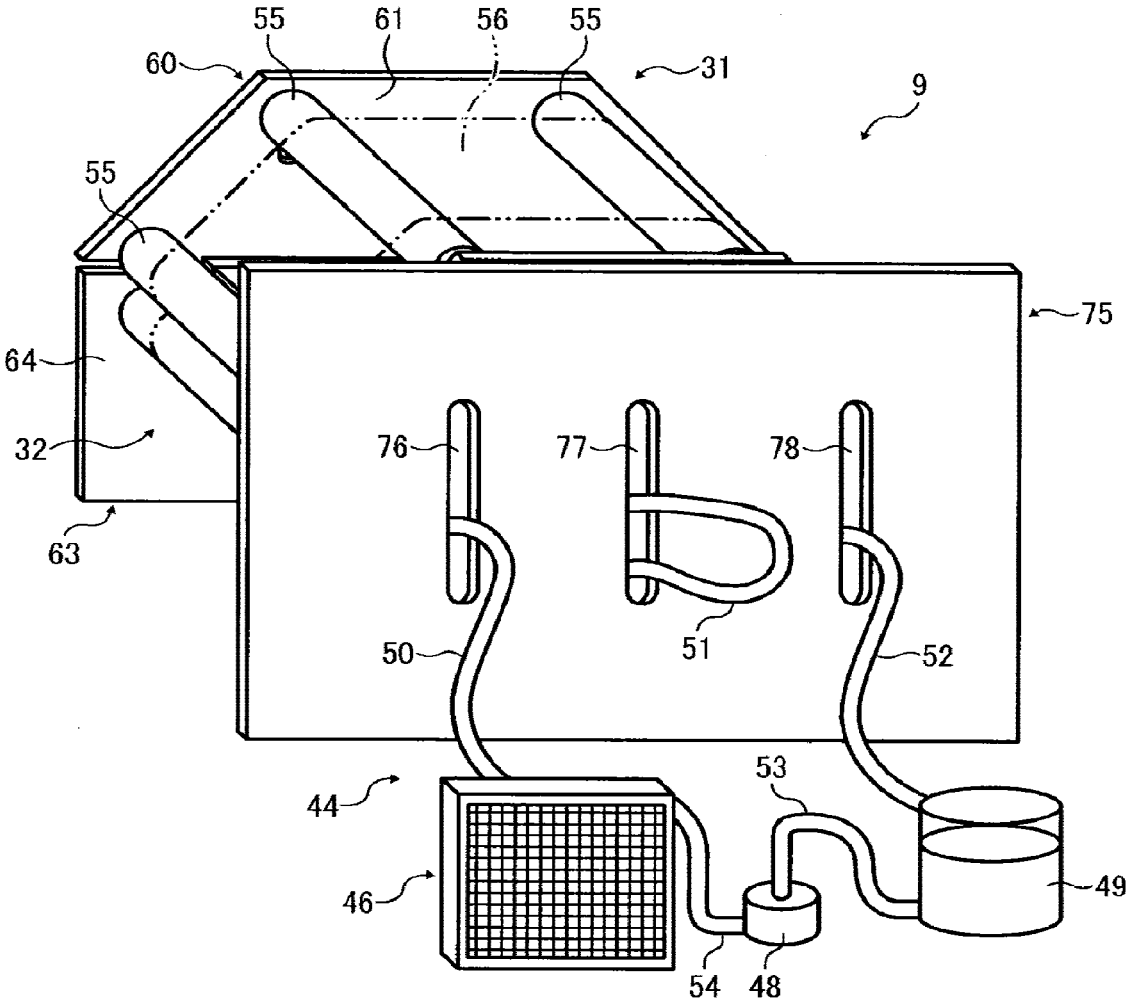
FIG. 12 is a perspective view of another configuration of the cooling device.
Figure 13:
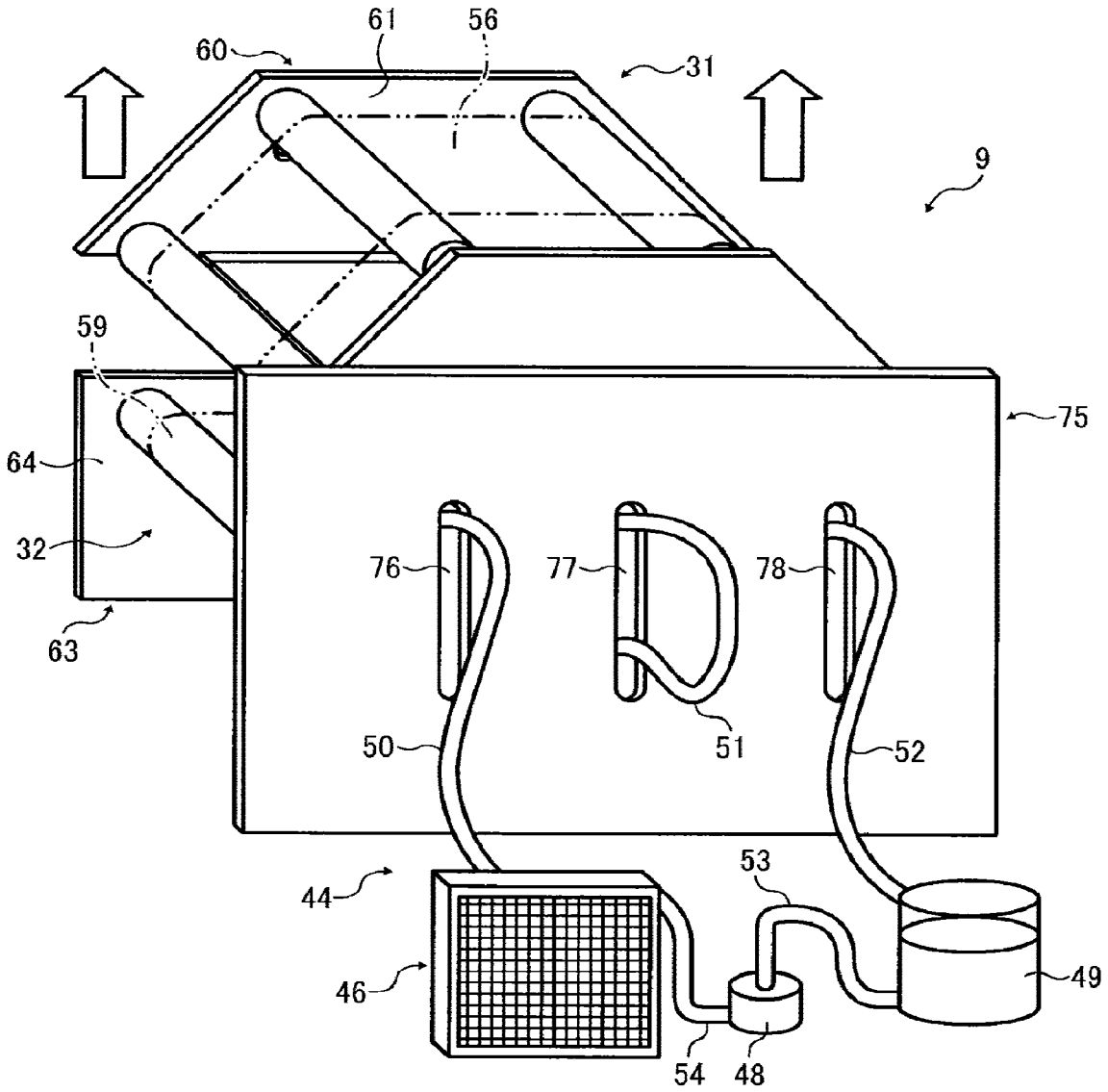
FIG. 13 is a perspective view of the cooling device of FIG. 12 in a state in which transport assemblies are placed away from each other.

Next, a cooling device in FIGS. 12 and 13 includes a partition wall 75 to separate the cooling members 33*a* and 33*b* serving as the heat receiving part 45 from other components, such as the heat dissipating part 46, the pump 48, and the liquid tank 49. The partition wall 75 has insertion holes 76, 77, and 78 through which the pipes 50, 51, and 52 are inserted.

The insertion holes 76, 77, and 78 are long holes extending upward and downward. The insertion holes 76, 77, and 78 are compatible with displacement of the pipes 50, 51, and 52 both in a state illustrated in FIG. 12 in which the cooling members 33*a* and 33*b* are adjacent to each other and in a state illustrated in FIG. 13 in which the cooling members 33*a* and 33*b* are separated away from each other.

In the configuration illustrated in FIGS. 12 and 13 in which the partition wall 75 is provided, for example, even if cooling liquid leaks at a side at which the heat dissipating part 46 is disposed, the cooling liquid would not enter a side in which the cooling members 33 are disposed, thus preventing dropping of the cooling liquid onto a recording material P or other components. Accordingly, such a configuration allows stable fixing of a desired image on the recording material P. Additionally, as described above, such a configuration allows displacement of the pipes 50, 51, and 52 of the cooling-liquid circuit 44 during movement of the cooling members 33*a* and 33*b*. As a result, deterioration and buckling of the pipes 50, 51, and 52 are prevented, and stable cooling performance is obtained.

Figure 14:
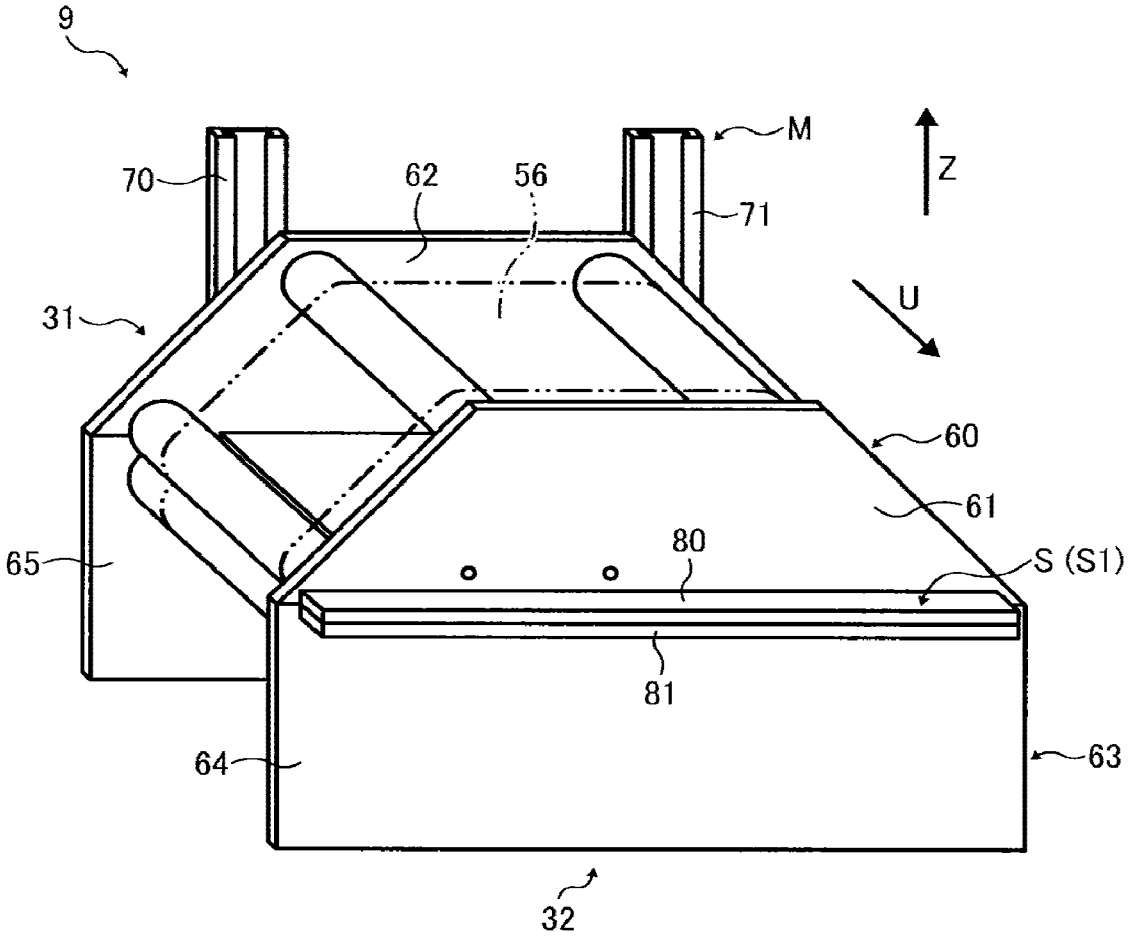
FIG. 14 is a perspective view of another configuration of the cooling device.
Figure 15:
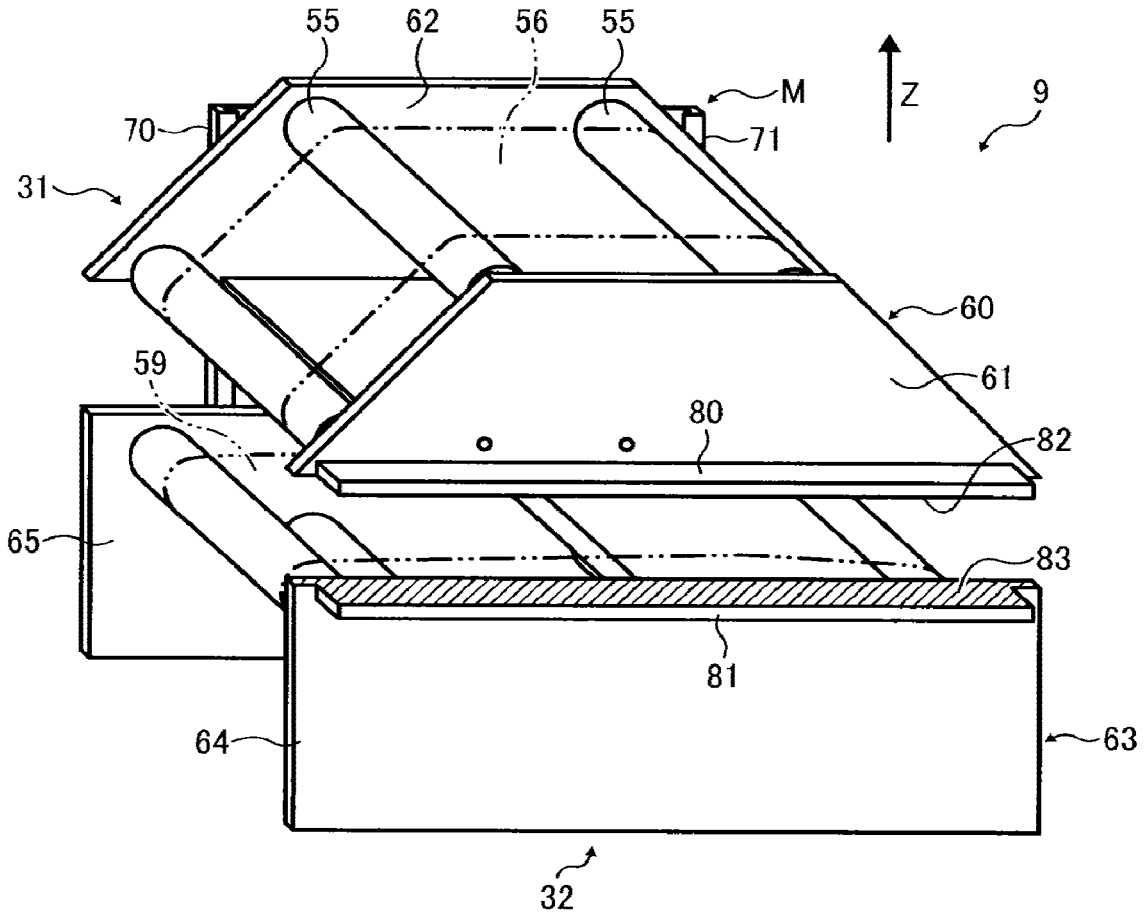
FIG. 15 is a perspective view of the cooling device of FIG. 14 seen from a front side thereof in a state in which transport assemblies are placed away from each other.
Figure 16:
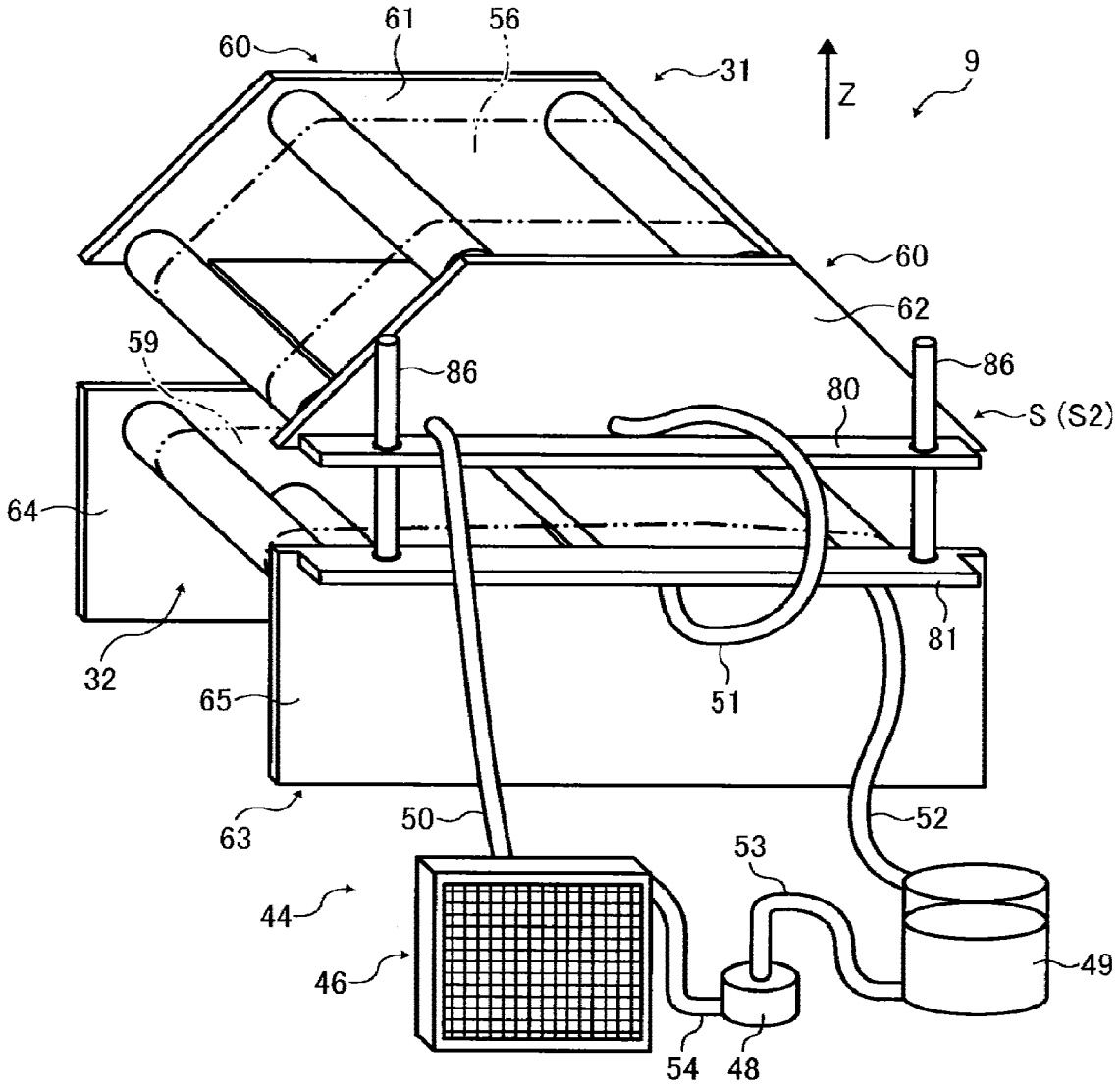
FIG. 16 is a perspective view of the cooling device of FIG. 14 seen from a rear side thereof in a state in which transport assemblies are placed away from each other.

In a cooling device illustrated in FIGS. 14 to 16, the first positioning unit S1 of the positioning assembly S for the recording-material thickness direction is provided on the holding frames 60 and 63 of the first transport assembly 31 and the second transport assembly 32. For example, flat plates 80 are disposed at lower edges of the side plates 61 and 62 of the holding frame 60, and flat plates 81 are disposed at upper edges of the side plates 64 and 65 of the holding frame 63. As a result, as illustrated in FIG. 14, when the cooling members 33*a* and 33*b* are placed adjacent to each other, the flat plate 80 of the holding frame 60 is overlapped on the holding frame 63 of the flat plate 81, in other words, a lower surface of the flat plate 80 is overlapped on an upper surface of the flat plate 81.

Thus, the lower surface of the flat plate 80 serves as a first overlap surface 82, and the upper surface of the flat plate 81 serves as a second overlap surface 83. The first overlap surface 82 and the second overlap surface 83 form the first positioning unit S1 to position the cooling members 33*a* and 33*b* with respect to the recording-material thickness direction (indicated by arrow Z). It is to be noted that the flat plate 80 of the holding frame 60 and the flat plate 81 of the holding frame 63 may be disposed at one of the rear side and the front side of the image forming apparatus.

The cooling device shown in FIGS. 14 and 15 has the guide assembly M. The cooling device shown in FIG. 16 has a pair of guide rods 86. In other words, the pair of guide rods 86 is mounted on the upper surface of the flat plate 81 so as to extend upward. The flat plate 80 of the side plate 62 has a pair of insertion holes through which the pair of guide rods 86 is inserted. Thus, the first transport assembly 31 can be guided upward and downward.

In the cooling device shown in FIGS. 14 to 16 having the first positioning unit S1 to position the cooling members 33*a* and 33*b* with respect to the recording-material thickness direction (Z direction), such a configuration allows stable positioning of with respect to the recording-material thickness direction. Additionally, the cooling device 9 shown in FIGS. 14 to 16 has the second positioning unit S2 to position the cooling members 33*a* and 33*b* with the guide assembly M with respect to the recording-material transport direction, thus giving operation effects equivalent to those of the cooling device 9 shown in FIGS. 8 to 11.

Figure 17:
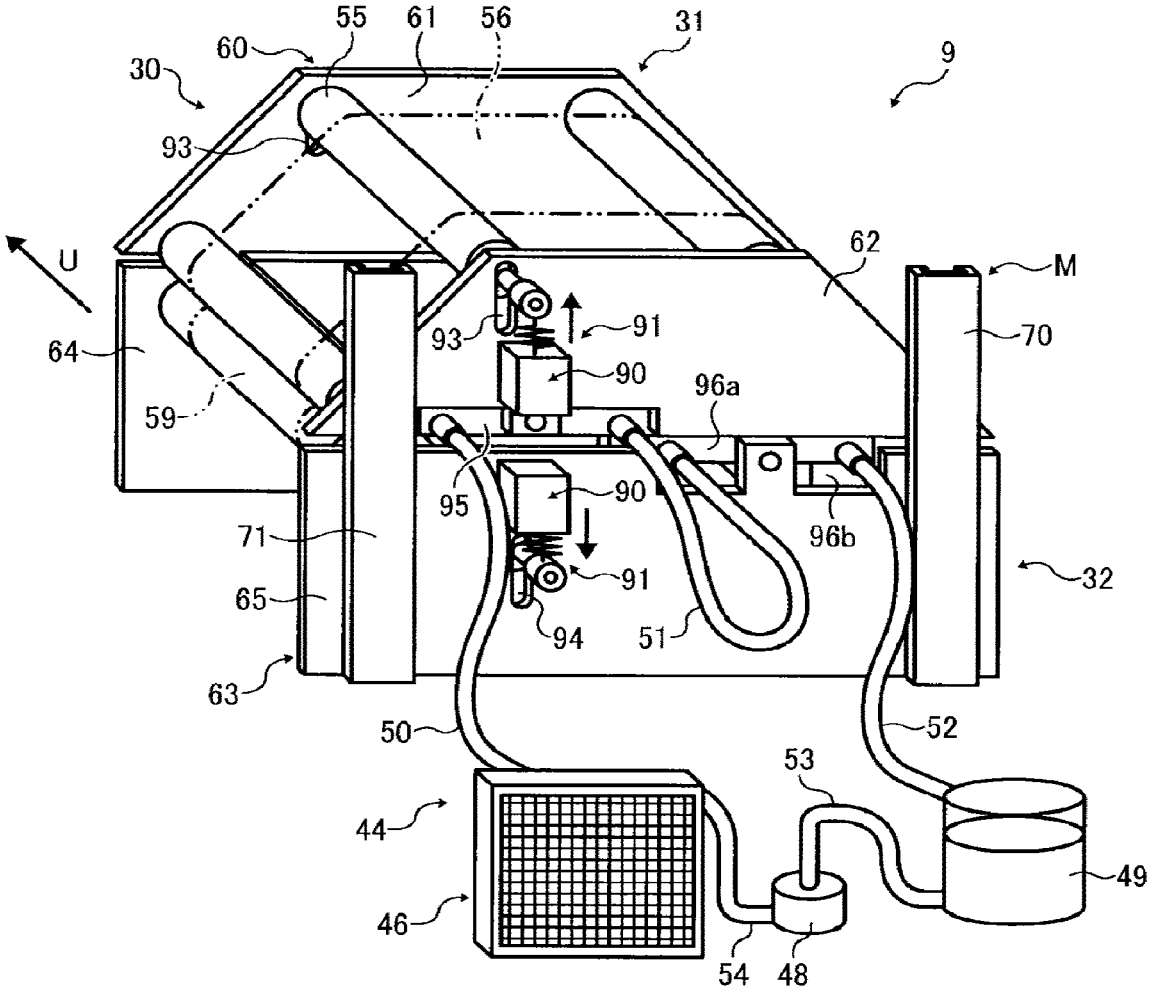
FIG. 17 is a perspective view of another configuration of the cooling device seen from a rear side thereof.
Figure 18:
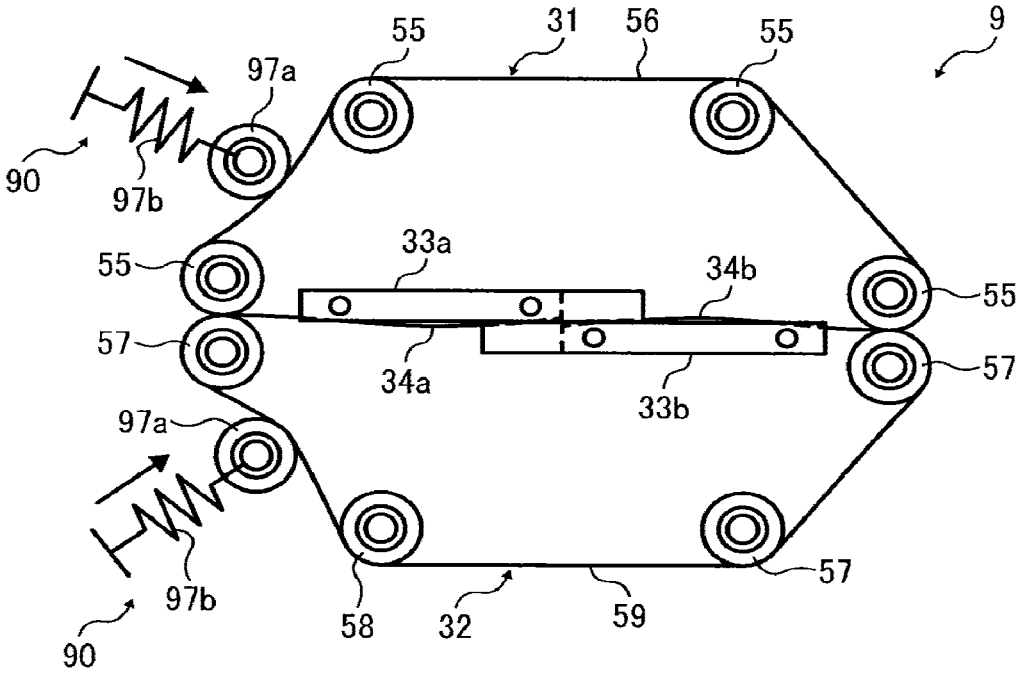
FIG. 18 is a schematic view of transport assemblies with tension application units.

Next, in a cooling device shown in FIG. 17, the first transport assembly 31 and the second transport assembly 32 have tension application units 90 to apply tension to the belts 56 and 59. The tension application units 90 include spring assemblies 91.

In other words, the side plates 61 and 62 have long holes 93 extending upward. End shafts of the roller 55*b* are inserted through the long holes 93, thus allowing the roller 55*b* to reciprocally move upward and downward. The spring assemblies 91 are set to elastically push up the roller 55*b*. Thus, tension is applied to the belt 56 winding around the rollers 55.

The side plates 64 and 65 also have long holes 94 extending upward. End shafts of one of the rollers 57 are inserted into the long holes 94, thus allowing the roller 57 to reciprocally move upward and downward. The spring assemblies 91 are set to elastically push up the roller 58. Thus, tension is applied to the belt 59 winding around the rollers 57 and 58

In such a configuration, the side plate 62 has a notch 95 at a lower edge thereof, and the side plate 65 has notches 96*a* and 96*b* at an upper edge thereof. The pipes 50 and 51 are drawn out through the notch 95.

Other configurations of the cooling device shown in FIG. 17 are substantially the same as those of the cooling device shown in FIGS. 8 to 11, thus giving operation effects equivalent to those of the cooling device shown in FIGS. 8 to 11.

The tension application units 90 may be arranged to directly press the belts 56 and 59 from outside of the belts 56 and 59. In such a configuration, the tension application units 90 include, e.g., rotors 97*a* to rotationally contact the belts 56 and 59 and spring members 97*b* to press the rotors 97*a* toward the belts 56 and 59.

Figure 19:
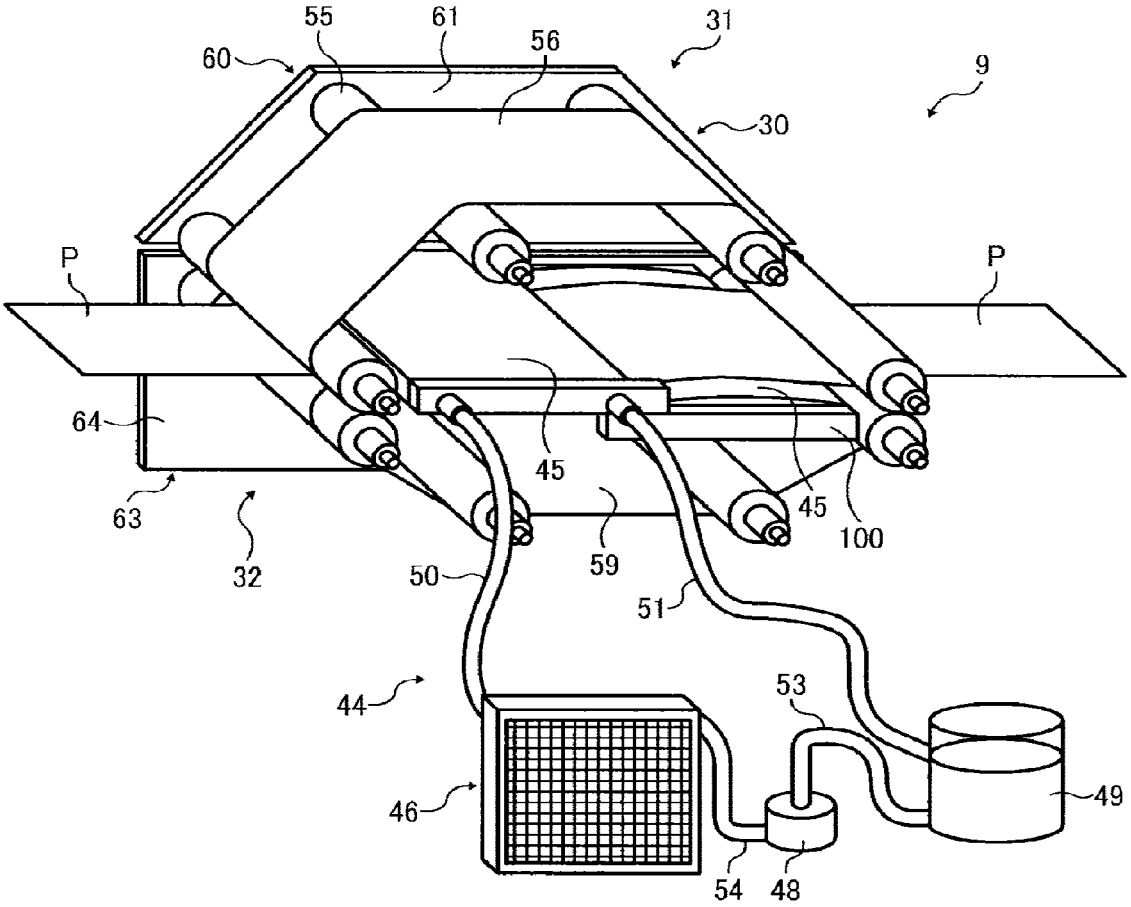
FIG. 19 is a perspective view of another configuration of the cooling device.

For the cooling device illustrated in FIG. 19, one of the cooling members 33, i.e., the cooling member 33*a* acts as the heat receiving part 45, and the other of the cooling members 33, i.e., the cooling member 33*b* does not form the heat receiving part 45, in other words, an auxiliary heat receiving part 100 in which the cooling liquid is not circulated. That is, only the cooling member 33*a* has the cooling-liquid channel and the other cooling member 33*b* has no cooling-liquid channel.

Accordingly, the cooling member 33*b* does not have the openings 41*a* and 41*b*, and the pipe 52 is omitted from the cooling-liquid circuit 44. The pipe 51 connects the opening 40*b* of the cooling member 33*a* to the liquid tank 49.

In such a case as well, in a state in which the contact portions 37*a* and 37*b* of the cooling member 33*a* are in contact with the contact portions 38*a* and 38*b*, respectively, of the cooling member 33*b*, the contact portions 37*a* and 37*b* are overlapped with the contact portions 38*a* and 38*b* so that the cooling member 33*a* and the cooling member 33*b* are shifted from each other along the transport direction of the sheet-type recording material. Thus, the cooling member 33*a* contacts the cooling member 33*b*, and the cooling member 33*b* acts as the auxiliary heat absorption part. In other words, although the cooling liquid does not flow through the cooling member 33*b*, the cooling member 33*b* absorbs heat from the recording material P and cools the back face side of the recording material P.

Figure 20:
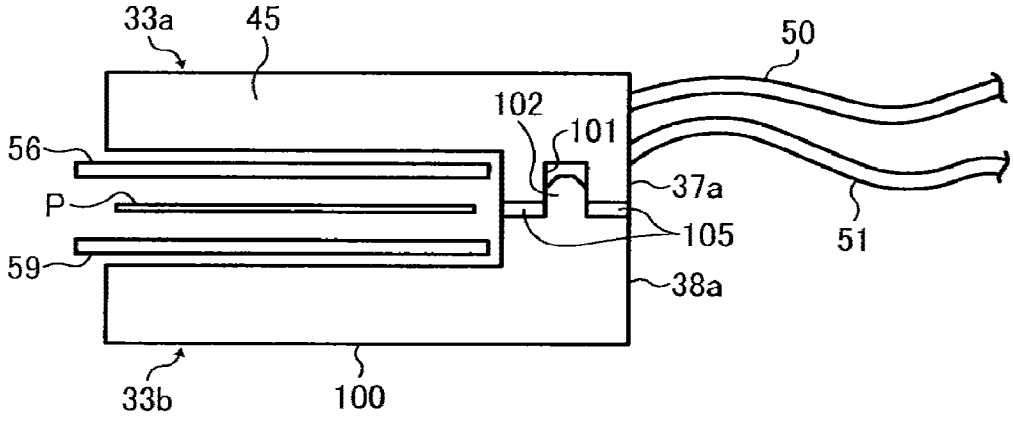
FIG. 20 is a front view of cooling members of the cooling device of FIG. 19.
Figure 21:
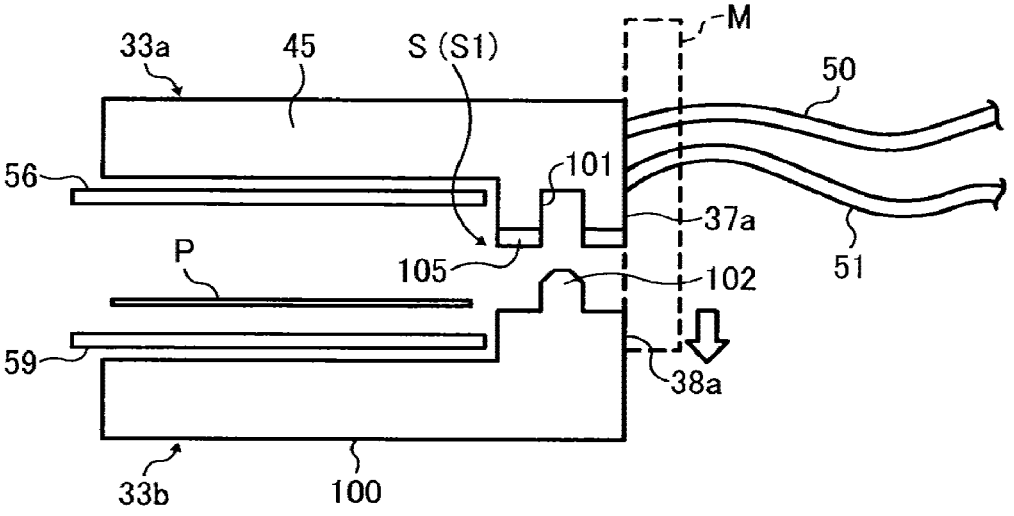
FIG. 21 is a front view of the cooling members of the cooling device of FIG. 19 in a separated state.
Figure 22:
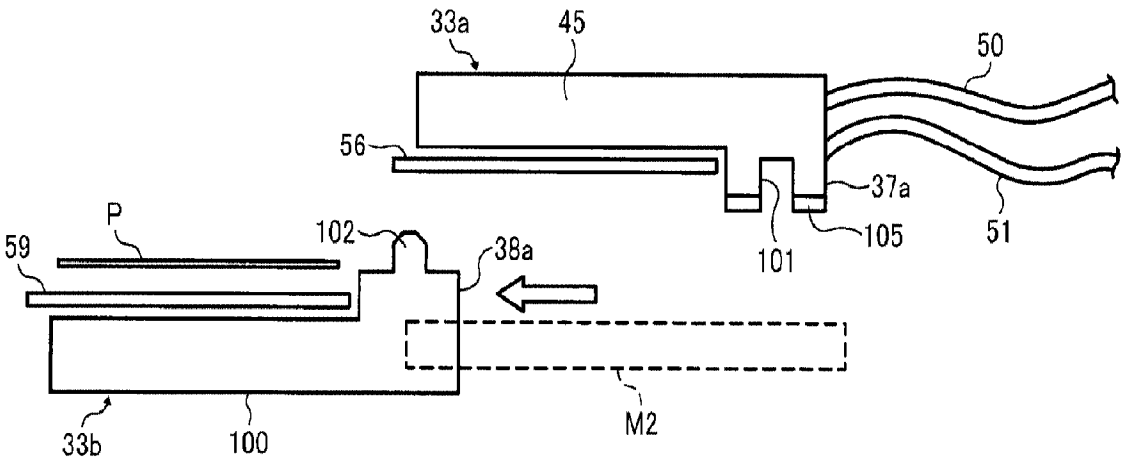
FIG. 22 is a front view of the cooling members of the cooling device of FIG. 19 in state in which one of the cooling members is drawn out.

In such a case, as illustrated in FIGS. 20 to 22, the cooling member 33*a* has an engagement recess 101 at a lower surface thereof, and the cooling member 33*b* has an engagement protrusion 102 at an upper surface thereof. The engagement recess 101 and the engagement protrusion 102 form the positioning assembly S.

At a lower surface of the contact portion 37*a* of the cooling member 33*a* is preferably disposed an intervening member 105 formed of a highly heat conductive member (e.g., 3M™ Thermally Conductive Hypersoft Acrylic Interface Pad 5590H of Sumitomo 3M Limited). Such a configuration allows the cooling member 33*b* to be more effectively cooled by the cooling member 33*a*.

The cooling member 33*b* serving as the auxiliary heat receiving part 100 preferably includes a material having a higher heat conductivity than the cooling member 33*a* serving as the heat receiving part 45, thus further enhancing cooling performance.

As described above, the engagement recess 101 and the engagement protrusion 102 form the positioning assembly S, thus allowing the cooling members 33*a* and 33*b* to be placed at the normal positions. When a sheet-type recording material P is conveyed by the belt transport unit 30, such a configuration prevents the sheet-type recording material P from being jammed between the cooling members 33*a* and 33*b*. In addition, the gap between the sheet-type recording material P and each of the heat absorbing surfaces of the cooling members 33*a* and 33*b* is maintained to be relatively small, thus providing effective absorption performance of the cooling members 33*a* and 33*b*.

In the cooling device illustrated in FIGS. 19 to 21, as illustrated in FIG. 21, the cooling member 33*a* is movable downward (and upward) relative to the cooling member 33*b*. In such a case, a guide assembly (for example, the above-described guide assembly M) having, e.g., guide rails may be employed to move the cooling member 33*a* downward (and upward) relative to the cooling member 33*b*.

In a state in which the cooling member 33*b* is placed at a lower position as illustrated in FIG. 21, as illustrated in FIG. 22, the cooling member 33*b* is drawable toward the front side of the apparatus body. In such a case as well, a guide assembly M2 including, e.g., guide rails is preferably provided so that the cooling member 33*b* is reciprocally movable back and forth.

Such a configuration in which the cooling member 33*b* is drawable toward the front side of the apparatus body further enhances operability in maintenance work. For example, such a configuration facilitates removal of foreign material sandwiched between the belts 56 and 59. Additionally, the above-described configuration obviates upward movement of the cooling member 33*a* and allows, e.g., an inflexible metal pipe to be used as a pipe of the cooling-liquid circuit 44. Thus, an increased degree of freedom of design is obtained with enhanced durability and reduced cost.

Figure 23:
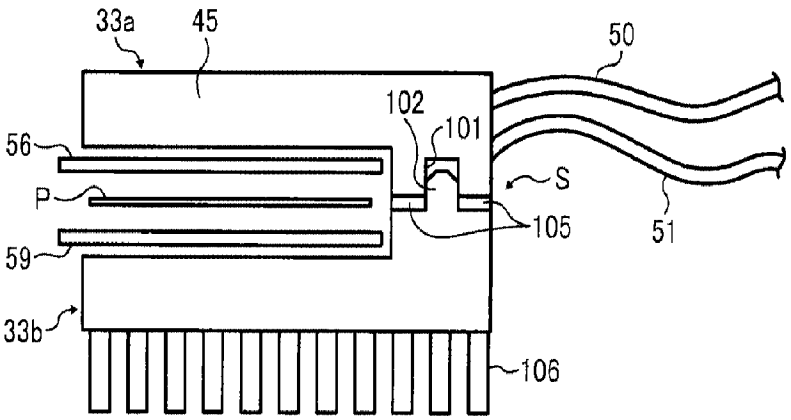
FIG. 23 is a front view of the cooling device of FIG. 19 having a radiation facilitating part.

In FIG. 23, the cooling member 33*b* serving as the auxiliary heat receiving part 100 has a radiation facilitating part 106. The radiation facilitating part 106 has a shape of heat sink having multiple fins. In other words, the radiation facilitating part 106 has a shape of increasing surfaces to contact ambient air (ambient air in the apparatus body), thus facilitating radiation and enhancing the cooling performance of the cooling member 33*b*.

As described above, in FIG. 23, the cooling member 33*b* has the radiation facilitating part 106. In some embodiments, for example, a heat sink provided separately from the cooling member 33*b* may be contacted with the cooling member 33*b*.

Figure 24:
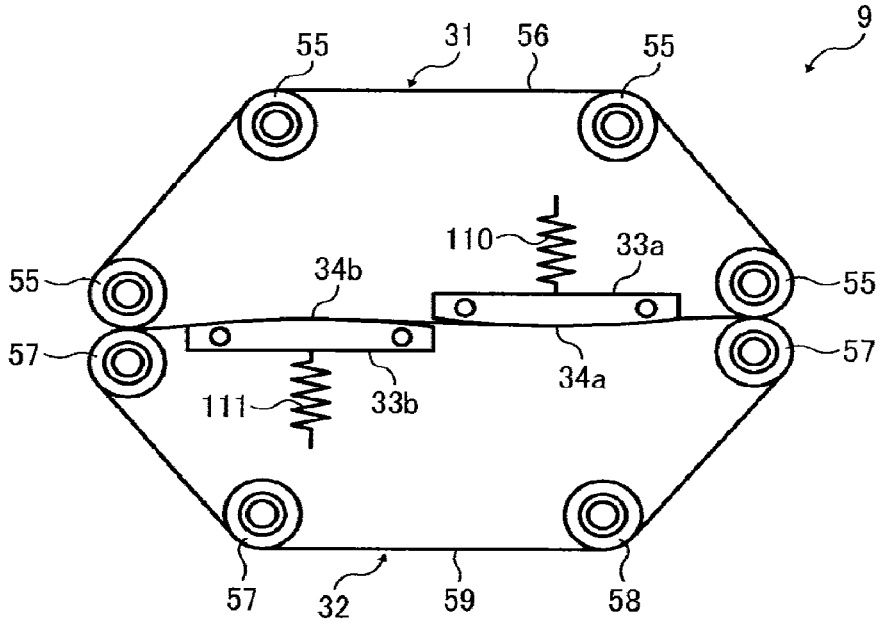
FIG. 24 is a side view of another configuration of the cooling device.
Figure 25:
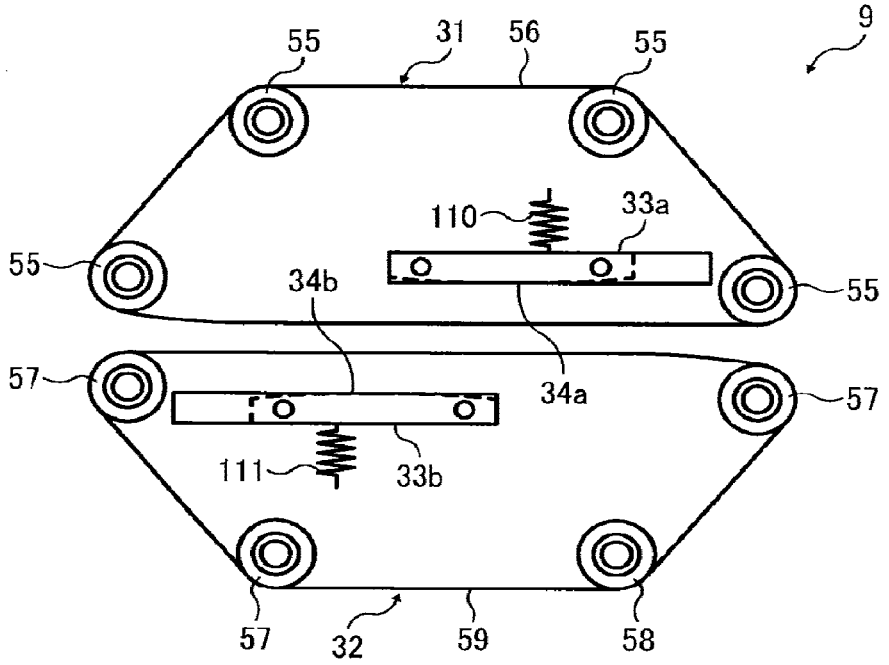
FIG. 25 is a side view of the cooling device of FIG. 24 in a state in which cooling members are placed away from each other.

For a cooling device illustrated in FIGS. 24 to 27, a first transport assembly 31 and a second transport assembly 32 are drawable toward a front side of an apparatus body. In such a case, as illustrated in FIG. 24, the first transport assembly 31 and the second transport assembly 32 are close to each other and in a state capable of sandwiching and conveying a recording material P, elastic pressing members (e.g., springs) 110 and 111 press cooling members 33*a* and 33*b* toward belts 56 and 59, respectively.

The cooling members 33*a* and 33*b* are placed away from each other against elastic forces of the elastic pressing members 110 and 111. In such a separated state, the first transport assembly 31 and the second transport assembly 32 are drawable toward the front side of the apparatus body.

Figure 26:
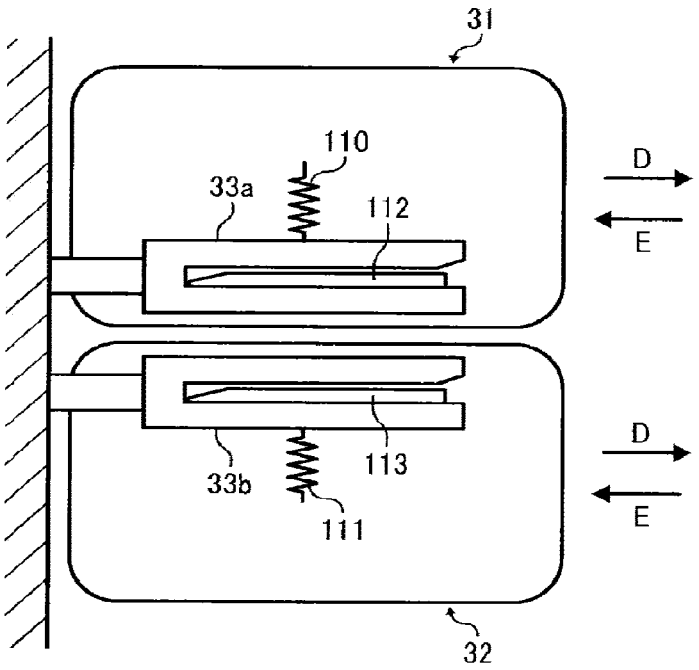
FIG. 26 is a front view of the cooling members of the cooling device of FIG. 24.
Figure 27:
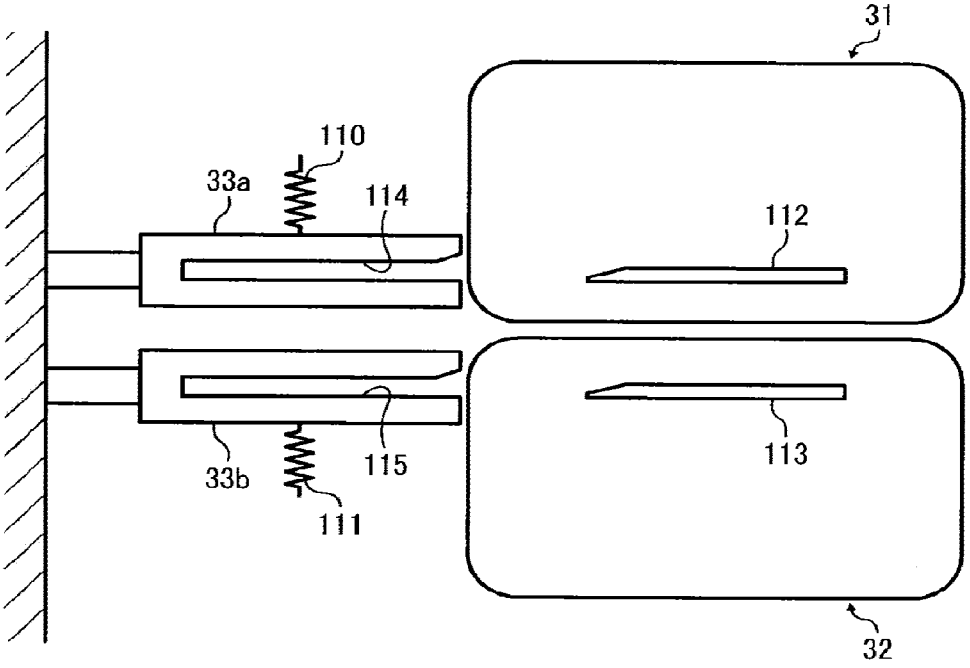
FIG. 27 is a front view of the cooling device of FIG. 24 in a state which the cooling members are drawn out.

In such a case, as illustrated in FIGS. 26 and 27, the first transport assembly 31 and the second transport assembly 32 have rail members 112 and 113, respectively. The cooling members 33*a* and 33*b* have guide recesses 114 and 115 to engage with the rail members 112 and 113.

As illustrated in FIG. 27, relative to the cooling members 33*a* and 33*b*, the first transport assembly 31 and the second transport assembly 32 are drawable in a direction indicated by arrow D in FIG. 26. From a state illustrated in FIG. 27, the first transport assembly 31 and the second transport assembly 32 can be pushed in a direction indicated by arrow E in FIG. 26. In such a case, the rail members 112 and 113 are engaged with the guide recesses 114 and 115, and the first transport assembly 31 and the second transport assembly 32 returns to a state illustrated in FIG. 26.

Drawing the first transport assembly 31 and the second transport assembly 32 to the front side facilitates maintenance work. Additionally, since the cooling members 33*a* and 33*b* are not drawn, such a configuration obviates use of a flexible pipe as, e.g., a pipe 50 of a cooling-liquid circuit 44, thus increasing the degree of freedom in design and cost.

Figure 28:
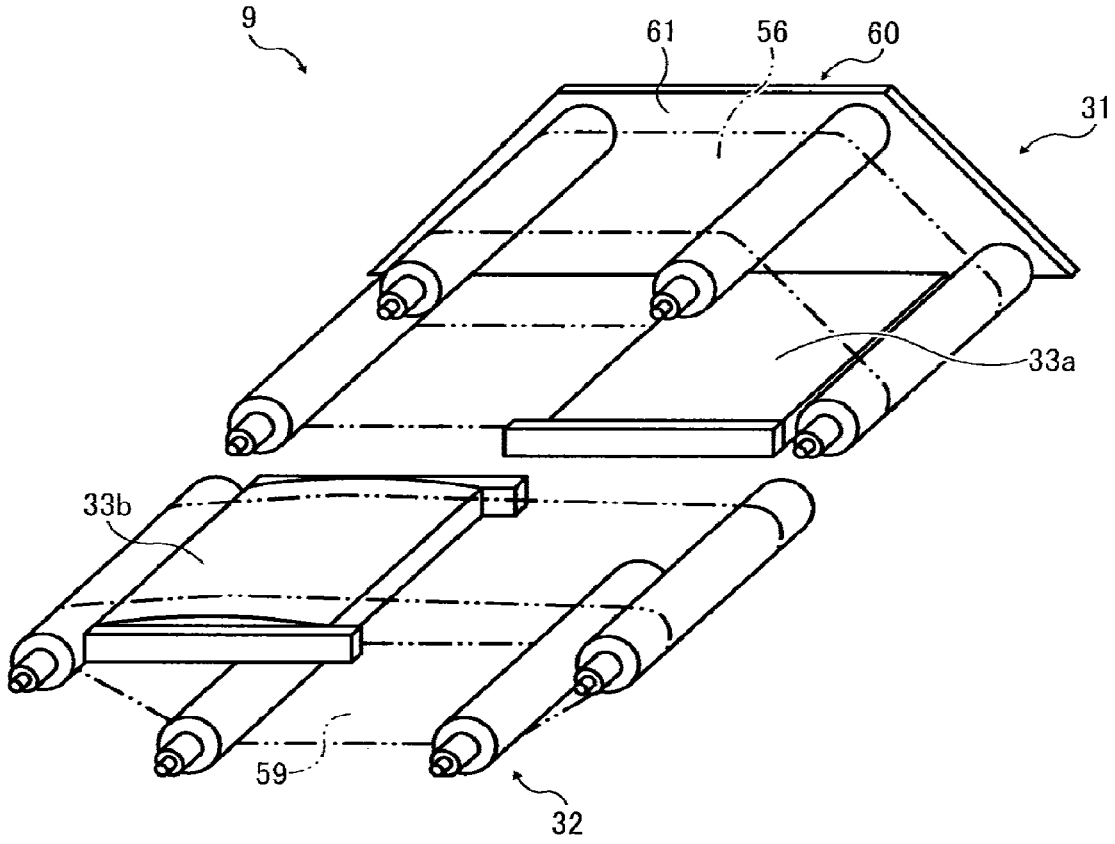
FIG. 28 is a perspective view of another configuration of the cooling device in a state in which one of cooling members is drawn out.
Figure 29:
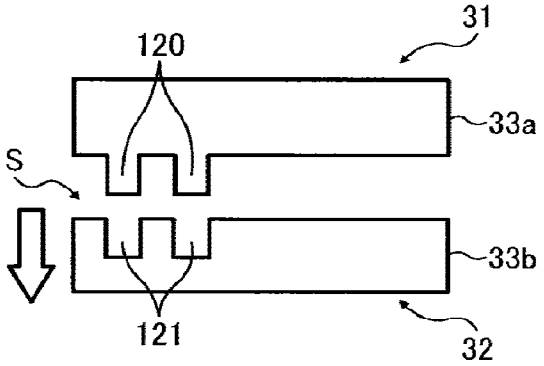
FIG. 29 is a schematic view of the cooling device of FIG. 28 in a state in which the cooling members are placed away from each other.
Figure 30:
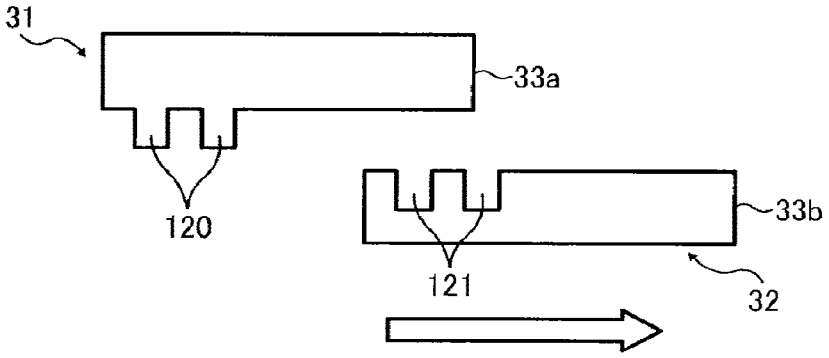
FIG. 30 is a schematic view of the cooling device of FIG. 28 in a state in which one of cooling members is drawn out.

Next, for a cooling device illustrated in FIGS. 28 to 30, a second transport assembly 32 is drawable to a front side of an apparatus body. A first transport assembly 31 is integrated with a cooling member 33*a* as a single unit, and the second transport assembly 32 is integrated with a cooling member 33*b* as a single unit. As illustrated in FIG. 28, the second transport assembly 32 and the cooling member 33*b* are drawable toward the front side.

In such a configuration, paired protrusions 120 of the cooling member 33*a* and paired recesses 121 of the cooling member 33*b* form a positioning assembly S. When the paired protrusions 120 of the cooling member 33*a* engage the paired recesses 121 of the cooling member 33*b*, the cooling member 33*a* and the cooling member 33*b* are positioned with respect to both the recording-material transport direction and the recording-material thickness direction.

As illustrated in FIG. 29, by moving the second transport assembly 32 downward, the second transport assembly 32 is separated from the first transport assembly 31. As illustrated in FIG. 30, from a state illustrated in FIG. 29, the second transport assembly 32 is drawable toward the front side of the apparatus body.

Figure 31A:
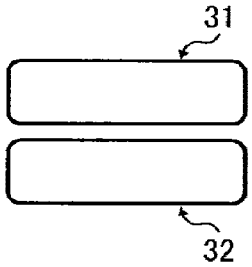
FIG. 31A is a schematic front view of another configuration of the transport assemblies of the cooling device.
Figure 31B:
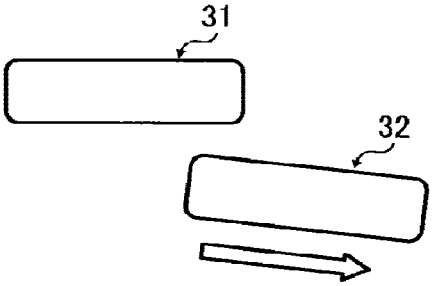
FIG. 31B is a schematic front view of the cooling device of FIG. 31A in a state in which one of the transport assemblies is drawn out.
Figure 32:
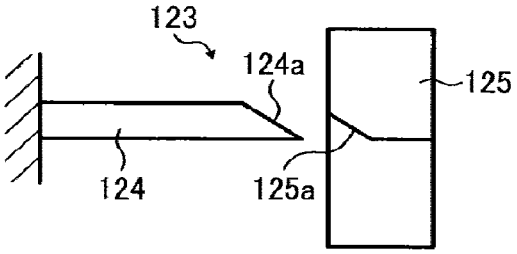
FIG. 32 is a schematic cross-sectional view of a guide assembly of the transport assemblies of the cooling device of FIGS. 31A and 31B.

As illustrated in FIG. 31B, from a state illustrated in FIG. 31A, the second transport assembly 32 may be drawn to drawable toward the front side of the apparatus body in an obliquely downward direction. In such a case, as illustrated in FIG. 32, a guide assembly 123 is provided to guide the second transport assembly 32. In other words, the first (upper) transport assembly 31 has a guide pins 124, and the second transport assembly 32 has a guide hole 125. The guide pins 124 have a tapered surface 124*a*, and the guide hole 125 has a tapered surface 125*a*.

Accordingly, the tapered surface 125*a* of the guide hole 125 is guided by the tapered surface 124*a* of the guide pins 124, thus allowing the second transport assembly 32 to be drawn obliquely downward. The guide assembly 123 thus configured allows the second transport assembly 32 to be guided with a simple configuration without, e.g., a complex release mechanism.

The above-described structure in which only the second transport assembly 32 is drawable toward the front side allows saving of a greater space than the structure in which, as illustrated in, e.g., FIGS. 26 and 27, both the first transport assembly 31 and the second transport assembly 32 are drawable toward the front side. The above-described structure maintenance is more advantageous in operability in maintenance work, thus allowing more prompt removal of jammed sheets.

Figure 33:
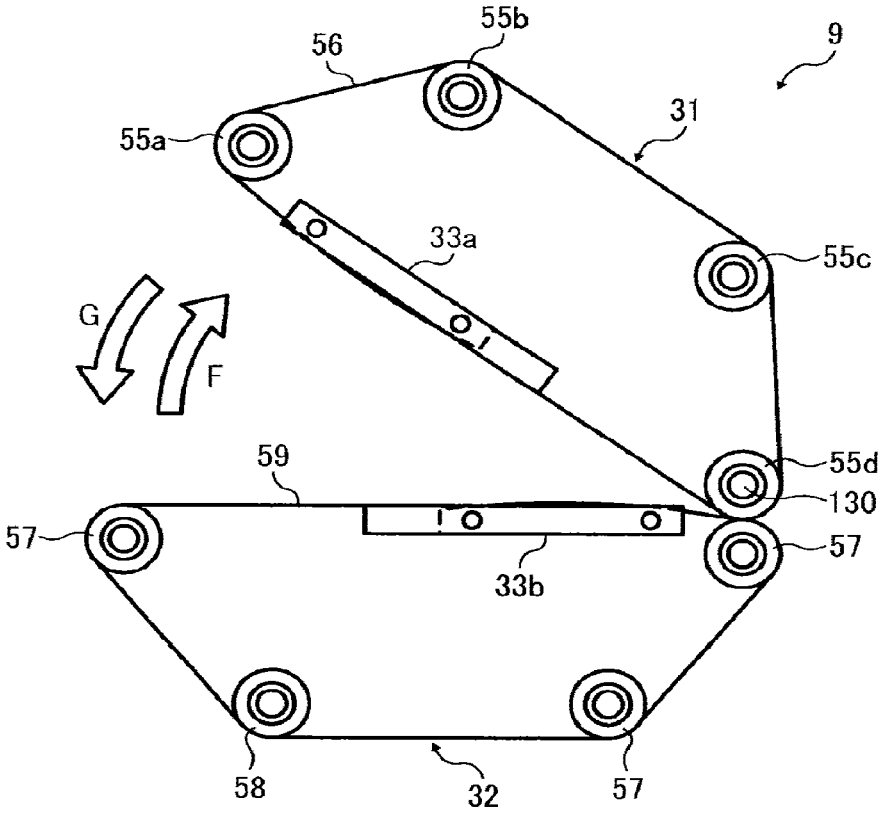
FIG. 33 is a schematic side view of another configuration of the cooling device in a state in which transport assemblies are placed away from each other.

In FIG. 33, the second transport assembly 32 is swingable around a swing support portion 130 in directions indicated by arrows F and G. In such a case, the swing support portion 130 serving as an approach-and-separation member is constituted of a roller 55*d* of the second transport assembly 32. Such a configuration allows the first transport assembly 31 or the cooling member 33*a* to come close to and move away from each other without using a space for drawing the transport unit toward the front side of the image forming apparatus.

Figure 34:
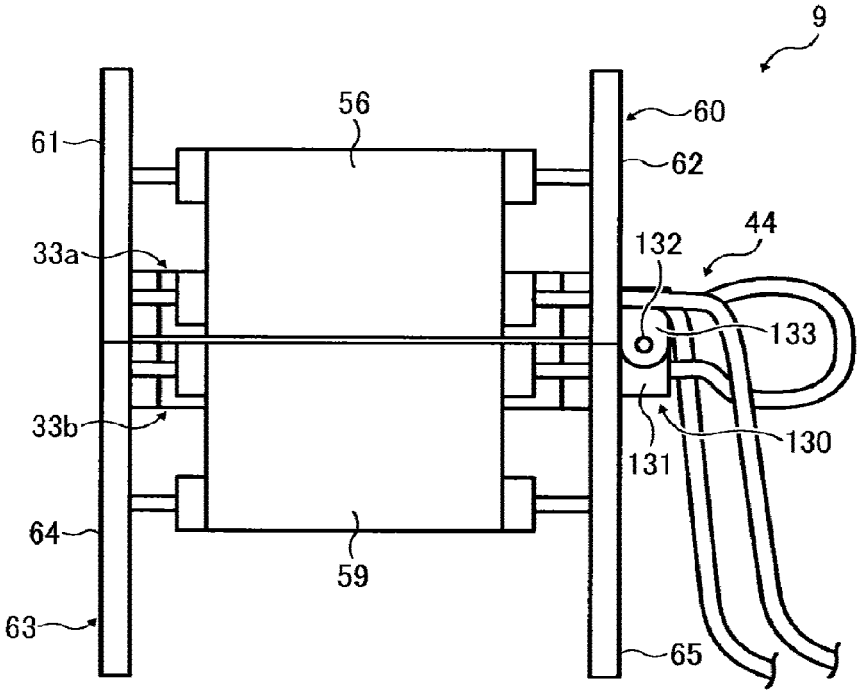
FIG. 34 is a front view of the cooling device of FIG. 33.
Figure 35:
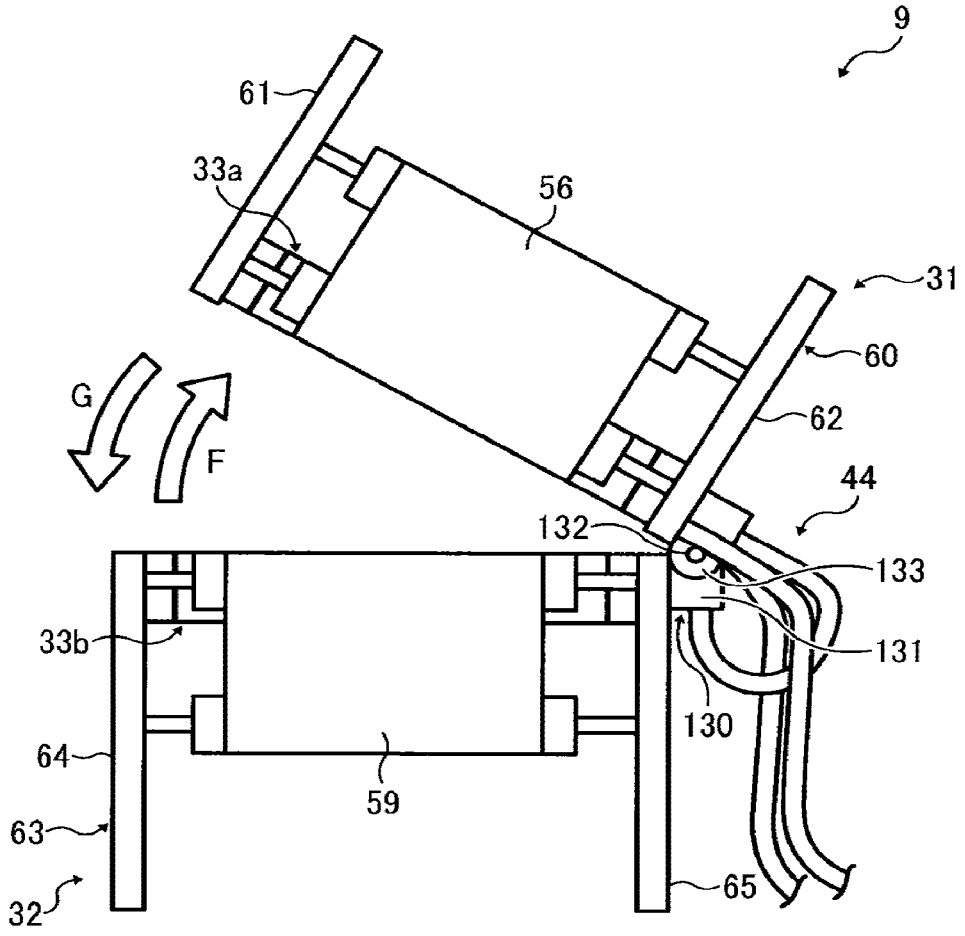
FIG. 35 is a front view of the cooling device of FIG. 33 in a state in which the transport assemblies are placed away from each other.

In FIGS. 34 and 35, the swing support portion 130 is provided as a separate member. In other words, a boss portion 131 is disposed on an upper portion of the side plate 65 of the holding frame 63, and a swing shaft 132 is disposed on the side plate 62 of the holding frame 60. A shaft support 133 is disposed on the side plate 62 of the holding frame 60, and the swing shaft 132 is supported by the shaft support 133. The swing shaft 132 is inserted through the boss portion 131, and the holding frame 60 is swingable around the swing shaft 132 in the directions indicated by arrows F and G. Accordingly, like the cooling device illustrated in FIG. 34, the first transport assembly 31 or the cooling member 33*a* can be placed close to and away from the second transport assembly 32 or the cooling member 33*b*.

As described above, in the configuration in which, as illustrated in, e.g., FIGS. 33 and 34, the second transport assembly 32 is swingable around the swing support portion 130 serving as the approach-and-separation member in the directions indicated by arrows F and G, the first transport assembly 31 and the second transport assembly 32 can also be placed close to and away from each other, thus facilitating maintenance work.

Figure 36:
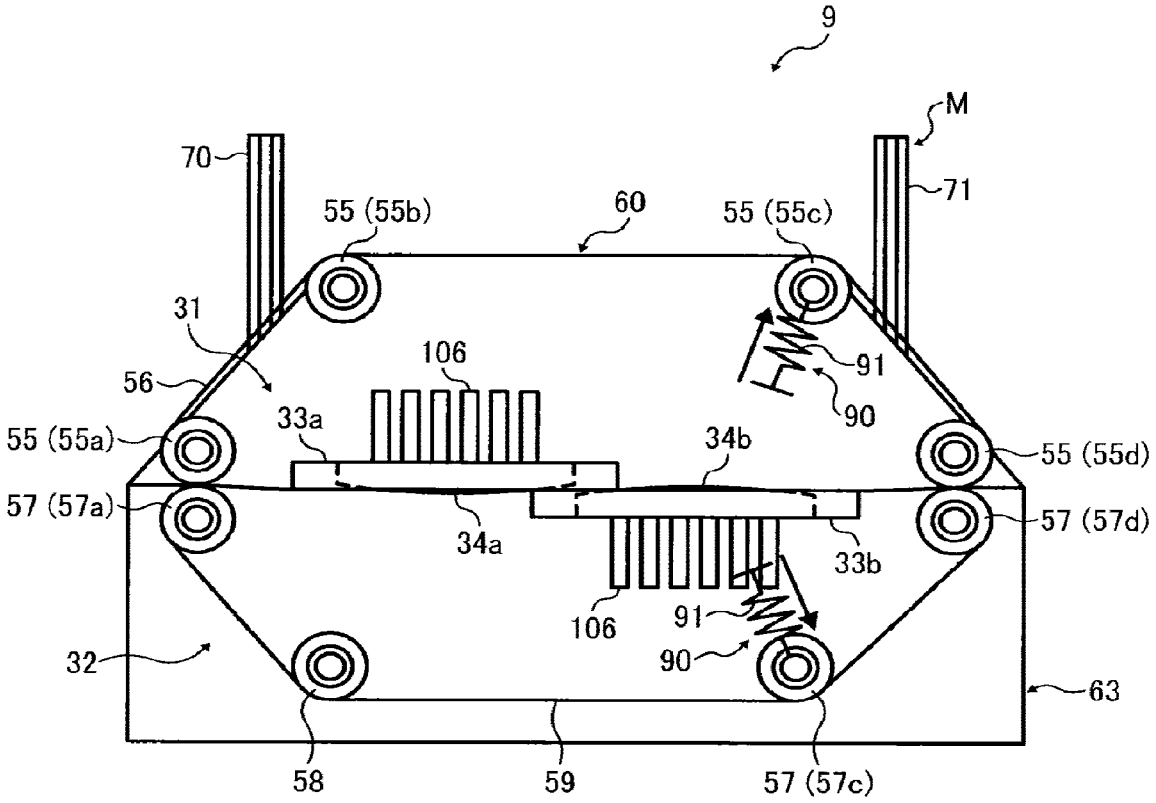
FIG. 36 is a schematic side view of another configuration of the cooling device.
Figure 37:
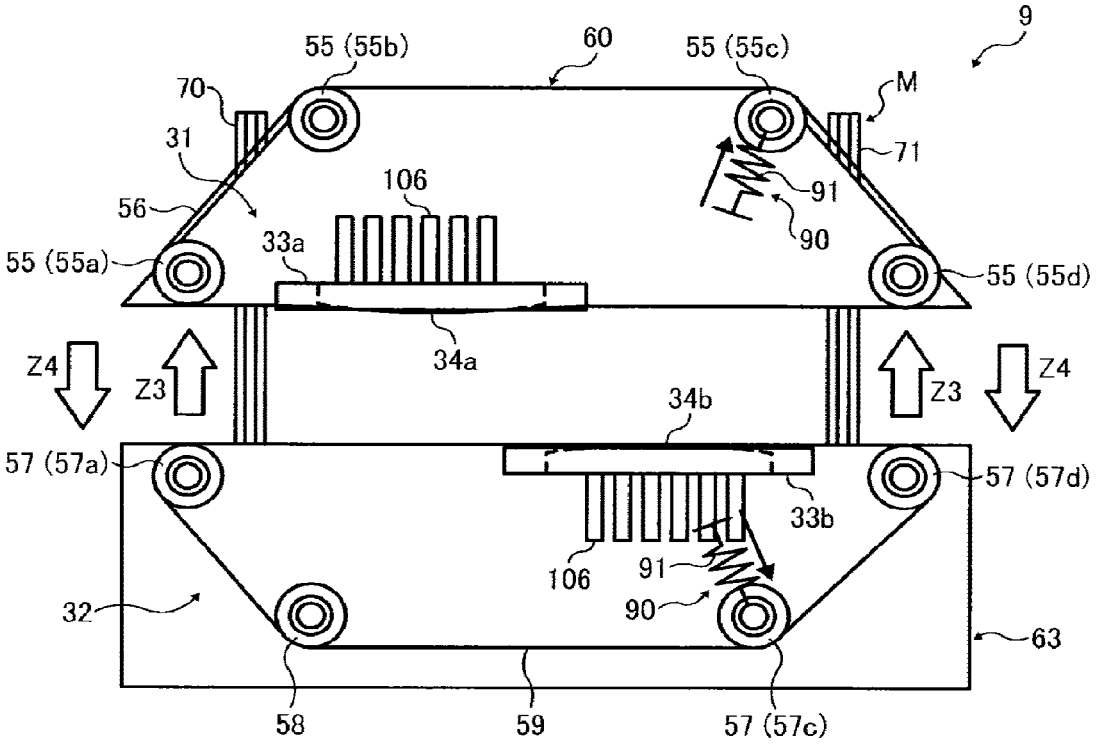
FIG. 37 is a schematic side view of the cooling device of FIG. 36 in a state in which transport assemblies are placed away from each other.

In FIGS. 36 and 37, the cooling unit does not include the cooling-liquid circuit 44. Each cooling member has a radiation facilitating part 106 on a side opposite a side on which a recording material is conveyed. As the radiation facilitating part 106, for example, an air-cooling heat sink having multiple fins is employed.

As described above, use of the air-cooling heat sink obviates use of the cooling-liquid circuit 44, thus allowing downsizing and cost reduction of the apparatus. In such a case as well, the first (upper) transport assembly 31 moves upward and downward as indicated by arrows Z3 and Z4 in FIG. 37.

Figure 38:
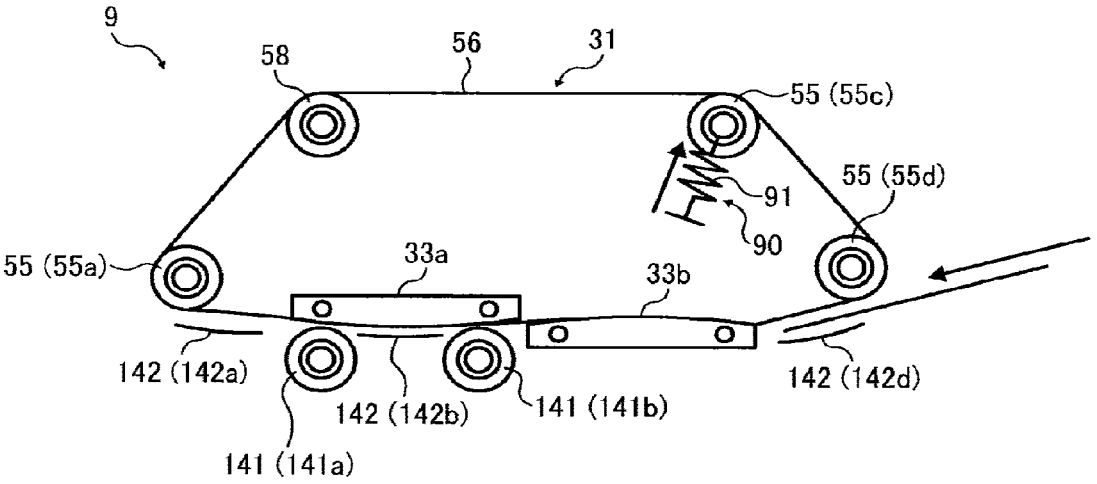
FIG. 38 is a schematic side view of another configuration of the cooling device.
Figure 39:
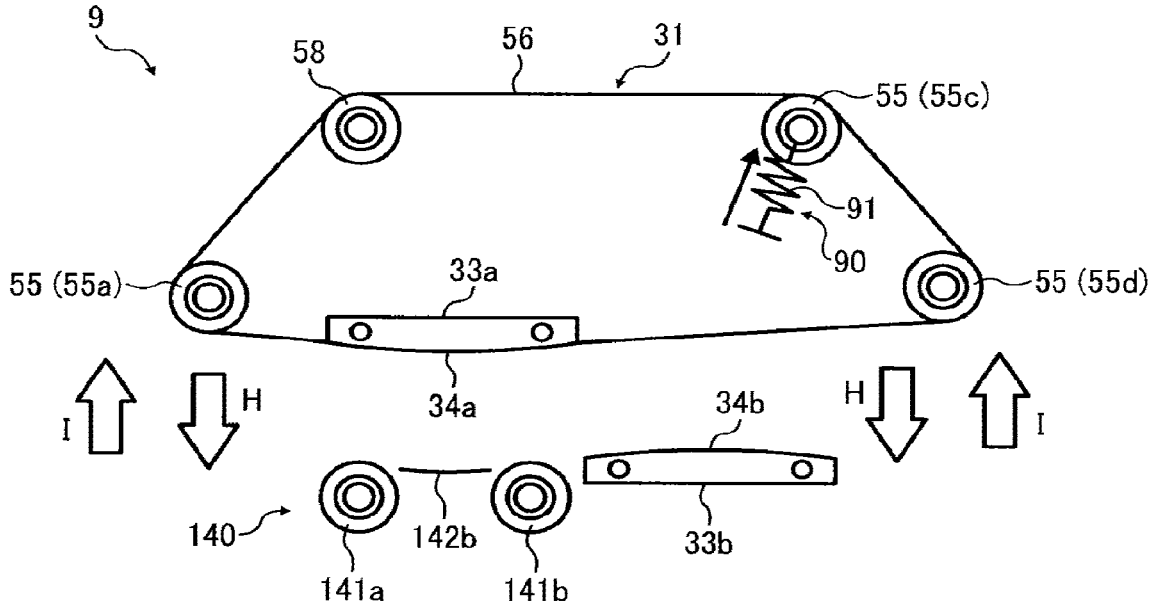
FIG. 39 is a schematic side view of the cooling device of FIG. 38 in a state in which transport assemblies are placed away from each other.

In FIGS. 38 and 39, a guide roller assembly 140 is provided as a lower transport unit corresponding to the above-described second transport assembly 32. In other words, in such a case as well, a belt transport unit 30 includes two cooling members 33*a* and 33*b*, and rollers 141*a* and 141*b* are disposed below the cooling member 33*a*. In a transport direction of a recording material, a guide plate 142*a* is disposed downstream from the roller 141*a*, a guide plate 142*b* is disposed between the rollers 141*a* and 141*b*. A guide plate 142*d* is disposed upstream from the cooling member 33*b*.

The guide plates 142*a*, 142*b*, and 142*d* and the rollers 141*a*, 141*b*, and 141*d* form the guide roller assembly 140. In such a configuration, the guide roller assembly 140 is held by a holding frame 63. As illustrated in FIG. 39, from a state illustrated in FIG. 38, the guide roller assembly 140 is movable downward in a direction indicated by arrow H. In other words, the guide roller assembly 140 is movable upward and downward as indicated by arrows H and I.

In such a case, when a driving roller is rotated in the first transport assembly 31, a belt 56 travels. A recording material P is guided by the guide plates 142*a*, 142*b*, and 142*d* and the rollers 141*a*, 141*b*, and 141*d* of the guide roller assembly 140 to pass through the cooling device.

A lower surface of the recording material P directly contacts and is cooled by a heat absorbing surface 34*b*, i.e., an upper surface of the cooling member 33*b*. Then, an upper surface of the recording material P contacts and is cooled by a heat absorbing surface 34*a*, i.e., a lower surface of the cooling member 33*a* via the belt 56.

For the cooling device illustrated in FIGS. 38 and 39, the guide roller assembly 140 serves as the lower transport unit (corresponding to the second transport assembly 32), thus allowing downsizing of the image forming apparatus. Additionally, use of the guide roller assembly 140 is advantageously less burden in upward and downward movements.

Figure 42:
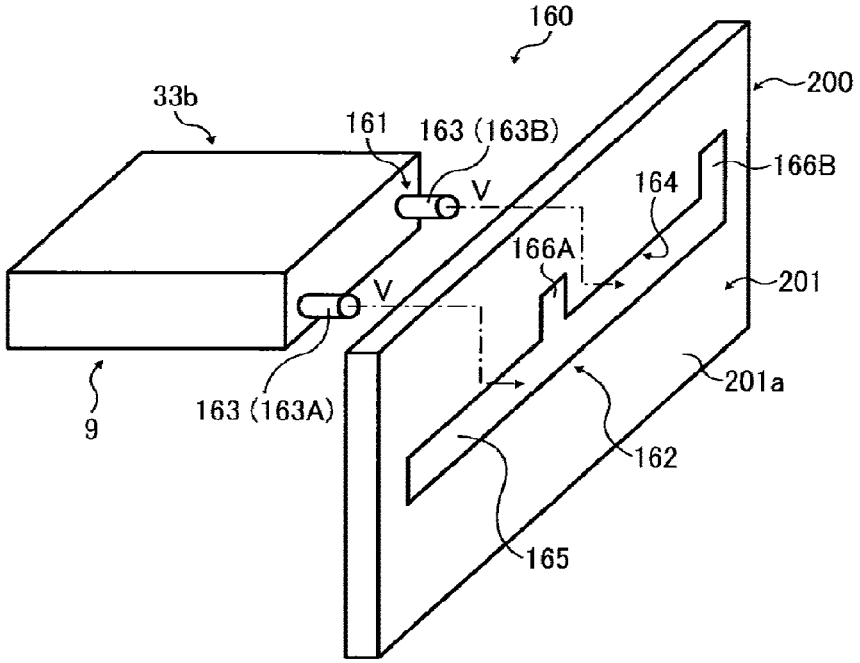
FIG. 42 is a schematic perspective view of a first guide unit.
Figure 43A:
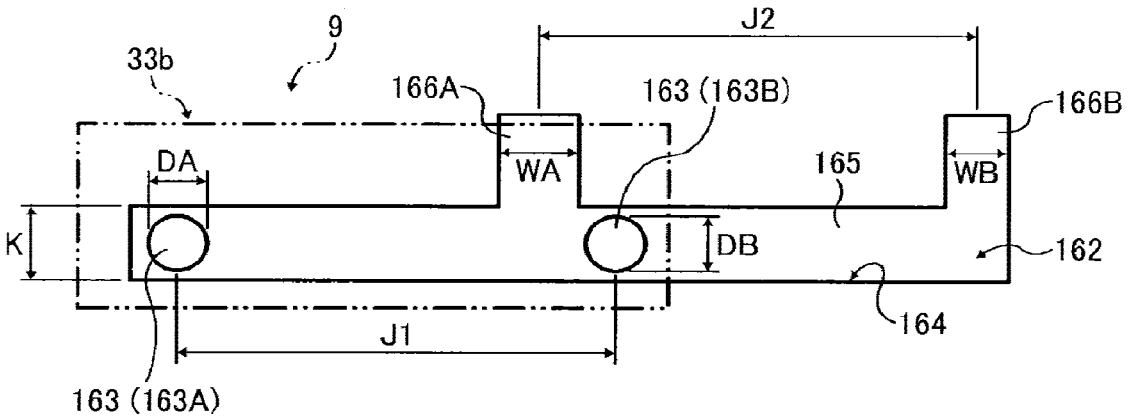
FIG. 43A is a schematic side view of the first guide unit of FIG. 42 in a state immediately before cooling members are set.
Figure 43B:
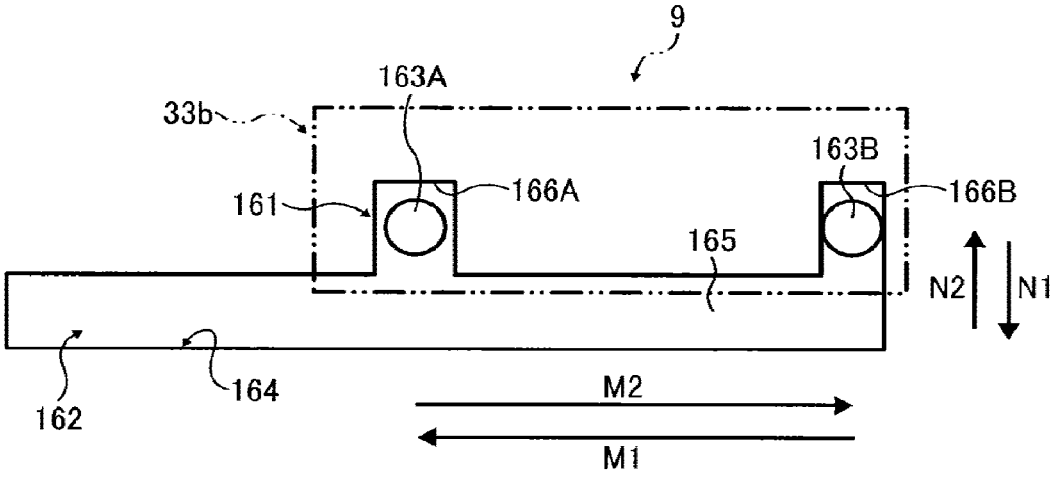
FIG. 43B is a schematic perspective view of the first guide unit of FIG. 42 in a state in which the cooling members are set.

Next, FIGS. 42, 43A, and 43B show guide assemblies (guide unit 160) to guide a lower, second cooling member 33*b* on installation and removal of the second cooling member 33*b* in a configuration in which, as illustrated in FIGS. 19 to 22 or FIGS. 28 to 30, a lower one of the cooling members 33, that is, the second cooling member 33*b* is movable. The guide unit 160 illustrated in FIG. 42 includes a first guide assembly 161 to guide the second cooling member 33*b* in upward and downward directions and a second guide assembly 162 to guide the second cooling member 33*b* in forward and backward directions of the apparatus body 200. The first guide assembly 161 guides the cooling device 9 (e.g., the cooling member 33*b*) to move downward as indicated by arrow N1 and upward as indicated by arrow N2 in FIG. 43B. The second guide assembly 162 guides the cooling device 9 (e.g., the cooling member 33*b*) to move forward as indicated by arrow M1 and backward as indicated by arrow M2 in FIG. 43B.

In other words, as illustrated in FIG. 42, the cooling device 9 (in this case, the cooling member 33*b*) has pins 163 (i.e., 163A and 163B) protruding toward a wall 201*a* of a casing 201. The wall 201*a* of the casing 201 has guides (e.g., guide grooves or guide holes) 164 into which the pins 163A and 163B are inserted. The pins 163A and 163B are disposed at a predetermined distance away from each other at the same height position.

The guide 162 includes a body portion 165, a first engagement portion 166A, and a second engagement portion 166B. The body portion 165 extends in the forward and backward directions. The first engagement portion 166A extends upward from a substantially middle portion of the body portion 165. The second engagement portion 166B extends upward from a rear portion of the body portion 165.

In such a case, the pins 163A and 163B are short cylindrical bodies or hollow short cylindrical bodies, and the first engagement portion 166A and the second engagement portion 166B are rectangular. The outer diameters of the pins 163A and 163B have the same length. Here, the term "same length" includes a completely identical length and a range of differences between actual products caused by, e.g., manufacturing error. By contrast, the width of the first engagement portion 166A is set to be greater than the width of the second engagement portion 166B.

In other words, as illustrated in FIG. 43A, relations of DA=DB=WB and WA>WB are satisfied, where DA represents an outer diameter of the pin 163A, DB represents the outer diameter of the pin 163B, WA represents the width of the first engagement portion 166A, and WB represents the width of the second engagement portion 166B. Additionally, a relation of DA=DB<K is satisfied, where K represents a size of the body portion 165 in the upward and downward direction. Furthermore, a relation of J1=J2 is satisfied, where J1 represents a pitch between the pins 163A and 163B and J2 represents a pitch between the first engagement portion 166A and the second engagement portion 166B.

In such a case, the pins 163A and 163B and the first engagement portion 166A and the second engagement portion 166B form the first guide assembly 161 with respect to the upward and downward direction. The pins 163A and 163B and the body portion 165 form the second guide assembly 162 with respect to the forward and backward direction.

In other words, when the cooling member 33*b* of the cooling device 9 is installed into the apparatus body 200, in a state illustrated in FIG. 42, the cooling member 33*b* is slid as indicated by arrow V. As a result, at the front side of the guide 164, the pins 163A and 163B are inserted in the body portion 165 of the guide 164. In such a state, as illustrated in FIG. 43A, the pin 163B, i.e., a rear one of the pin 163, does not preferably correspond to the second engagement portion 166B, i.e., a rear one of the second engagement portions 166.

In a state illustrated in FIG. 43A, the cooling member 33*b* is slid backward as indicated by arrow M2 in FIG. 43B to correspond the pin 163A to the first engagement portion 166A and the pin 163B to the second engagement portion 166B. Then, the cooling member 33*b* is moved upward as indicated by arrow N2. Thus, the pin 163A is engaged with the first engagement portion 166A, and the pin 163B is engaged with the second engagement portion 166B. The cooling member 33*b* is maintained in a state illustrated in FIG. 43B with a lock assembly.

In such a case, since DB=WB is satisfied, the cooling member 33*b* is positioned with respect to the forward and backward direction by engagement of the pin 163B with the second engagement portion 166B. Additionally, since WA>WB is satisfied, WA>DA is satisfied. As a result, the pin 163A is engaged with the first engagement portion 166A in a loosely fitting manner. When the pins 163A and 163B engage the first engagement portion 166A and the second engagement portion 166B, respectively, such a configuration effectively prevents the pins 163A and 163B from conflicting with the first engagement portion 166A and the second engagement portion 166B.

In the state illustrated in FIG. 43B, when the cooling member 33*b* is moved downward as indicated by arrow N1 and slid in the direction indicated by arrow M1, the cooling device 9 takes the state illustrated in FIG. 43A. In such a state, the cooling member 33 of the cooling device 9 is removable from the apparatus body 200 as illustrated in FIG. 42.

As described above, the configuration provided with the guide unit 160 allows simple and stable installation and removal of the cooling device 9 (in this case, the cooling member 33*b*). As described above, the guide unit 160 guides the cooling device 9 backward with respect to the forward and backward direction and then upward with respect to the upward and downward direction. Such a configuration prevents the belt 56 of the first transport assembly 31 and the belt 59 of the second transport assembly 32 from rubbing against each other, and also prevents the cooling members 33*a* and 33*b* from rubbing against the belts 56 and 59, respectively.

Figure 44A:
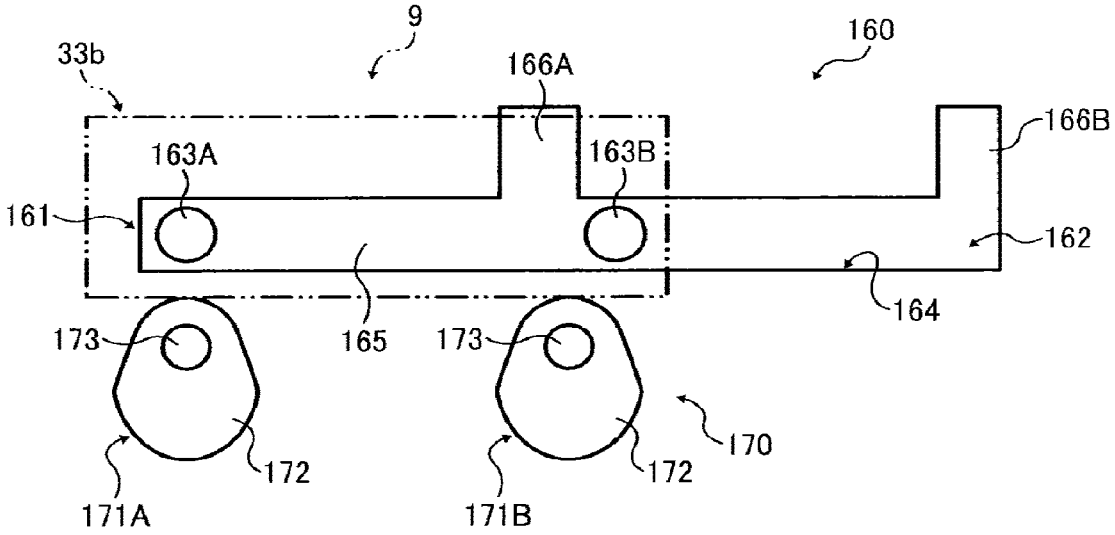
FIG. 44A is a schematic side view of a second guide unit in a state immediately before cooling members are set.
Figure 44B:
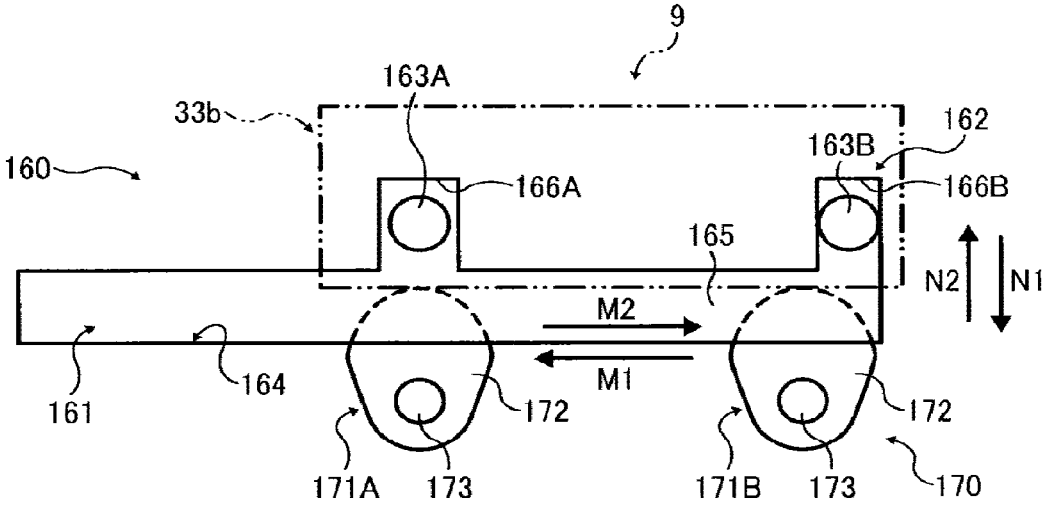
FIG. 44B is a schematic perspective view of the second guide unit of FIG. 44A in a state in which the cooling members are set.

FIGS. 44A and 44B show a moving assembly 170 to move the cooling device 9 upward and downward. The elevation assembly 170 includes a pair of cam units 171A and 171B. Each of the cam units 171A and 171B includes a cam member 172 and a shaft 173 to support the cam member 172. The shaft 173 is disposed at a position eccentric to a center of the cam member 172.

Thus, in a state illustrated in FIG. 44A in which a long diameter direction of each of the cam units 171A and 171B is placed in parallel to the vertical direction and the shaft 173 is placed at an upper position, the cam units 171A and 171B do not push up the cooling member 33*b* and the pins 163A and 163B are inserted in the body portion 165 of the guide 164.

In such a state, the moving assembly 170 is slidable forward and backward together with the cooling member 33*b*. Accordingly, as illustrated in FIG. 44B, after the cooling member 33*b* is slid backward as indicated by arrow M2, each of the cam units 171A and 171B is rotated around the shaft 173 clockwise or counterclockwise so that the long diameter direction of each of the cam units 171A and 171B is placed in parallel to the vertical direction and the shaft 173 is placed at a lower position. As a result, the cam members 172 of the cam units 171A and 171B push the cooling member 33*b* upward as indicated by arrow N2, thus engaging the pins 163A and 163B with the first engagement portion 166A and the second engagement portion 166B.

In addition, from a state illustrated in FIG. 44B, each of the cam units 171A and 171B is rotated around the shaft 173 clockwise or counterclockwise so that the long diameter direction of each of the cam units 171A and 171B is placed in parallel to the vertical direction and the shaft 173 is placed at an upper position. Thus, the cooling member 33*b* is moved downward as indicated by arrow N1. Then, the cooling member 33*b* is slid as indicated by arrow M1 and returned to the state illustrated in FIG. 44A.

As described above, the configuration provided with the moving assembly 170 including the cam units 171A and 171B allows the cooling member 33*b* to stably move upward and downward. In the state illustrated in FIG. 44B, for example, by locking the cam units 171A and 171B, the cooling member 33*b* can be maintained in a stable state.

Figure 45A:
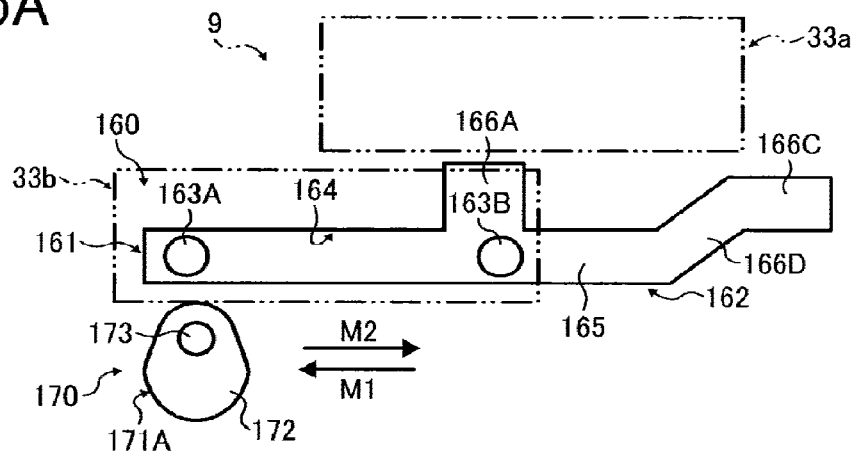
FIG. 45A is a schematic side view of a third guide unit in a state immediately before cooling members are set.
Figure 45B:
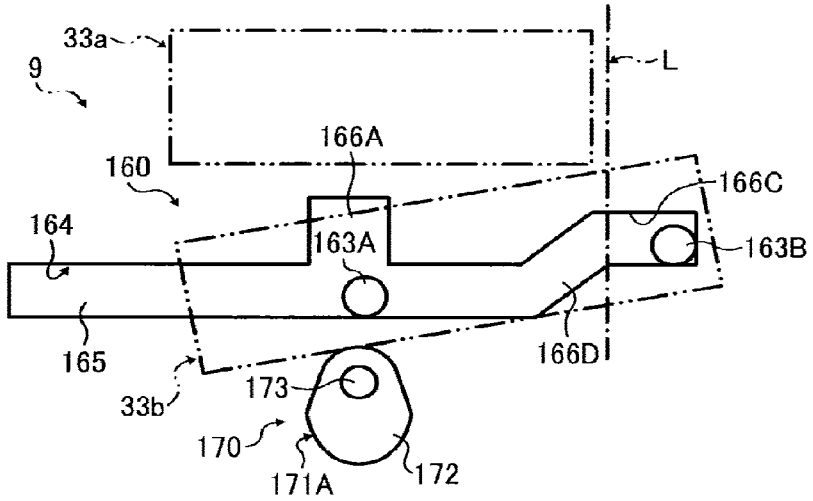
FIG. 45B is a schematic perspective view of the third guide unit of FIG. 45A in a state on the way in which the cooling members are set.
Figure 45C:
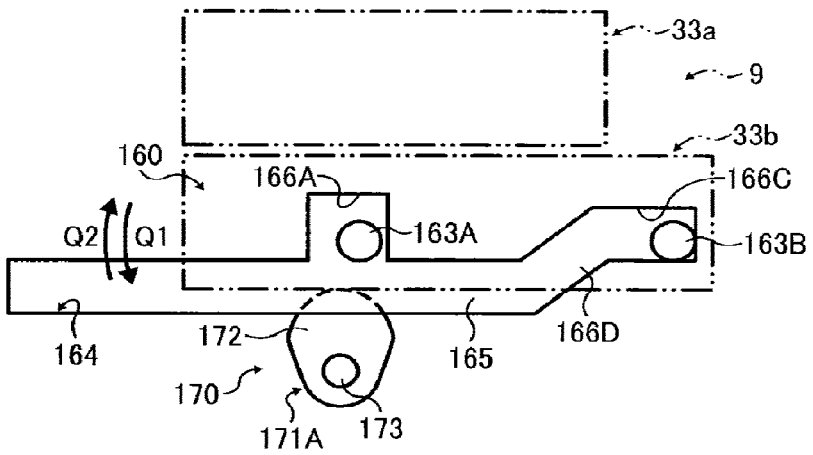
FIG. 45C is a schematic perspective view of the third guide unit of FIG. 45A in a state in which the cooling members are set.

Next, in FIGS. 45A, 45B, and 45C, the cam unit 171B at the rear side of the cooling device 9 illustrated in FIGS. 44A and 44B is omitted. In a guide 164 of FIGS. 45A, 45B, and 45C, an engagement portion 166C is disposed at the rear side of the cooling device 9 so as to horizontally extend. In other words, the guide 164 includes a body portion 165, an engagement portion 166A, a slope portion 166D, and the engagement portion 166C. The body portion 165 horizontally extends in a forward and backward direction of the cooling device 9. The slope portion 166D slopes upward in a backward direction. The engagement portion 166A extends upward from a position slightly rearward from a center of the body portion 165.

In installation operation, as illustrated in FIG. 45A, the pins 163A and 163B are inserted into the body portion 165 of the guide 164. In such a state, the cam unit 171A is directed so that the long diameter direction thereof is placed in parallel to the vertical direction and the shaft 173 is placed at the upper position.

Then, the cooling member 33*b* of the cooling device 9 is slid backward as indicated by arrow M2. With the sliding movement, the pin 163B is guided by the slope portion 166D of the guide 164 and inserted into the engagement portion 166C at the rear side. In this time, since the slope portion 166D is moved up toward the rear side, as illustrated in FIG. 45B, the cooling member 33*b* is tilted so that the rear side is raised (i.e., the front side is lowered).

Then, the cam unit 171A is rotated around the shaft 173 clockwise or counterclockwise so that the long diameter direction of the cam unit 171A is placed in parallel to the vertical direction and the shaft 173 is placed at a lower position. As a result, the cooling member 33*b* swings around the pin 163B in a direction indicated by arrow Q2 in FIG. 45C, and the pin 163A engages the engagement portion 166A.

From a state illustrated in FIG. 45C, the cam member 172 is rotated around the shaft 173 so that the long diameter direction of the cam unit 171A is placed in parallel to the vertical direction and the shaft 173 is placed at the upper position. As a result, the cooling member 33*b* is rotated around in a direction indicated by arrow Q1 in FIG. 45C, and turns into a state illustrated in FIG. 45B, i.e., is tilted so that the rear side is raised (and the front side is lowered). Then, the cooling member 33*b* is slid in the direction indicated by arrow M1 in FIG. 45A and turns into the state illustrated in FIG. 45A.

As described above, for the guide unit 160 illustrated in FIGS. 45A to 45C, a rear-side cam unit as illustrated in FIGS. 44A and 44B can be omitted. Thus, the number of components can be reduced, thus allowing cost reduction. The above-described configuration also allows the cooling member 33*b* to be stably guided in both the upward and downward direction and the forward and backward direction.

For the guide unit 160 illustrated in FIG. 45B, the engagement portion 166C is disposed at a position more rearward than line L indicating a rear edge of the first cooling member 33*a*. Such a configuration allows the cooling member 33*b* to be locked more rearward than the rear edge line L, thus allowing the cooling members 33*a* and 33*b* to come close to and separate from each other without conflict.

Figure 46A:
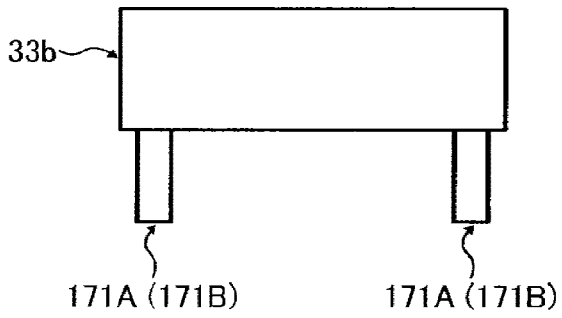
FIG. 46A is a schematic view of a moving assembly with cam units disposed at opposed ends in a width direction.
Figure 46B:
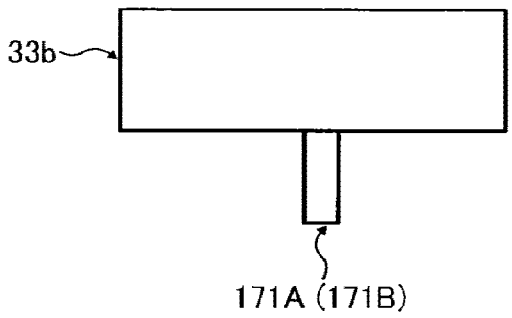
FIG. 46B is a schematic view of a moving assembly with a cam unit disposed at a middle portion in the width direction.

Alternatively, in a configuration provided with the guide assembly 171A (171B) as illustrated in FIGS. 44A and 44B and 45A to 45C, the number of the guide assembly 171A (171B) may be, for example, two as illustrated in FIG. 46A or one as illustrated in FIG. 46B.

In FIG. 46A, two guide assemblies 171A (171B) are arranged at a certain interval in parallel to the width direction (i.e., lateral direction perpendicular to the forward and backward direction) of the apparatus body. In such a case, the cooling member 33*b* has the guide assemblies 171A (171B) at opposed ends in the width direction. In FIG. 46B, the cooling member 33*b* has one guide assembly 171A (171B) at a center in the width direction.

Figure 47:
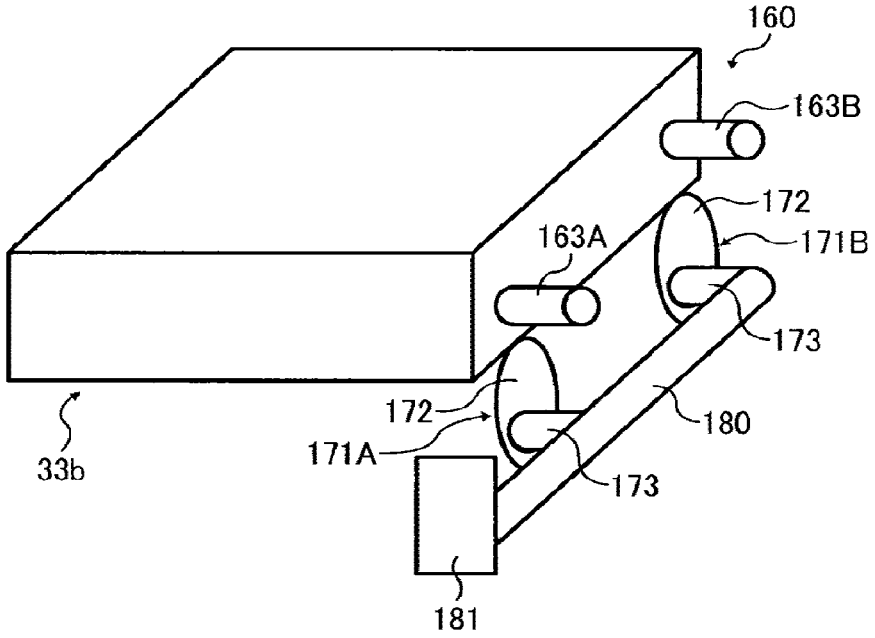
FIG. 47 is a schematic perspective view of the third guide unit.

In FIG. 47, paired cam units 171A and 171B have shaft portions 173 connected to a shaft 180 extending in the forward and backward direction. The shaft 180 has a grip 181 at an end thereof.

In such a case, by operating the grip 181, the paired cam units 171A and 171B are movable in conjunction with each other, thus allowing the cooling member 33*b* to be stably and simply guided in both the upward and downward direction and the forward and backward direction. Accordingly, such a configuration allows operation from the outside of the apparatus body 200 during jam processing or maintenance.

It is to be noted that the image forming apparatus according to the present disclosure is not limited to the above-described exemplary embodiments. Various modifications are possible within the scope of the above-described teachings. An image forming apparatus according to an exemplary embodiment of the present disclosure may be, for example, an electrophotographic copier, a laser beam printer, or a facsimile machine. In the above-described embodiments, the image forming apparatus is described taking an example of monochromatic electrophotographic apparatus. However, the image forming apparatus is not limited to the monochromatic electrophotographic apparatus, but may be, for example, a color electrophotographic apparatus.

Regarding the first transport assemblies 31 and 32, within a range in which, as illustrated in FIG. 2, the first transport assemblies 31 and 32 can sandwich and convey a recording material P, the number of rollers 55 and 57 can be increased or reduced. Additionally, the number of cooling members is not limited to two or three but may be four or more. One of the cooling members 33 upstream in the transport direction of a recording material may be disposed at an upper side while the other of the cooling members 33 downstream in the transport direction is disposed at a lower side. Alternatively, one of the cooling members 33 upstream in the transport direction of a recording material may be disposed at a lower side while the other of the cooling members 33 downstream in the transport direction is disposed at an upper side.

When the cooling members 33 are placed close to or away from each other, for the cooling device 9 illustrated in, e.g., FIG. 1, the upper cooling member 33*a* is moved upward and downward. By contrast, for the cooling device 9 illustrated in, e.g., FIGS. 38 and 39, the lower cooling member 33*b* is moved upward and downward. Alternatively, in the cooling device 9 illustrated in, e.g., FIG. 1, the lower cooling member 33*b* may be moved upward and downward. In the cooling device 9 illustrated in, e.g., FIGS. 38 and 39, the upper cooling member 33*b* is moved upward and downward. In addition, both the upper cooling member 33*a* and the lower cooling member 33*b* are movable to come close to and separate from each other.

The positions of the tension application units 90 are not limited to the positions illustrated in FIG. 17 but may be any suitable positions. The recording material P is not limited to a cut sheet but may be, for example, a media roll. In such a case, the image forming apparatus includes a media roll setting part instead of the feed trays 13, a cutter unit to cut the media roll at a certain position (for example, upstream from the registration roller 15 or the fixing device 8 in a transport direction of the media roll), and an output tray 20 to stack cut pieces of recording media. Alternatively, instead of the cutter unit, a reel unit may be provided to reel an output media roll.

Regarding the guide unit 160, the number of the pins 163 is not limited to two but may be increased or reduced. Thus, the number of the engagement portions 166 to engage with the pins 163 may also be increased or reduced in accordance with the number of the pins 163. The number of the cam units 171 may also be increased or decreased. The pitch between or positions of the cam units 171 are set to any other suitable pitch or positions within a range in which the cooling members 33 can be moved upward and downward by the cam units 171.

In FIGS. 45A to 45C, only the rear-side pin 163B is moved upward and downward. Alternatively, the front-side pin 163A may be movable upward and downward similarly with the pin 163B.

In FIG. 47, to move the paired cam units 171A and 171B in conjunction with each other, the shafts 173 of the cam units 171A and 171B are connected to the shaft 180. Alternatively, in a configuration in which the cam units 171A and 171B are arranged in the width direction, all of the cam units 171A and 171B may be moved in conjunction with each other.

As illustrated in, e.g., FIGS. 28 to 30, in a configuration in which the first transport assembly 31 is integrated with the cooling member 33 as a single unit and the second transport assembly 32 is integrated with the cooling member 33*b* as a single unit, the pins 163 may be disposed on, for example, the holding frame 65 of the second transport assembly 32.

Next, a cooling device 9 according to an exemplary embodiment of this disclosure is described with reference to drawings.

Figure 48B:
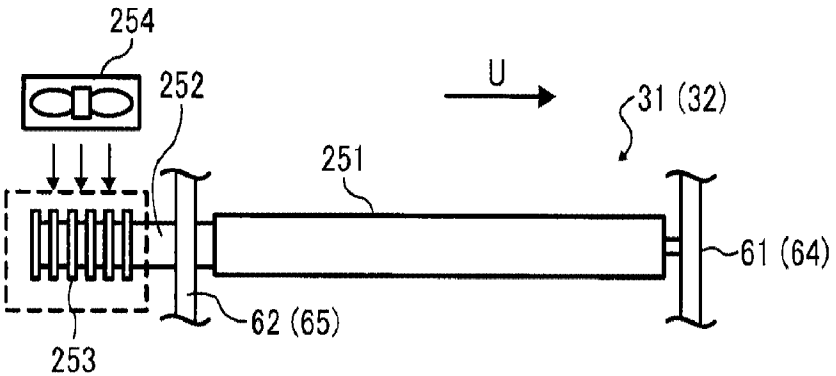
FIG. 48B is a side view of a cooling member of the cooling device of FIG. 48A.
Figure 48A:
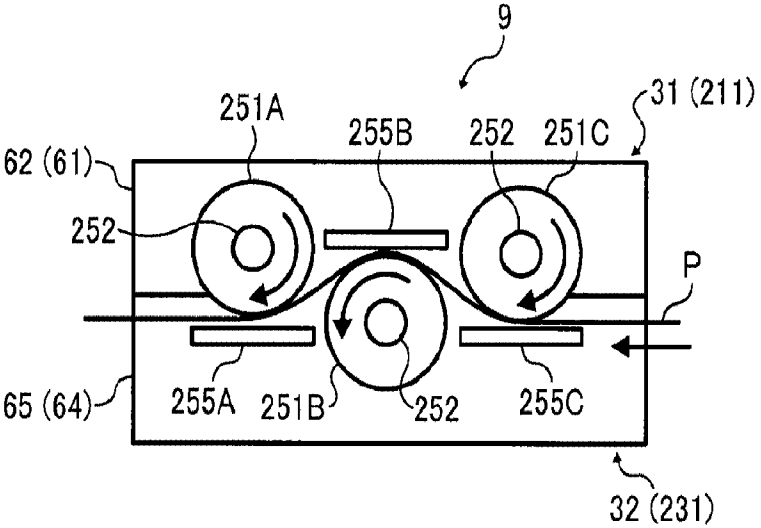
FIG. 48A is a cross-sectional view of a cooling device according to an exemplary embodiment of this disclosure.

FIG. 48A is a cross-sectional view of a cooling device 9 according to an exemplary embodiment of this disclosure. FIG. 48B is a side view of a cooling member of the cooling device 9.

Figure 49B:
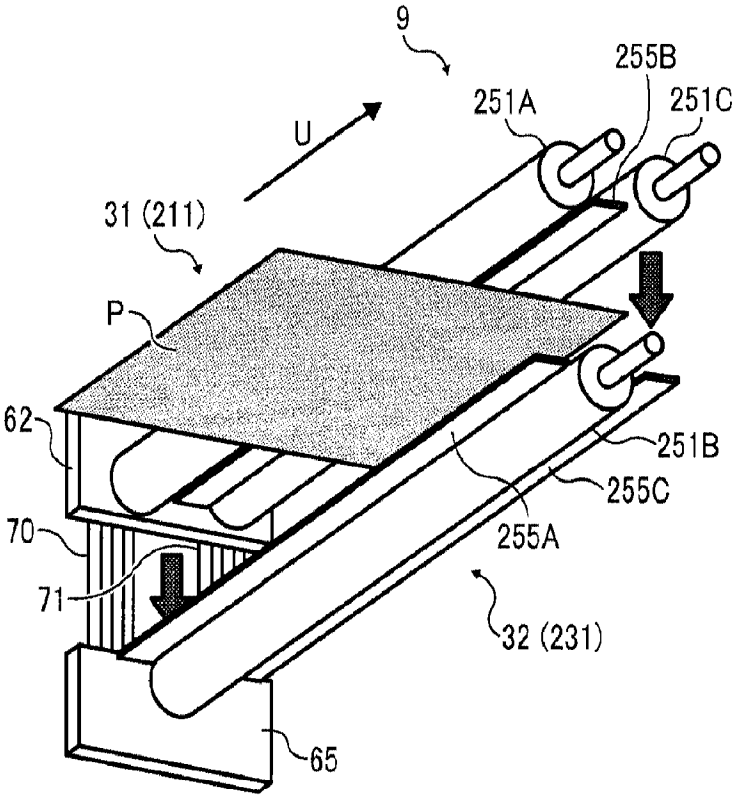
FIG. 49B is a perspective view of the cooling device of FIG. 48A in a state after separation.
Figure 49A:
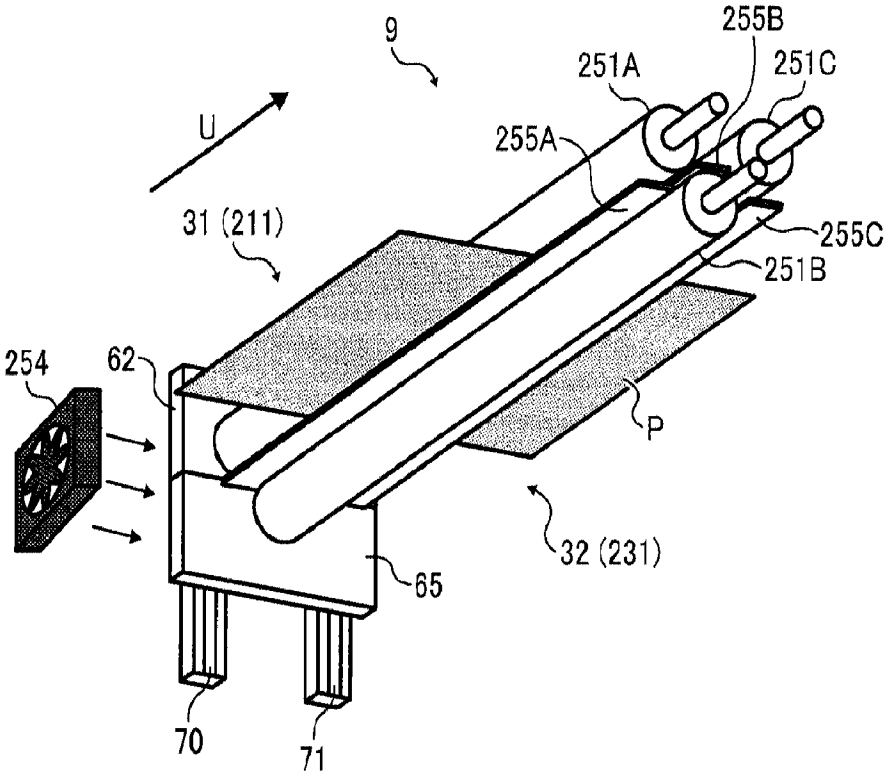
FIG. 49A is a perspective view of an example of the cooling device of FIG. 48A in a state before separation.

FIGS. 49A and 49B are perspective views of an example of the cooling device 9 in which the position of a lighter one of a front-face-side sandwiching part and a back-face-side sandwiching part is displaceable in parallel to the other heavier one so as to bring the front-face-side sandwiching part and the back-face-side sandwiching part close to and away from each other. FIG. 49A is a perspective view of the cooling device 9 in a state before separation. FIG. 49B is a perspective view of the cooling device 9 in a state after separation.

Figure 50B:
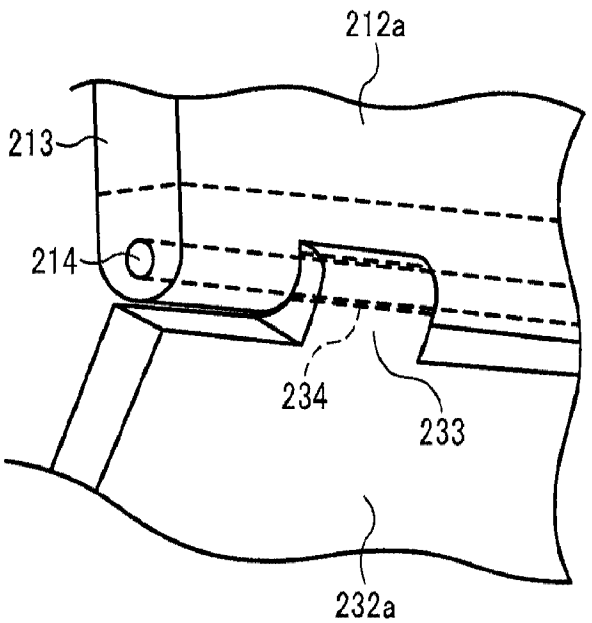
FIG. 50B is a schematic side view of a hinge part of the cooling device of FIG. 50A.
Figure 50A:
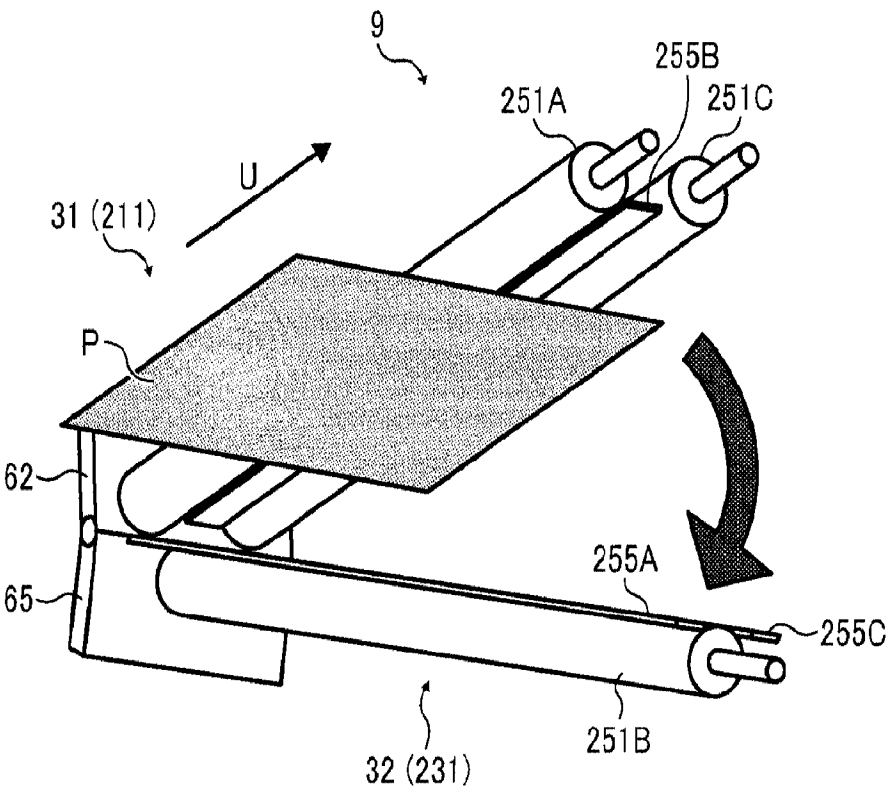
FIG. 50A is a perspective view of an example of the cooling device in a state before separation.

FIGS. 50A and 50B are perspective views of another example of the cooling device 9 in which the position of a lighter one of a front-face-side sandwiching part and a back-face-side sandwiching part is displaceable relative to the other heavier by rotating around a rotation fulcrum. FIG. 50A is a perspective view of the cooling device 9 in a state after separation. FIG. 50B is a schematic view of a hinge part of the cooling device 9 of FIG. 50A.

As illustrated in FIG. 48A, the cooling device 9 includes a first transport assembly 31 serves as first sandwiching part and a second transport assembly 32 serves as second sandwiching part to sandwich a recording material P therebetween. The first transport assembly 31 is disposed at an upper side in FIG. 48A to support a recording material P from a front side of the recording material P on which toner adheres in a softened state. The second transport assembly 32 is disposed at a lower side in FIG. 48A to support the recording material P from a back side of the recording material P. The first transport assembly 31 and the second transport assembly 32 include cooling rollers 251 (251A, 251B, and 251C) which are roller-shaped cooling members. Specifically, the first transport assembly 31 includes the cooling roller 251A and the cooling roller 251C, and the second transport assembly 32 includes the cooling roller 251B. After a toner image is fixed on a recording material P under heat, the heated recording material P is carried on outer surfaces of the cooling rollers 251. While rotationally conveying the recording material P, the cooling rollers 251 directly contact the recording material P to absorb heat and cool the recording material P. Guide members 255A, 255B, and 255C are disposed facing the cooling rollers 251A, 251B, and 251C, respectively, to guide the recording material P. While sandwiching and conveying the recording material P with the guide members 255, the cooling rollers 251 cool the recording material P from both the front and back faces.

For example, as illustrated in FIG. 48A, the first transport assembly 31 includes side plates 61 and 62, two of the cooling rollers 251 (in FIG. 48A, 251A and 251C) rotatable in a transport direction of the recording material P (recording-material transport direction), and one of the guide members 255 (in FIG. 48A, the guide member 255B) between the two cooling rollers 251A and 251C. As illustrated in FIG. 48B, each of the cooling rollers 251A and 251C is supported from both lateral sides by the side plates 61 and 62 having bearings to receive a cooling roller shaft 252 serving as a rotation shaft thereof. Each of the cooling rollers 251A and 251C has radiation fins 253 at an end of the side plate 62. A cooling fan 254 blows wind against the radiation fins 253 behind the side plates 62 to radiate the cooling roller shaft 252. Thus, heat absorbed from the recording material P by the cooling rollers 251A and 251C is radiated via the cooling roller shaft 252. The cooling rollers 251A and 251C of the first transport assembly 31 sandwich and convey the recording material P with the guide members 255A and 255C of the second transport assembly 32 while cooling the recording material P. In the first transport assembly 31, the side plate 61, the side plate 62, the cooling roller shaft 252, and the guide member 255B form a front-face-side holding frame 211 to hold the cooling rollers 251A and 251C and the guide member 255B.

As illustrated in FIG. 48A, the second transport assembly 32 includes side plates 64 and 65, the cooling roller 251B rotatable in the transport direction of the recording material P, and the guide members 255A and 255C disposed upstream and downstream from the cooling roller 251B in the recording-material transport direction. Similarly with the first transport assembly 32, the cooling roller 251B is supported from both lateral sides by the side plates 64 and 65 having bearings to receive a cooling roller shaft 252 serving as a rotation shaft thereof. A cooling fan 254 blows wind against the radiation fins 253 behind the side plate 65 to radiate the cooling roller shaft 252. Thus, heat absorbed from the recording material P by the cooling roller 251B is radiated via the cooling roller shaft 252. The cooling roller 251B of the second transport assembly 32 sandwiches and conveys the recording material P with the guide member 255B of the first transport assembly 31 while cooling the recording material P. In the second transport assembly 32, the side plates 64 and 65, the cooling roller shaft 252, and the guide members 255A and 255C form a back-face-side holding frame 231 to hold the cooling roller 251B and the guide members 255A and 255C.

As described above, the multiple cooling rollers 251 are separately provided in the first transport assembly 31 and the second transport assembly 32 to allow a recording material P to be alternately cooled from both the front-face side and the back-face side. Such a configuration more effectively cools the recording material P than a configuration in which the same number of cooling rollers 251 (in this case, three cooling rollers) are provided in only one of the first transport assembly 31 and the second transport assembly 32. In other words, at least one cooling roller 251 is provided in each of the first transport assembly 31 and the second transport assembly 32, thus allowing more effective cooling of the recording material P than the configuration in which the same number of cooling rollers 251 (in this case, three cooling rollers) are provided in only one of the first transport assembly 31 and the second transport assembly 32. When the number of cooling rollers 251 to achieve a sufficient cooling performance is an odd number, the number of cooling rollers 251 is asymmetric between the first transport assembly 31 and the second transport assembly 32. In this exemplary embodiment, the first transport assembly 31 to cool a front face of a recording material P has two cooling rollers 251 (i.e., the cooling rollers 251A and 251C) and the second transport assembly 32 to cool a back face of the recording material P has one cooling roller 251 (i.e., the cooling roller 251B). It is to be noted that the number of cooling rollers 251 allocated to each sandwiching part is not limited to the above-described example but may be any other suitable number. For example, the first transport assembly 31 may have three cooling rollers 251 while the second transport assembly 32 has two cooling rollers 251.

For a cooling device like the above-described cooling device 9 according to this exemplary embodiment, if the cooling device stops due to, e.g., a jam of a recording material P in passing through the cooling device, a user removes the recording material P before restart. To facilitate such maintenance work, the cooling rollers 251 and the corresponding guide members 255 sandwiching the recording material P from both the front-face and the back-face side are separated away from each other. Hence, in this exemplary embodiment, to separate the cooling rollers 251 from the corresponding guide members 255, the front-face-side holding frame 211 of the first transport assembly 31 and the back-face-side holding frame 231 of the second transport assembly 32 are separated away as follow.

The cooling device 9 according to this exemplary embodiment cools a recording material P in the above-described manner, and the number of the cooling rollers 251 is different between the first transport assembly 31 and the second transport assembly 32. The first transport assembly 31 and the second transport assembly 32 are the same in the configuration of the cooling rollers 251 and substantially the same in other configurations. Thus, the weight of the front-face-side holding frame 211 and components held by the front-face-side holding frame 211 differs from the weight of the back-face-side holding frame 231 and components held by the back-face-side holding frame 231. In the above-described configuration in which the number of the cooling rollers 251 is different between the first transport assembly 31 and the second transport assembly 32, as illustrated in FIGS. 49A and 49B (in which a lateral plate at a user side, i.e., the lateral plate 212*b* is omitted for visibility), the second transport assembly 32 (the back-face-side holding frame 231) having a smaller number of the cooling rollers 251 and a smaller weight is movable. In other words, of the first transport assembly 31 and the second transport assembly 32, the lighter one, i.e., the second transport assembly 32 is displaceable relative to the heavier one, i.e., the first transport assembly 31. When the first transport assembly 31 and the second transport assembly 32 come close to and separate from each other, the heavier one, i.e., the first transport assembly 31 is fixed and the lighter one, i.e., the second transport assembly 32 is movable.

For example, for the example illustrated in FIGS. 49A and 49B, from a state illustrated in FIG. 49A in which a recording material P is sandwiched with the cooling rollers 251A to 251C and the guide members 255A to 255C, the second transport assembly 32 is moved in parallel to the first transport assembly 31 so as to separate from the first transport assembly 31. In FIGS. 49A and 49B, the front-face-side holding frame 211 are provided with guide rails 70 and 71, and the back-face-side holding frame 231 of the second transport assembly 32 are provided with sliders reciprocally movable upward and downward while being guided along the guide rails 70 and 71 and holding the second transport assembly 32. By providing such a displacement assembly (moving assembly) to displace the position of the second transport assembly 32 relative to the first transport assembly 31, the back-face-side holding frame 231 can be moved downward together with the single cooling roller 251B and the two guide members 255A and 255C, thus allowing a user to remove a recording material P at occurrence of a jam.

Thus, only the lighter one, i.e., the second transport assembly 32 can be configured to move to separate the first transport assembly 31 and the second transport assembly 32 from each other for maintenance work at occurrence of a jam in the cooling device 9. As compared with a configuration in which both sandwiching parts are displaced (moved), such a configuration further reduces a burden of the weight of the cooling rollers 251 and accompanying components including the guide members 255 to a user or components such as the guide rails 70 and 71 holding the second transport assembly 32 moved. As a result, the cooling device 9 can reduce the burden of the weight of the cooling rollers 251 and accompanying components including the guide members 255 to a user or components to hold the sandwiching part moved, when the first transport assembly 31 and the second transport assembly 32 come close to or separate from each other in, e.g., maintenance work. In other words, when the second transport assembly 32 is separated from the first transport assembly 31 or returned to an original position, a burden to a user or components, such as the guide rails 70 and 71 or sliders, to hold the second transport assembly 32 can be reduced.

In the cooling device 9 according to this exemplary embodiment, as described above, the position of the second transport assembly 32 having a smaller number of the cooling rollers 251 with the same configuration than the first transport assembly 31 is displaceable relative to the first transport assembly 31 so as to come close to and separate from the first transport assembly 31. Such a configuration allows use of common parts in the cooling rollers 251 and accompanying components, such as the radiation fins 253 and the guide members 255, thus reducing cost of the cooling device 9.

Another example of the displacement mechanism to displace the position of the second transport assembly 32 relative to the first transport assembly 31 is shown in FIGS. 50A and 50B. For the example shown in FIGS. 50A and 50B, at least one of the first transport assembly 31 and the second transport assembly 32 swings around a swing shaft 214 disposed at a side distal to the user side indicated by arrow U in FIGS. 50A and 50B. In such a case as well, as illustrated in FIGS. 50A and 50B, displacing the position of the lighter second transport assembly 32 reduces burden to a user. As illustrated in FIG. 50B, such a configuration reduces stress to the swing shaft 214 of a hinge part, a shaft holding portion 213 of the side plate 62 on which the swing shaft 214 is mounted, a boss portion 233 of the side plate 65 that has a swing-shaft hole 234 and is swingably supported by the swing shaft 214. As a result, such a configuration reduces the cost and increases the product life of the hinge part (displacement assembly or approach-and-separation member) to hold the second transport assembly 32 when the position of the second transport assembly 32 relative to the first transport assembly 31 is displaced.

In the above-described exemplary embodiment, the first transport assembly 31 and the second transport assembly 32 have the same configuration of cooling members, i.e., the cooling rollers 251. It is to be noted that the configuration of cooling members is not limited to the above-described exemplary embodiment but may be any other suitable configuration. For example, the diameter of the cooling rollers may be different between the first transport assembly 31 and the second transport assembly 32. In such a case, when the position of the first transport assembly 31 or the second transport assembly 32 is displaced, a lighter one of the first transport assembly 31 and the second transport assembly 32 with respect to the total weight of components held by each holding frame is displaced instead of a smaller number of the cooling rollers. In a configuration as well in which only one of the first transport assembly 31 and the second transport assembly 32 has cooling rollers, when the position of the first transport assembly 31 or the second transport assembly 32 is displaced, a lighter one with respect to the total weight of components held by each holding frame is displaced.

Next, different exemplary embodiments are described with reference to FIGS. 51A, 51B, 52A, and 52B.

Figure 51A:
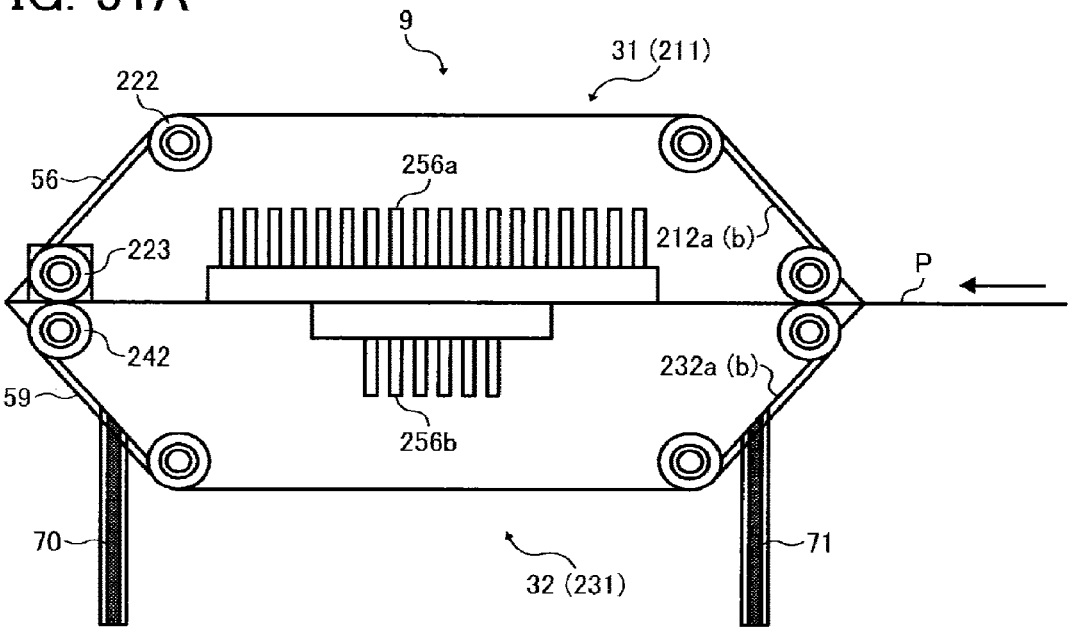
FIG. 51A is a schematic side view of another configuration of the cooling device.
Figure 51B:
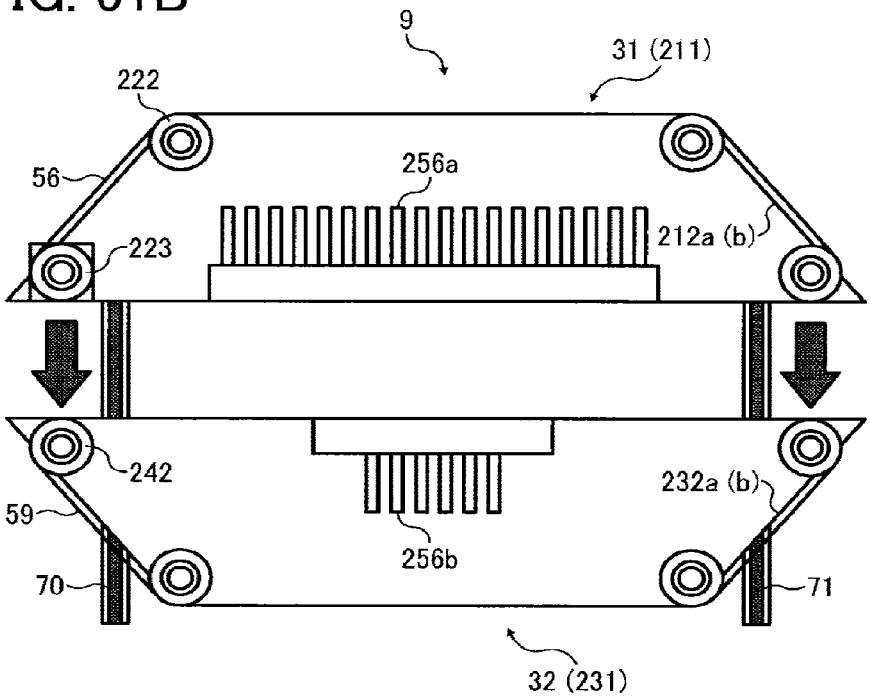
FIG. 51B is a schematic side view of the cooling device of FIG. 51A in a separation state.
Figure 52A:
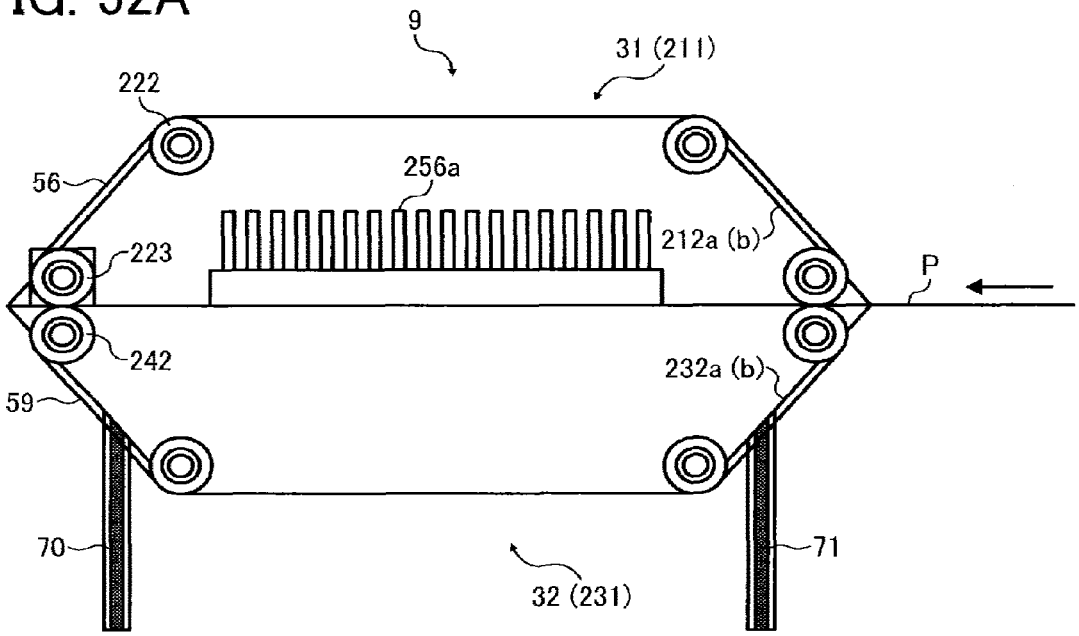
FIG. 52A is a schematic side view of another configuration of the cooling device.
Figure 52B:
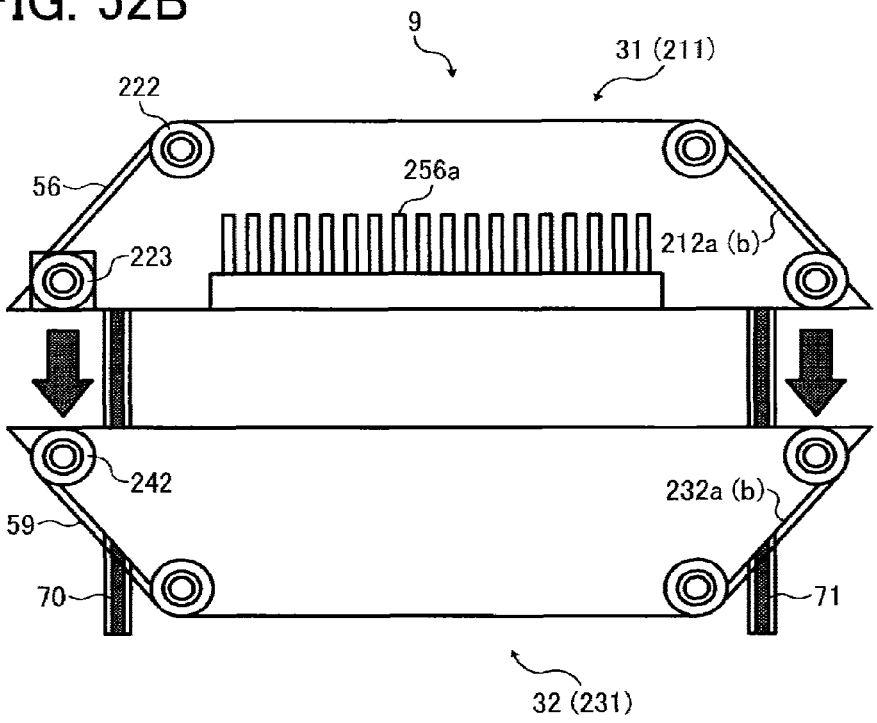
FIG. 52B is a schematic side view of the cooling device of FIG. 52A in a separation state.

FIGS. 51A and 51B are schematic views of a cooling device 9 according to an exemplary embodiment of this disclosure. FIG. 51A shows a state in which a recording material P is sandwiched by a first transport assembly 31 and a second transport assembly 32. FIG. 51B shows a state in which the first transport assembly 31 and the second transport assembly 32 are separated from each other. FIGS. 52A and 52B are schematic views of a cooling device 9 according to an exemplary embodiment of this disclosure. FIG. 52A shows a state in which a recording material P is sandwiched by a first transport assembly 31 and a second transport assembly 32. FIG. 51B shows a state in which the first transport assembly 31 and the second transport assembly 32 are separated from each other.

The cooling device 9 illustrated in FIGS. 51A and 51B or 52A and 52B differs from the above-described cooling device 9 illustrated in FIGS. 48A to 50B in the following configuration. In the cooling device 9 illustrated in FIGS. 48A to 50B, the cooling rollers 251 serving as cooling members directly contact the recording material P. By contrast, for the cooling device 9 illustrated in FIGS. 51A and 51B or 52A and 52B, each of the first transport assembly 31 and the second transport assembly 32 has a belt transport assembly, and at least one air-cooling heat sink 256 indirectly contacts the recording material P via an conveyance belt. Therefore, configurations similar to the above-described cooling device 9 illustrated in FIGS. 48A to 50B and operation effects thereof are omitted below for simplicity. Further, the same reference codes are allocated to the same members or components having similar functions unless specified.

In FIGS. 51A and 51B, the cooling device 9 has two sandwiching parts, i.e., the first transport assembly 31 and the second transport assembly 32. The first transport assembly 31 sandwiches a recording material P from a front face side of the recording material P on which toner adheres in a softened state. The second transport assembly 32 sandwiches the recording material P from a back face side of the recording material P.

The first transport assembly 31 includes three front-face-side tension rollers 222, a front-face-side driving roller 223, and a conveyance belt 56 stretched over the tension rollers 222. A stretched surface of the conveyance belt 56 contacts a recording material P at a lower side in FIGS. 51A and 51B. An air-cooling heat sink 256*a* is disposed on an inner circumferential side of the stretched surface at the lower side. The air-cooling heat sink 256*a* is larger in size and weight than an air-cooling heat sink 256*b* of the second transport assembly 32. When the first transport assembly 31 and the second transport assembly 32 sandwich and convey a recording material P, the air-cooling heat sink 256*a* absorbs heat from the recording material P via the conveyance belt 56 and radiates heat from radiation fins that are integral part of the air-cooling heat sink 256*a*, thus cooling the recording material P from the front-face-side.

The second transport assembly 32 includes four back-face-side tension rollers 242 and a conveyance belt 59 stretched over the tension rollers 242. A stretched surface of the conveyance belt 59 contacts a recording material P at an upper side in FIGS. 51A and 51B. The air-cooling heat sink 256*b* is disposed on an inner circumferential side of the stretched surface at the upper side. The air-cooling heat sink 256*b* is smaller in size and weight than the air-cooling heat sink 256*a* of the first transport assembly 31. When the first transport assembly 31 and the second transport assembly 32 sandwich and convey a recording material P, the air-cooling heat sink 256*b* absorbs heat from the recording material P via the conveyance belt 59 and radiates heat from radiation fins that are integral part of the air-cooling heat sink 256*b*, thus cooling the recording material P from the front-face-side.

The first transport assembly 31 has the front-face-side driving roller 223. When the front-face-side driving roller 223 is driven for rotation, the conveyance belt 56 is rotated clockwise in FIGS. 51A and 51B. Thus, the conveyance belt 59 to contact the conveyance belt 56 directly or indirectly via the conveyance belt 56 is rotated by the rotation of the conveyance belt 56. As described above, the first transport assembly 31 has the large-size air-cooling heat sink 256*a*. The first transport assembly 31, which is likely to have a greater resistance in transport, is rotated by the front-face-side driving roller 223. Such a configuration suppresses occurrence of transport failure of a recording material P with first transport assembly 31 and the second transport assembly 32. The air-cooling heat sink 256*a* and the air-cooling heat sink 256*b* contact a recording material P via the conveyance belt 56 and the conveyance belt 59. Such a configuration effectively cools the recording material P sandwiched and conveyed by the conveyance belt 56 and the conveyance belt 59. Such a configuration also allows setting of a broader cooling surface than a configuration in which roller-type cooling members, such as the cooling rollers 251 of FIGS. 48A to 50B, are employed, thus obtaining higher cooling effect.

When the first transport assembly 31 and the second transport assembly 32 are moved to come close to or separate from each other at occurrence of a jam of a recording material P in the cooling device 9, the second transport assembly 32 having the air-cooling heat sink 256*b* lighter than the air-cooling heat sink 256*a* can be moved. After the second transport assembly 32 is moved, a jammed recording material P or a recording material P remaining between the first transport assembly 31 and the second transport assembly 32 can be removed. In FIGS. 51A and 51B, the conveyance belt 59 of the second transport assembly 32 moved as described above is provided with the air-cooling heat sink 256*b*, which is smaller in size and weight than the air-cooling heat sink 256*a* of the first transport assembly 31.

Such a configuration gives less burden to a user in separation or return to the original position than a configuration in which the position of the first transport assembly 31 is displaced (moved). Such a configuration gives less burden to components such as the guide rails 70 and 71, the sliders, and so on to hold the second transport assembly 32 displaced. As a result, when the first transport assembly 31 and the second transport assembly 32 are moved to come close to or separate from each other, the burden to a user or components to hold the displaced sandwiching part due to the weight of the cooling members and accompanying components.

In FIGS. 51A and 51B, the first transport assembly 31 and the second transport assembly 32 includes the air-cooling heat sink 256*a* and the air-cooling heat sink 256*b* serving as cooling members. However, the configuration of the first transport assembly 31 and the second transport assembly 32 are not limited to the above-described configuration. For example, as illustrated in FIGS. 52A and 52B, only the first transport assembly 31 may have the air-cooling heat sink 256*a*. For such a configuration as well, the second transport assembly 32 having a smaller total weight of components held by each holding frame is displaced.

Next, a cooling device 9 according to an exemplary embodiment of this disclosure is described with reference to FIGS. 53A and 53B.

Figure 53A:
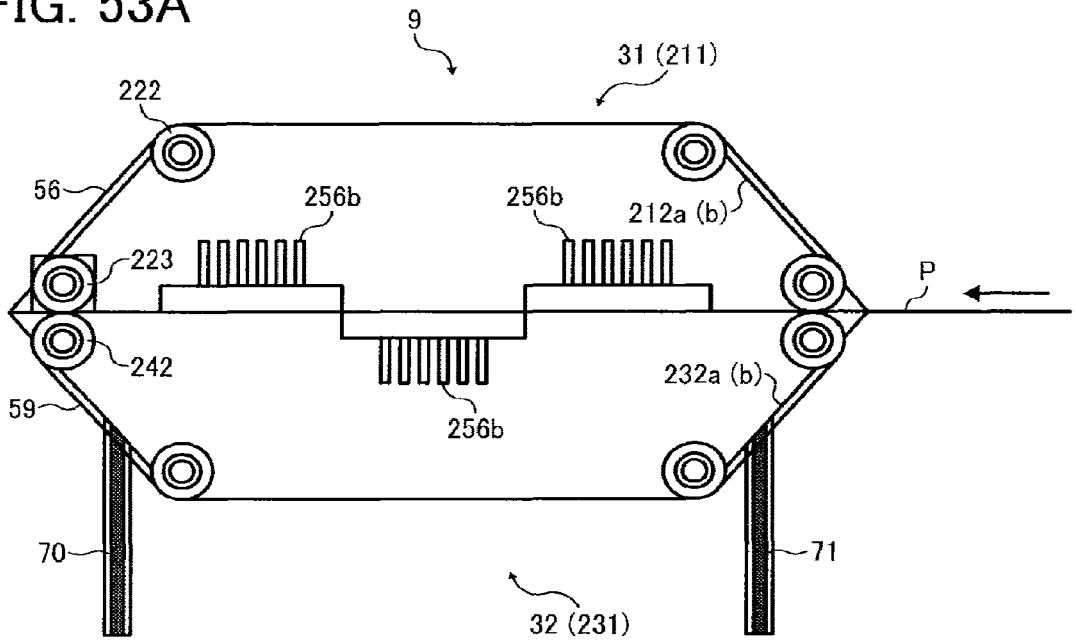
FIG. 53A is a schematic side view of another configuration of the cooling device.

FIG. 53A is a schematic view of the cooling device 9 in a state in which a recording material P is sandwiched by a first transport assembly 31 and a second transport assembly 32. FIG. 53B is a schematic view of the cooling device 9 in a state in which the first transport assembly 31 and the second transport assembly 32 are separated from each other.

The cooling device 9 illustrated in FIGS. 53A and 53B differs from the cooling device 9 illustrated in FIGS. 51A and 51B in the following configuration. For the cooling device 9 illustrated in FIGS. 51A and 51B, the large-size air-cooling heat sink 256*a* and the small-size air-cooling heat sink 256*b* face each other via the conveyance belt 56 and the conveyance belt 59. By contrast, for the cooling device 9 illustrated in FIGS. 53A and 53B, first transport assembly 31 and the second transport assembly 32 have different numbers of air-cooling heat sinks 256*b* of the same configuration, and the air-cooling heat sinks 256*b* are staggered in the recording-material transport direction. Therefore, configurations similar to the above-described cooling device 9 illustrated in FIGS. 51A to 51B and operation effects thereof are omitted below for simplicity. Further, the same reference codes are allocated to the same members or components having similar functions unless specified.

Here, for the cooling device 9 illustrated in FIGS. 51A and 51B, if the contact between each air-cooling heat sink 256 and the conveyance belt 56 is enhanced to increase heat conductivity therebetween, a relatively large transport resistance may arise in a portion sandwiched by the air-cooling heat sinks 256*a* and 256*b*. Such large transport resistance may hamper transport of a recording material P by the first transport assembly 31 and the second transport assembly 32. Hence, for the cooling device 9 illustrated in FIGS. 53A and 53B, the first transport assembly 31 and the second transport assembly 32 have different numbers of the air-cooling heat sinks 256*b* serving as cooling members, and the air-cooling heat sinks 256*b* are staggered in the recording-material transport direction.

Specifically, as illustrated in FIG. 53A, in the configuration in which a recording material P is conveyed by the conveyance belt 56 and the conveyance belt 59, one small-size air-cooling heat sink 256*b* of the second transport assembly 32 is disposed between two small-size air-cooling heat sinks 256*b* of the first transport assembly 31. As described above, the number of the small-size air-cooling heat sinks 256*b* of the same configuration is different and the air-cooling heat sinks 256*b* are staggered in the recording-material transport direction. Such a configuration eliminates portions sandwiched between the air-cooling heat sinks, thus reducing transport resistance when a recording material P is sandwiched and conveyed. Such a configuration allows more effective cooling than a configuration as illustrated in FIGS. 52A and 52B in which only one of the transport assemblies (e.g., the first transport assembly 31) has a cooling member (e.g., large-size air-cooling heat sink 256*a*). Such a configuration also allows more stable transport of a recording material P with less transport resistance than the configuration illustrated in FIGS. 51A and 51B in which the large-size air-cooling heat sink 256*a* and the small-size air-cooling heat sink 256*b* face each other via the conveyance belt 56 and the conveyance belt 59.

Figure 53B:
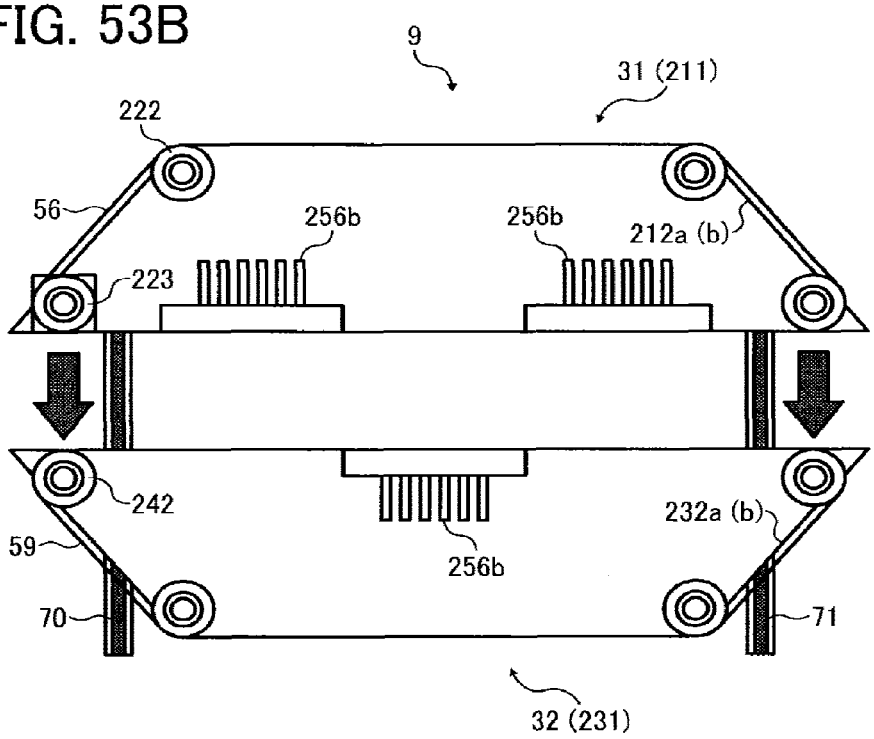
FIG. 53B is a schematic side view of the cooling device of FIG. 53A in a separation state.

For the cooling device 9 illustrated in FIGS. 53A and 53B, since the small-size air-cooling heat sinks 256*b* of the same configuration are employed as cooling members, the position of the second transport assembly 32 that is smaller in the number of the air-cooling heat sinks 256*b* is displaceable (movable). The cooling device 9 having such a configuration gives effects equivalent to those of, e.g., the cooling device 9 illustrated in FIGS. 48A to 50A or FIGS. 51A and 51A. In other words, when the first transport assembly 31 and the second transport assembly 32 are moved to come close to or separate from each other, the burden to a user or components to hold the displaced sandwiching part due to the weight of the cooling members and accompanying components.

For the cooling device 9 illustrated in FIGS. 53A and 53B, as described above, the position of the second transport assembly 32, which is smaller in the number of the small-size air-cooling heat sinks 256*b* of the same configuration than the first transport assembly 31, is displaceable so as to come close to or separate from the first transport assembly 31, which is larger in the number of the small-size air-cooling heat sinks 256*b*. Such a configuration allows use of common parts in the small-size air-cooling heat sinks 256*b* serving as cooling members and accompanying components, such as stays to mount the air-cooling heat sinks 256*b* to respective holding frames, thus reducing cost of the cooling device 9. Additionally, use of common parts in the tension rollers and the conveyance belts is facilitated, thus allows further cost reduction of the cooling device 9.

Figure 54:
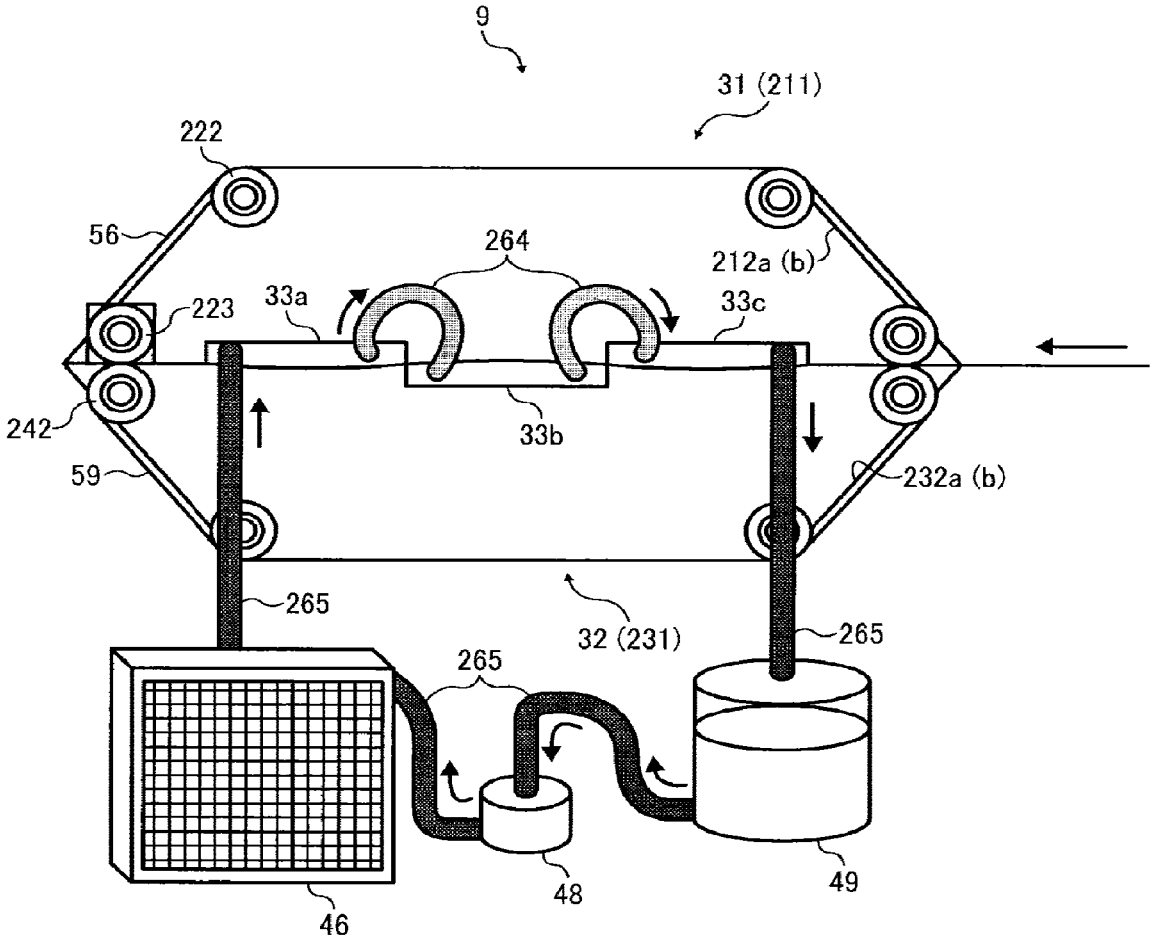
FIG. 54 is a schematic side view of another configuration of the cooling device.
Figure 55B:
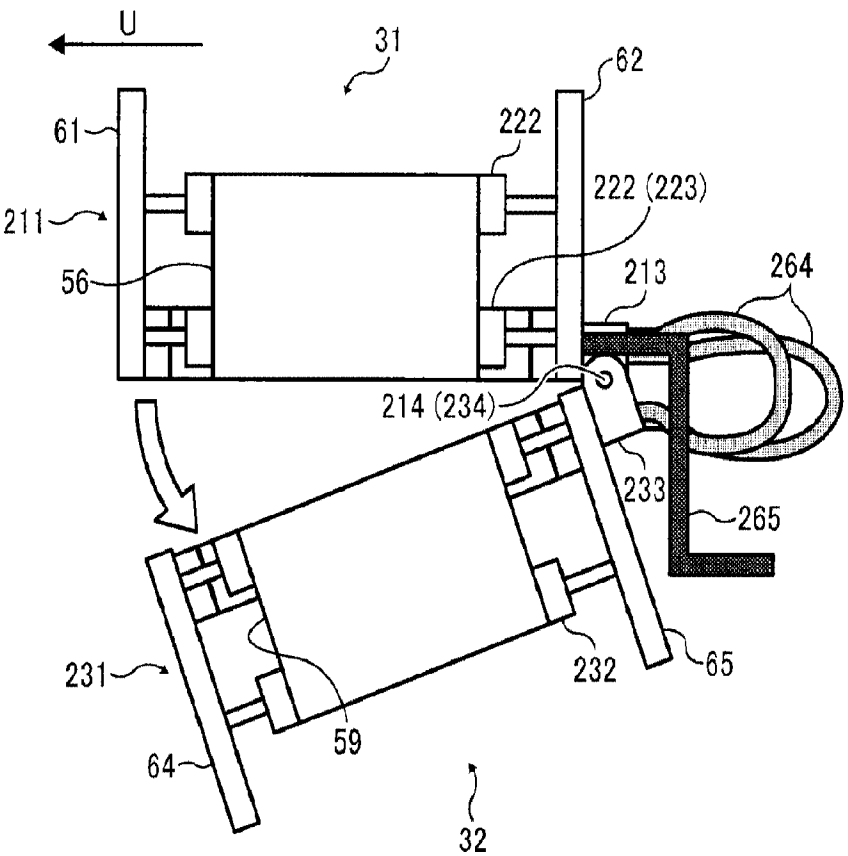
FIG. 55B is a front view of the cooling device of FIG. 54 in a state after separation.
Figure 55A:
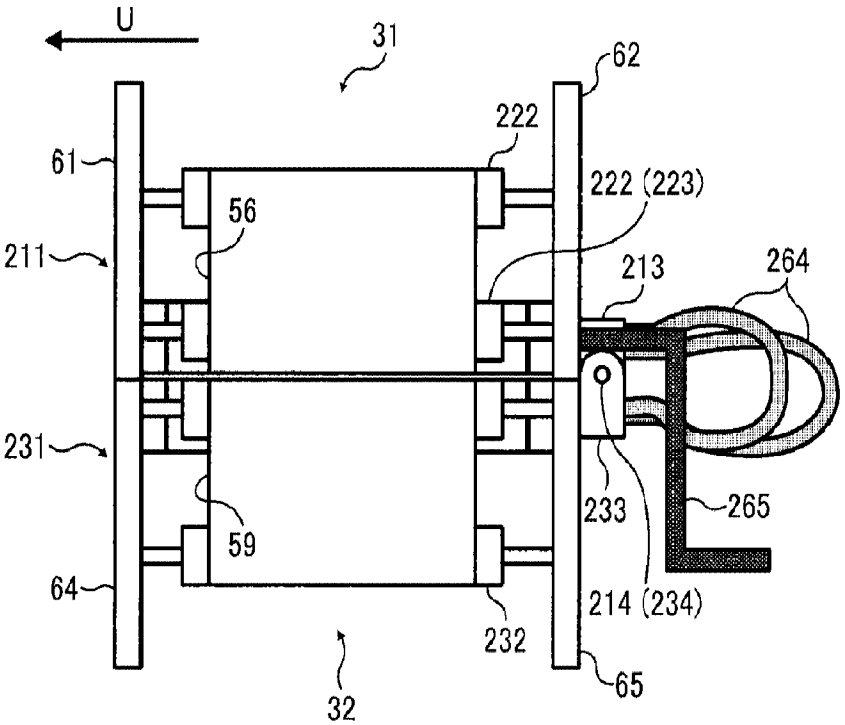
FIG. 55A is a front view of an example of the cooling device of FIG. 54 in a state before separation.
Figure 56B:
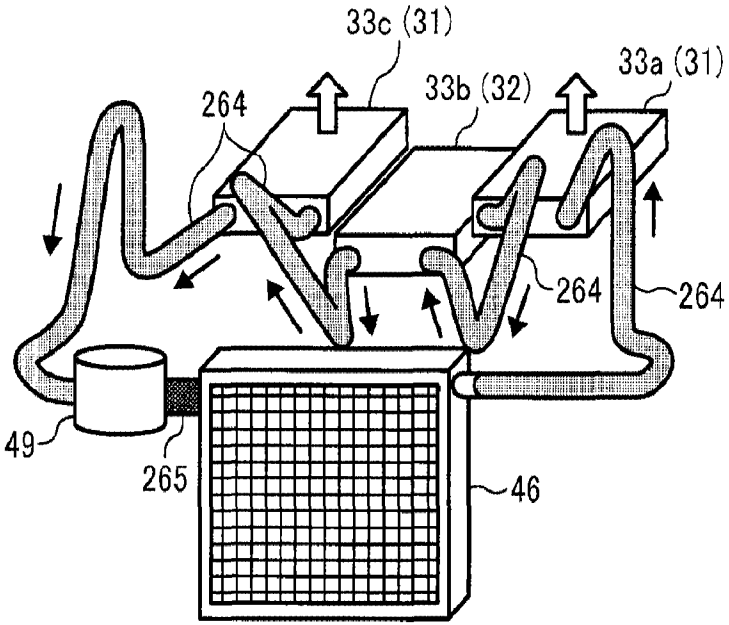
FIG. 56B is a perspective view of another configuration of channel formation members in the cooling device of FIG. 54.
Figure 56A:
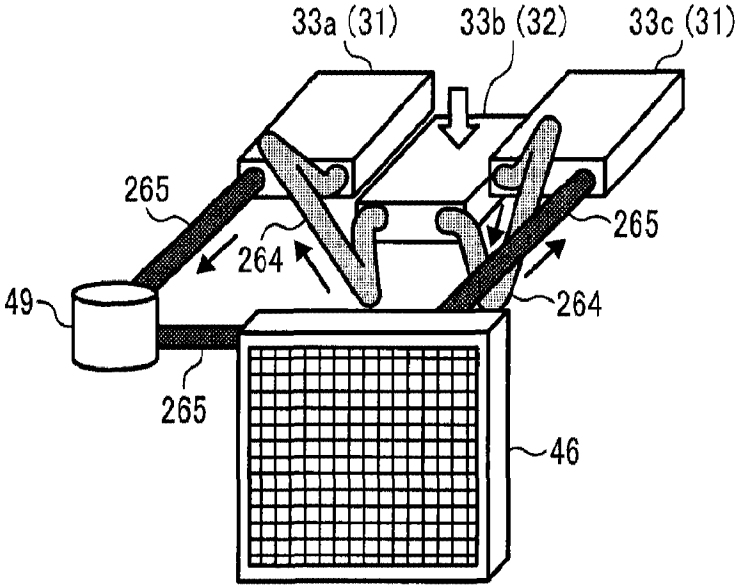
FIG. 56A is a perspective view of a configuration of channel formation members in the cooling device of FIG. 54.

Next, a cooling device 9 according to an exemplary embodiment of this disclosure is described with reference to FIGS. 54, 55A, 55B, 56A, and 56B. FIG. 54 is a schematic view of the cooling device 9 according to this exemplary embodiment. FIGS. 55A and 55B are schematic views of a configuration of the cooling device 9 in which a lighter one of a first transport assembly 31 and a second transport assembly 32, i.e., the second transport assembly 32 swings around a swing fulcrum relative to a heavier one, i.e., the first transport assembly 31. FIG. 55A is a schematic view of the cooling device 9 in a state in which a recording material P is sandwiched by the first transport assembly 31 and the second transport assembly 32. FIG. 55B is a schematic view of the cooling device 9 in a state in which the first transport assembly 31 and the second transport assembly 32 are separated from each other. FIGS. 56A and 56B are perspective view of different configurations of cooling members and a cooling-liquid channel. In FIG. 54, connections of rubber tubes 264 and metal pipes 265, serving as channel formation members, to cooling members 33*a*, 33*b*, and 33*c* are indicated by solid lines for convenience though some of the connections are indeed on a back side of FIG. 54.

The cooling device 9 according to this exemplary embodiment differs from the cooling device 9 illustrated in FIGS. 53A and 53B in the following configuration. For the cooling device 9 illustrate in FIGS. 53A and 53B, the air-cooling heat sinks 256*b* of air cooling system is employed as the cooling members disposed on the conveyance belt 56 and the conveyance belt 59. By contrast, the cooling device 9 according to this exemplary embodiment employs the cooling members 33 serving as liquid cooling members of liquid cooking system including an internal channel for cooling liquid. Therefore, configurations similar to the above-described cooling device 9 illustrated in FIGS. 53A to 53B and operation effects thereof are omitted below for simplicity. Further, the same reference codes are allocated to the same members or components having similar functions unless specified.

The cooling device 9 according to this exemplary embodiment employs a cooling unit of a liquid cooling system (hereinafter, liquid cooling unit) providing a higher cooling performance than a typical cooling unit of an air cooling system using, e.g., air-cooling heat sinks. For example, as illustrated in FIG. 54, as the cooling members, the first transport assembly 31 has the cooling members 33*a* and 33*c*, each of which includes an internal channel, and the second transport assembly 32 has the cooling members 33*b* including an internal channel for cooling liquid. Each of the cooling members 33*a*, 33*b*, and 33*c* absorbs heat of a recording material P from a cooling surface thereof via a conveyance belt 56 or a conveyance belt 59 that slide over and contact the corresponding cooling member(s) 33. Cooling liquid flowing though the internal channel is delivered to the outside of each cooling member 33 to maintain a low temperature, thus cooling the recording material P. Each liquid cooling member 33 has an inlet and an outlet of cooling liquid passing through the internal channel, in one lateral face in a width direction of the recording material P perpendicular to the transport direction of the recording material P. The lateral faces of the cooling members 33*a*, 33*b*, and 33*c* are arranged on the same side, and channel formation members forming external channels of cooling liquid are connected to the inlets and the outlets.

The cooling liquid flowing through the internal channel of each cooling member 33 is stored in a liquid tank 49 and fed by a pump 48 serving as a liquid feed pump. Then, the cooling liquid passes through a heat dissipating part 46 serving as a heat exchanger to radiate heat to outside air, thus reducing the temperature. The cooling liquid thus cooled passes through the inside of each liquid cooling plate 258, receives (absorbs) heat from each liquid cooling plate 258 by thermal transmission, and returns to the liquid tank 49 at a high temperature.

Here, the cooling members 33*a*, 33*b*, and 33*c*, the liquid tank 49, the pump 48, and the heat dissipating part 46, serving as liquid cooling members forming the liquid cooling unit, are connected to the channel formation members to form the external channels, e.g., metal pipes, thus forming channels of the cooling liquid. However, if the channel formation members are formed of, e.g., typical metal pipes, it would be difficult to hold the two cooling members 33 of the displaceable second transport assembly 32 integrally with the side plate 64 within the second transport assembly 32.

This is because connecting the cooling members 33 with, e.g., metal pipes makes it difficult to displace the position of the second transport assembly 32 relative to the first transport assembly 31 in, e.g., the following reason. The position of the cooling members 33*b* of the second transport assembly 32 would displace in any of a configuration in which the second transport assembly 32 is displaced in parallel to the first transport assembly 31 with the guide rails 70 and 71 and a configuration in which the second transport assembly 32 is displaced by the hinge part. Accordingly, if the channel formation members connected to the two cooling members 33*a* and 33*b* of the first transport assembly 31 are, e.g., metal pipes, the second transport assembly 32 might not displace relative to the first transport assembly 31 or the metal pipes might be damaged. To prevent such failures, when the second transport assembly 32 is displaced, it is conceivable to drain cooling liquid from at least the cooling members 33 and the metal pipes connected thereto and detach the metal pipes to displace the second transport assembly 32. However, such a configuration is not advantageous in operability and cost. Alternatively, it is conceivable to provide air-tight slide joints or rotary joints with the metal pipes. However, such a configuration is not easily implemented in an actual product from perspectives of processing accuracy, assembling accuracy, and cost.

Hence, in the present exemplary embodiment, the channel formation members, which is connected to the cooling members forming the liquid cooling unit to form channels for the cooling liquid, have the following configuration. The three cooling members 33*a*, 33*b*, and 33*c* are connected via the rubber tubes 264 serving as flexible members. Other liquid cooling members, such as the liquid tank 49, the pump 48, and the heat dissipating part 46, forming part of the liquid cooling unit of the liquid cooling system are connected via the metal pipes 265. Of the three cooling members 33, the liquid cooling plate 258*a* most upstream in a delivery direction of the cooling liquid from the heat dissipating part 46 is connected to the heat dissipating part 46 via one of the metal pipes 265, and the liquid cooling plate 258*c* most downstream in the delivery direction from the heat dissipating part 46 is connected to one of the metal pipes 265. The liquid cooling members of the liquid cooling unit, such as the cooling members 33, the liquid tank 49, the pump 48, and the heat dissipating part 46, form the channels of cooling liquid with the rubber tubes 264 and the metal pipes 265.

As described above, in this exemplary embodiment, the channel formation members connected to the liquid cooling members forming the liquid cooling unit include the rubber tubes 264. Such a configuration allows the channel formation members to follow displacement of connecting portions of the cooling members 33*b* before and after the position of the second transport assembly 32 is displaced. Accordingly, in the configuration in which the cooling members 33 serving as the liquid cooling members forming part of the liquid cooling unit are employed as the cooling members, the position of the second transport assembly 32, which is smaller in weight, is displaceable (movable or rotatable) without draining the cooling liquid.

However, the flexible members, such as the rubber tubes 264, might deteriorate or be damaged by repeated bending or tension. Hence, to prevent such failures, it is conceivable to sufficiently increase the length of the flexible members to form a long track so that a sudden change of the track does not occur at a specific position. However, considering the internal space, layout, and cost of the apparatus body 200, the track cannot be extended so long. Hence, in this exemplary embodiment, a displacement assembly (approach-and-separation member) to displace the position of the second transport assembly 32, which is smaller in weight, relative to the first transport assembly 31, which is larger in weight, has the following configuration. As illustrated in FIGS. 55A and 55B, a side plate 62 is disposed at a side distal to a user side of the front-face-side holding frame 211 (the first transport assembly 31), and a side plate 65 is disposed at a side distal to a user side of the back-face-side holding frame 231 (the second transport assembly 32). A hinge part is provided at the side plate 62 and the side plate 65 to swing the second transport assembly 32.

In this exemplary embodiment, the hinge part has a configuration in which the configuration of the hinge part illustrated in FIG. 50B is modified as follow. As illustrated in FIG. 55A, at an end of the side plate 62 opposing the side plate 65, a swing-shaft holding portion 213 is disposed so as to protrude toward an outside of the front-face-side holding frame 211. The swing-shaft holding portion 213 holds the swing shaft 214. At an end of the side plate 65 opposing the side plate 62, a boss portion 233 is disposed so as to protrude toward an outside of front-face-side holding frame 211. The boss portion 233 has a swing-shaft hole 234 rotatably supported by the swing shaft 214. The swing shaft 214 held by the shaft holding portion 213 of the side plate 62 is inserted into the swing-shaft hole 234 of the boss portion 233 of the side plate 61. Thus, the displacement assembly (hinge part) is configured to rotate the back-face-side holding frame 231 relative to the front-face-side holding frame 211.

In the displacement assembly thus configured, as illustrated in FIGS. 54, 55A, and 55B, the cooling members 33*a*, 33*b*, and 33*c* are connected to the rubber tubes 264 at lateral faces thereof at a side at which the hinge part is disposed, i.e., a side opposite the user side indicated by arrow U. In other words, all of the rubber tubes 264 connecting the cooling members 33*a*, 33*b*, and 33*c* to each other are connected to the lateral faces on the same side of the cooling members 33. As a result, when, as illustrated in FIG. 55B, the position of the second transport assembly 32, which is lighter in weight, is displaced relative to the first transport assembly 31, which is heavier in weight, from a state illustrated in FIG. 55A, such a configuration suppresses a change in the tracks of the rubber tubes 264, thus suppressing deterioration or breakage of the rubber tubes 264 due to repeated occurrences of bending or tension in the tracks. Additionally, when the first transport assembly 31 and the second transport assembly 32 are moved away from each other for maintenance work, such a configuration prevents the flexible rubber tubes 264 from hampering user's operation or being damaged.

In this exemplary embodiment, in addition to the rubber tubes 264, the cooling member 33*a* most upstream and the cooling members 33*c* most downstream in the delivery direction of the cooling liquid are connected to the heat dissipating part 46 and the liquid tank 49, respectively, via the metal pipes 265. In other words, all of the channel formation members, such as the rubber tubes 264 and the metal pipes 265, connected to the cooling members 33 are connected to the lateral faces on the same side of the cooling members 33. Thus, when the first transport assembly 31 and the second transport assembly 32 are moved away from each other for maintenance work, such a configuration prevents the channel formation members connected to the cooling members 33 from hampering user's operation or prevents the flexible rubber tubes 264 from being damaged.

When the recording material P is jammed during passing through the cooling device 9 or an image forming apparatus urgently stops for other reason, the second transport assembly 32, which is smaller in the number of the cooling members 33 and lighter in weight, is rotated around the swing shaft 214 as illustrated in FIG. 55B. With such a rotation, the second transport assembly 32 is moved away from the first transport assembly 31, and a recording-material transport surface of the conveyance belt 59 of the second transport assembly 32 is opened from a recording-material transport surface of the conveyance belt 56 of the first transport assembly 31. Thus, a user can remove a recording material P jammed or stopped.

As described above, unless at least three cooling members 33 are connected to each other via flexible and deformable members, such as the rubber tubes 264, such rotation of the second transport assembly 32 would be difficult. However, for the configuration illustrated in FIG. 55A, since other components are not moved, the metal pipes 265 more reliably preventing leakage of the cooling liquid are employed to connect the liquid cooling members forming the liquid cooling unit. Alternatively, the rubber tubes 264 may be employed instead of the metal pipes 265.

In this exemplary embodiment, as illustrated in FIGS. 54, 55A, and 55B, the number of cooling members 33 is different between the first transport assembly 31 and the second transport assembly 32. The position of the second transport assembly 32, which is smaller in the number of cooling members 33, is displaceable relative to the first transport assembly 31, which is larger in the number of cooling members 33.

With such a configuration, even in an example illustrated in FIG. 56A in which the liquid tank 49 is not provided, the second transport assembly 32 which is smaller in the number of cooling members 33 is displaceable. Such a configuration can reduce the number of flexible channel formation members, such as the rubber tubes 264, to connect the cooling members 33*b* of the displaceable second transport assembly 32 to other cooling members of the liquid cooling unit. In other words, when the second transport assembly 32, which is smaller in the number of cooling members 33, is displaced, the first transport assembly 31, which is larger in the number of cooling members 33, can be maintained in fixed state. Such a configuration allows the metal pipes 265 to be employed to connect the cooling members 33*a* and 33*c* of the first transport assembly 31 in fixed state to other liquid cooling members, such as the heat dissipating part 46, forming part of the liquid cooling unit. Thus, the number of flexible rubber tubes 264 can be reduced.

The configuration illustrated in FIG. 56A is further described below.

For example, the number of rubber tubes 264 can be limited to two: one connects the cooling members 33*a* most upstream of the first transport assembly 31 in the delivery direction of the cooling liquid to the cooling members 33*b* of the second transport assembly 32, and the other connects the cooling members 33*c* most downstream of the first transport assembly 31 in the delivery direction to the cooling members 33*b* of the second transport assembly 32. Metal pipes 265 can be employed as channel formation members connecting other liquid cooling members that form part of the liquid cooling unit. Such a configuration can reduce the setting points of the rubber tubes 264 serving as flexible channel formation members that might be damaged during maintenance work or deteriorate or break due to repeated bending and as a result, might cause failures, such as leakage of the cooling liquid.

Here, a description is given of a comparative example in which the position of a first transport assembly 31, which is larger in the number of cooling members 33, is displaceable relative to the second transport assembly 32, which is smaller in the number of cooling members 33. As illustrated in FIG. 56B, in a configuration in which a liquid tank 49 is not provided, the first transport assembly 31 having a larger number of cooling members 33 (i.e., cooling members 33*a* and 33*c*) is displaceable. Such a configuration has an increased number of flexible channel formation members, such as rubber tubes 264, to connect the cooling members 33*a* and 33*c* of the first transport assembly 31 to other liquid cooling members of the liquid cooling unit.

For example, as illustrated in FIG. 56B, all of four channel formation members connected to the cooling members 33*a* and 33*c* of the first transport assembly 31 and the cooling members 33*b* of the second transport assembly 32 are formed of rubber tubes 264. As a result, in the comparative example of FIG. 56B, only one channel formation member not connected to the cooling members 33 is formed of a metal pipe 265.

In some of the above-described exemplary embodiments of this disclosure, the position of the lighter second transport assembly 32 is displaced relative to the heavier first transport assembly 31 to bring the second transport assembly 32 and the first transport assembly 31 away from each other. The cooling device 9 according to this exemplary embodiment may also have the following configuration. For example, the cooling device 9 may have a lock unit to maintain a state in which the position of the second transport assembly 32 is displaced away from the first transport assembly 31, and a damper unit to cushion a shock caused when the second transport assembly 32 is moved away from the first transport assembly 31. The above-described exemplary embodiments also give an effect of reducing burden to components of the lock unit and the damper unit. In the above-description, the configuration of the cooling device 9 in which the first transport assembly 31 is heavier than the second transport assembly 32. It is to be noted that the configuration of the cooling device is not limited to such a configuration. For example, in some exemplary embodiments, the second transport assembly may be heavier than the first transport assembly.

The cooling device according to the above-described exemplary embodiments is applicable to, for example, an image forming apparatus employing an intermediate transfer system. However, it is to be noted that an applicable image forming apparatus is not limited to such a configuration but may have a direct transfer system or any other suitable system. In drawings, the first transport assembly 31 is disposed above a substantially horizontal transport path of recording material, and the second transport assembly 32 is disposed below the substantially horizontal transport path. However, it is to be noted that an applicable image forming apparatus is not limited to such a configuration. For example, the applicable image forming apparatus may have a cooling device in a substantially vertical transport path along which a recording material is transported upward. In the above-described exemplary embodiment, the image forming apparatus has one cooling device 9. However, it is to be noted that an applicable image forming apparatus is not limited to such a configuration. For example, in some exemplary embodiments, an image forming apparatus may have a plurality of cooling devices.

The above-descriptions relate to limited examples, and the present disclosure includes, e.g., the following aspects giving respective effects described below.

(Aspect A)

For example, in an aspect A of this disclosure, a cooling device includes a front-face-side sandwiching part (e.g., first transport assembly 31) and a back-face-side sandwiching part (e.g., second transport assembly 32) to sandwich a recording material (e.g., recording material P) from both a front-face-side and the back side of the recording material to convey the recording material. At least one of the front-face-side sandwiching part and the back-face-side sandwiching part has a cooling member(s) (e.g., cooling rollers 251) to directly or indirectly absorb heat of the recording material for cooling. The front-face-side sandwiching part and the back-face-side sandwiching part are different in weight from each other. A lighter one of the front-face-side sandwiching part and the back-face-side sandwiching part is displaceable relative to the other heavier one. In a state in which, for example, the heavier one (e.g., first transport assembly 31) is fixed, the lighter one (e.g., second transport assembly 32) is displaced to perform separating operation to bring the front-face-side sandwiching part and the back-face-side sandwiching part away from each other.

Such a configuration gives the following effects as described in the above-described exemplary embodiments illustrated FIGS. 48A to 50B. For example, the switching part displaced during the separating operation can be limited to the lighter one of the front-face-side sandwiching part and the back-face-side sandwiching part. As compared to a configuration in which both sandwiching parts are displaced, such a configuration can further reduce a burden to a user or members, such as the guide rails 70 and 71, holding the displaced sandwiching part due to the weight of the cooling members and accompanying components, such as the guide members 255. With such a configuration, when the front-face-side sandwiching part and the back-face-side sandwiching part are brought close to and away from each other in, e.g., maintenance work, the cooling device can more reduce the burden to a user or members holding the displaced sandwiching part due to the weight of the cooling members and accompanying components than the configuration in which both sandwiching parts are displaced.

(Aspect B)

In the above-described aspect A, each of the front-face-side sandwiching part (e.g., the first transport assembly 31) and the back-face-side sandwiching part (e.g., the second transport assembly 32) has at least one of the cooling members (e.g., the cooling rollers 251A, 251B, and 251C). With such a configuration, as described in the above-described exemplary embodiments illustrated FIGS. 48A to 50B, each of the front-face-side sandwiching part and the back-face-side sandwiching part has at least one cooling member, thus allowing more effective cooling of a recording material (e.g., recording material P) than a configuration in which one of the front-face-side sandwiching part and the back-face-side sandwiching part has the same number of cooling members as that of such a configuration.

(Aspect C)

In the above-described aspect A, the cooling member (e.g., cooling members 33) has an internal channel through which cooling liquid passes. The cooling device includes a liquid cooling unit. The liquid cooling unit includes a liquid cooling member and a channel formation member. The liquid cooling member includes at least the cooling member and a heat exchanger (e.g., heat dissipating part 46). The channel formation member (e.g., rubber tubes 264 or metal pipes 265) connects the liquid cooling member to form a channel through which the cooling liquid passes. The liquid cooling unit absorbs heat of the recording material (e.g., recording material P) with the cooling member and transmits the heat via the cooling liquid passing through the internal channel to the heat exchanger for radiation. Such a configuration gives the following effect as described in the above-described exemplary embodiments illustrated in FIGS. 54 to 56A. When the front-face-side sandwiching part and the back-face-side sandwiching part are brought close to or away from each other in, e.g., maintenance work, the cooling device can employ a liquid cooling system to more reduce a burden to a user or members holding the displaced sandwiching part due to the weight of the cooling members and accompanying components than the configuration in which both sandwiching parts are displaced.

(Aspect D)

In the above-described aspect B, the cooling member (e.g., cooling members 33) has an internal channel through which cooling liquid passes. The cooling device includes a liquid cooling unit. The liquid cooling unit includes liquid cooling members and channel formation members. The liquid cooling members are formed of at least a heat exchanger (e.g., heat dissipating part 46) and a plurality of cooling members (e.g., cooling members 33). The channel formation members (e.g., rubber tubes 264 or metal pipes 265) connect the liquid cooling members to form a channel through which the cooling liquid passes. The liquid cooling unit absorbs heat of the recording material (e.g., recording material P) with the cooling members and transmits the heat via the cooling liquid passing through the internal channels to the heat exchanger for radiation. The channel formation members have flexibility and connect the cooling members disposed at the displaceable sandwiching part to liquid cooling members of the liquid cooling members, the positions of which are maintained when the displaceable sandwiching part is displaced. Such a configuration gives the following effect as described in the above-described exemplary embodiments illustrated in FIGS. 54 to 56A. That is, even in a configuration in which liquid cooling members forming part of the liquid cooling unit are employed as the cooling members, the position of a lighter one of the sandwiching parts is displaceable (movable or rotatable) without draining cooling liquid from the channel formation members or the liquid cooling members, such as the cooling members, forming part of the liquid cooling unit.

(Aspect E)

In the above-described aspect D, each of the cooling members (e.g., the cooling members 33*a*, 33*b*, and 33*c*) have an inlet and an outlet at a lateral face at one end in a width direction of the recording material perpendicular to a transport direction of the recording material (e.g., recording material P). The cooling liquid passes through the internal channel via the inlet and the outlet of each of the cooling members. The channel formation members (e.g., rubber tubes 264) having flexibility are connected to the inlets or outlets formed at the lateral faces on the same side of the respective cooling members. As described in the above-described exemplary embodiments illustrated in FIGS. 54 to 56A, such a configuration can prevent the channel formation members having flexibility from hampering user's operation or being damaged when the front-face-side sandwiching part and the back-face-side sandwiching part are brought away from each other for, e.g., maintenance work.

(Aspect F)

In the above-described aspect D, each of the liquid cooling plates (e.g., cooling members 33*a*, 33*b*, and 33*c*) have an inlet and an outlet at a lateral face at one end in a width direction of the recording material perpendicular to a transport direction of the recording material (e.g., recording material P). The cooling liquid passes through the internal channel via the inlet and the outlet of each of the cooling members. The channel formation members (e.g., rubber tubes 264 or the metal pipes 265) having flexibility are connected to the inlets or outlets formed at the lateral faces on the same side of the respective cooling members. Such a configuration gives the following effect as described in the above-described exemplary embodiments illustrated in FIGS. 54 to 56A. When the front-face-side sandwiching part and the back-face-side sandwiching part are brought away from each other for, e.g., maintenance work, such a configuration can prevent the channel formation members connected to the cooling members from hampering user's operation. Such a configuration can also reduce the setting points of the channel formation members (e.g., rubber tubes 264) having flexibility that might be damaged during maintenance work or deteriorate or break due to repeated bending and as a result, might cause failures, such as leakage of the cooling liquid.

(Aspect G)

In the above-described aspect A or F, the cooling members (e.g., cooling rollers 251) disposed in at least one of the front-face-side sandwiching part (e.g., first transport assembly 31) and the back-face-side sandwiching part (e.g., second transport assembly 32) have the same configuration, and the front-face-side sandwiching part and the back-face-side sandwiching part are different from each other in the number of the cooling members. In a state in which a greater one of the front-face-side sandwiching part and the back-face-side sandwiching part in the number of the cooling members is fixed, the other smaller one in the number of the cooling members is displaced to perform the separating operation to bring the front-face-side sandwiching part and the back-face-side sandwiching part away from each other. Accordingly, as described in the above-described exemplary embodiments illustrated in FIGS. 48A to 50B, such a configuration can standardize the cooling members and components (e.g., radiation fins 253 or guide members 255) accompanying with the cooling members, thus allowing cost reduction of the cooling device.

Alternatively, in a configuration in which a liquid cooling system (liquid cooling unit) is employed as described in the above-described exemplary embodiment illustrated in FIGS. 53A and 53B, the following effect can be obtained. For example, when the sandwiching part having a smaller number of cooling members (e.g., liquid cooling plate 258*b*) is displaced, the sandwiching part having a greater number of cooling members (e.g., cooling members 33*a* and 33*c*) can be maintained in fixed state. As a result, less-flexible channel formation members (e.g., metal pipes 265) can be employed to connect the cooling members of the sandwiching part maintained in fixed state to other cooling members (e.g., heat dissipating part 46) forming part of the liquid cooling members. Such a configuration can reduce the setting points of the channel formation members (e.g., rubber tubes 264) having flexibility that might be damaged during maintenance work or deteriorate or break due to repeated bending and as a result, might cause failures, such as leakage of the cooling liquid.

(Aspect H)

In the above-described aspect A or G, each of the front-face-side sandwiching part (e.g., first transport assembly 31) and the back-face-side sandwiching part (e.g., second transport assembly 32) has a belt transport unit (e.g., first transport assembly 31 or the second transport assembly 32) including an endless belt member (e.g., conveyance belt 56 or conveyance belt 59) rotatably stretched over a plurality of rollers (e.g., tension rollers and front-face-side driving roller 223). As described in the above-described exemplary embodiments illustrated in FIGS. 51A to 52B, such a configuration allows setting of a broader cooling surface than a configuration in which roller-shaped rotary cooling members (e.g., cooling rollers 251*a*, 251B, and 251C) are employed, thus giving greater cooling effect.

(Aspect I)

In an aspect I of this disclosure, an image forming apparatus has the cooling device (e.g., cooling device 9) according to the above-described aspect A or H to cool the recording material (e.g., recording material P) while sandwiching and conveying the recording material. As described in the above-described exemplary embodiments illustrated in FIGS. 51A to 52B, such a configuration can provide an image forming apparatus giving effects equivalent to the cooling device according to the above-described aspect A or H.

What is claimed is:

1. An image forming apparatus, comprising:

a first conveyor including a first belt;

a second conveyor including a second belt to press against and convey a recording medium with the first belt;

a rail to guide the first conveyor in a horizontal direction; and a cooler including a plate to absorb heat from the recording medium, and a metal pipe to flow a liquid coolant to the plate, to cool the recording medium, the plate disposed within a loop of the first conveyor when the first conveyor is within the image forming apparatus, the plate disposed at least partially outside the first conveyor and inside the image forming apparatus when the first conveyor is disposed at least partially outside of the image forming apparatus.

2. The image forming apparatus according to claim 1, wherein:

the second conveyor moves downward when separating the first conveyor from the second conveyor.

3. The image forming apparatus according to claim 1, wherein the cooler is located above the recording medium conveyance path.

4. The image forming apparatus according to claim 1, further comprising:

a second cooler to cool the recording medium; and a second rail to guide the second conveyor in a horizontal direction, wherein the second cooler is disposed in the second conveyor when the second conveyor is within the image forming apparatus, and the second cooler is disposed at least partially outside the second conveyor and in the image forming apparatus when the second conveyor is disposed at least partially outside of the image forming apparatus.

5. The image forming apparatus according to claim 2, wherein:

the second conveyor pivots away from the first conveyor.

6. The image forming apparatus according to claim 5, further comprising:

a hinge mechanism to pivot the second conveyor downwardly and away from the first conveyor, when separating the first conveyor from the second conveyor.

7. The image forming apparatus according to claim 6, wherein:

the hinge mechanism is disposed at a back of the first conveyor and a back of the second conveyor.

8. An image forming apparatus, comprising:

a first conveyor including a first belt;

a second conveyor including a second belt to press against and convey a recording medium with the first belt;

a first rail to guide the first conveyor in a horizontal direction;

a first cooler to cool the recording medium, the first cooler disposed within a loop of the first conveyor when the first conveyor is within the image forming apparatus, the first cooler disposed at least partially outside the first conveyor and in the image forming apparatus when the first conveyor is disposed at least partially outside of the image forming apparatus;

a second cooler to cool the recording medium; and a second rail to guide the second conveyor in a horizontal direction, wherein the second cooler is disposed in the second conveyor when the second conveyor is within the image forming apparatus, and the second cooler is disposed at least partially outside the second conveyor and in the image forming apparatus when the second conveyor is disposed at least partially outside of the image forming apparatus.

9. The image forming apparatus according to claim 8, further comprising:

an elastic pressing member which presses one of the first cooler and the second cooler towards a corresponding one of the first belt and the second belt in order to press the recording medium.

10. The image forming apparatus according to claim 8, further comprising:

a first elastic pressing member which presses the first cooler towards the first belt in order to press the recording medium; and a second elastic pressing member which presses the second cooler towards the second belt in order to press the recording medium.

11. The image forming apparatus according to claim 8, wherein:

the first cooler includes a corresponding slot, and the first rail slides into the slot of the first cooler, when the first conveyor is within the image forming apparatus.

12. The image forming apparatus according to claim 8, wherein:

the first cooler includes a corresponding slot, the first rail slides into the slot of the first cooler, when the first conveyor is within the image forming apparatus, the second cooler includes a corresponding slot, the second rail slides into the slot of the second cooler, when the second conveyor is within the image forming apparatus.

* * * * *